US008061479B2

(12) United States Patent
Harris, Jr.

(10) Patent No.: US 8,061,479 B2
(45) Date of Patent: Nov. 22, 2011

(54) FALL PROTECTION SYSTEM

(76) Inventor: Rano J. Harris, Jr., Spanish Fort, AL (US)

( * ) Notice: Subject to any disclaimer, the term of this patent is extended or adjusted under 35 U.S.C. 154(b) by 656 days.

(21) Appl. No.: 11/099,373

(22) Filed: Apr. 5, 2005

(65) Prior Publication Data

US 2006/0113147 A1 Jun. 1, 2006

Related U.S. Application Data

(60) Provisional application No. 60/559,936, filed on Apr. 6, 2004.

(51) Int. Cl.
*A62B 1/00* (2006.01)

(52) U.S. Cl. ..... 182/3

(58) Field of Classification Search ..... 182/3, 187
See application file for complete search history.

(56) References Cited

U.S. PATENT DOCUMENTS

| | | | | | |
|---|---|---|---|---|---|
| 194,507 | A | * | 8/1877 | Wie | 188/65.4 |
| 312,085 | A | * | 2/1885 | Claghorn | 182/5 |
| 386,237 | A | | 7/1888 | Budd | |
| 556,099 | A | * | 3/1896 | Kingsbury | 188/65.5 |
| 946,588 | A | * | 1/1910 | Thuener | 188/65.4 |
| 1,574,529 | A | * | 2/1926 | Abraham | 182/7 |
| 3,260,328 | A | * | 7/1966 | McGowan | 182/5 |
| 4,102,431 | A | | 7/1978 | Carroll et al. | |
| 4,494,629 | A | * | 1/1985 | Raeburn | 188/65.5 |
| 4,553,633 | A | | 11/1985 | Armstrong et al. | |
| 4,662,475 | A | * | 5/1987 | Rutschi et al. | 182/5 |
| 4,714,135 | A | * | 12/1987 | Bell et al. | 182/6 |
| 4,830,340 | A | * | 5/1989 | Knitig | 254/391 |
| 4,877,110 | A | * | 10/1989 | Wolner | 182/232 |
| 4,938,435 | A | * | 7/1990 | Varner et al. | 244/142 |
| 5,107,956 | A | | 4/1992 | Constantinis et al. | |
| 5,131,491 | A | | 7/1992 | Varner et al. | |
| 5,145,028 | A | | 9/1992 | Wai | |
| 5,174,410 | A | * | 12/1992 | Casebolt | 182/3 |
| 5,228,412 | A | * | 7/1993 | Bell | 182/3 |
| 5,295,559 | A | * | 3/1994 | Nutkins | 188/65.4 |
| 5,360,082 | A | * | 11/1994 | Bell | 182/3 |
| 5,671,822 | A | | 9/1997 | Phillips | |
| 5,970,517 | A | | 10/1999 | Jordan | |
| 6,029,777 | A | * | 2/2000 | Rogelja | 182/193 |
| 6,062,340 | A | * | 5/2000 | Walker | 182/5 |
| 6,125,966 | A | * | 10/2000 | Jones | 182/3 |
| 6,305,024 | B1 | | 10/2001 | Schweer | |
| 6,487,725 | B1 | | 12/2002 | Jordan | |

(Continued)

OTHER PUBLICATIONS

"Seat-O-The-Pants" Product Brochure.

(Continued)

*Primary Examiner* — Katherine Mitchell
*Assistant Examiner* — Candace L Bradford
(74) *Attorney, Agent, or Firm* — Clark & Brody

(57) ABSTRACT

An improved fall protection system has been developed. The system functions by: (1) arresting the fall of such users, thereby protecting them from impact with the ground which could cause serious injury or death; (2) providing a method of recovery and escape from a fall-arresting device by providing a user with a controlled descent back to the ground or to a lower place of safety at a safe and gradual rate of descent; (3) providing greater simplicity and wearer comfort in fall-arresting and self-recovery devices; and (4) incorporating gear storage capability into such protective devices, in order to eliminate the need to wear a separate gear storage pack, vest, tool belt, or other such garment or accessory.

15 Claims, 43 Drawing Sheets

U.S. PATENT DOCUMENTS

| | | | | |
|---|---|---|---|---|
| 6,637,547 | B1 | 10/2003 | Wydner | |
| 6,705,179 | B1 * | 3/2004 | Mohtasham | 74/505 |
| 6,732,834 | B2 * | 5/2004 | Colorado | 182/6 |
| 6,820,721 | B1 * | 11/2004 | Henson | 182/5 |
| 6,832,668 | B2 * | 12/2004 | Henson | 182/236 |
| 7,025,172 | B2 * | 4/2006 | Gregory | 182/5 |
| 7,036,628 | B2 * | 5/2006 | Wilcox et al. | 182/9 |
| D523,588 | S * | 6/2006 | Henson | D29/101.4 |
| 7,063,185 | B2 * | 6/2006 | Green | 182/7 |
| 7,086,091 | B2 | 8/2006 | Jordan | |
| 2002/0179372 | A1 | 12/2002 | Schreiber et al. | |
| 2010/0122874 | A1 * | 5/2010 | Harris, Jr. | 182/231 |

OTHER PUBLICATIONS

"Fall Guy Tree Stand Safety System" Product Brochure.

* cited by examiner

FIG. 4
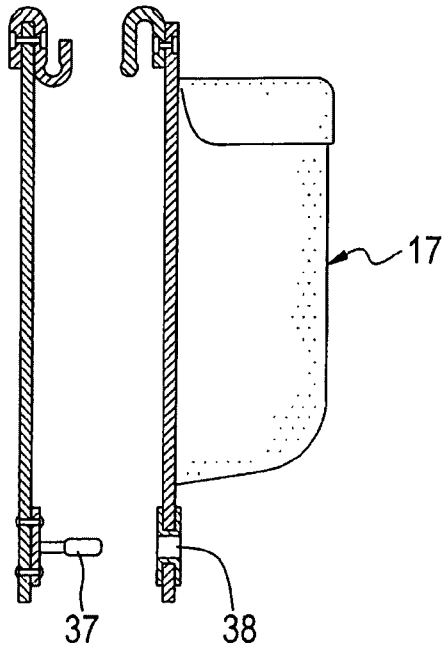
FIG. 4A
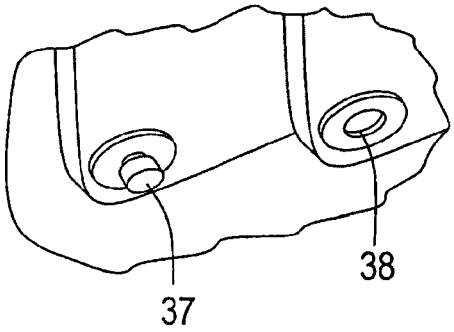
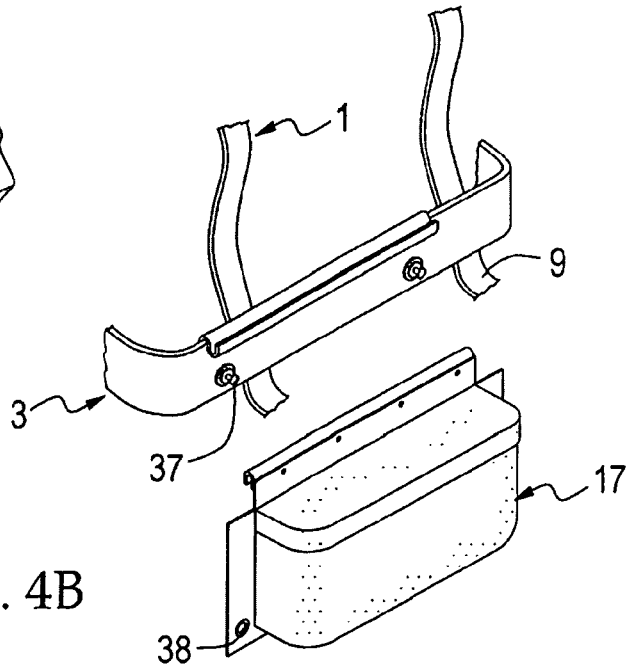
FIG. 4B

FALL PROTECTION SYSTEM

CROSS-REFERENCE TO RELATED APPLICATIONS

This application claims priority from U.S. Provisional Application No. 60/559,936 entitled "Improved Fall Protection System" that was filed on Apr. 6, 2004.

BACKGROUND OF INVENTION

1. Field of the Invention

The invention relates generally to safety equipment. More specifically, the present invention relates to an improved fall protection system.

2. Background Art

In recent years, the use of safety harnesses in hunting has experienced a sharp rise, as the use of climbing-type treestands for hunting has gained in popularity. Estimates are that approximately 90% of deer hunters hunt from elevated stands at one time or another. One of the most popular types of elevated stands is the so-called climbing tree stand, which attaches by a cantilever mechanism to the trunk of a tree, and permits the user to ascend the tree, often to heights of as much as 35 feet, by alternately moving the upper and lower sections of the stand, in a "sit-and-stand" "ratchet-type" action. Such climbing tree stands depend on the cantilever design to impinge upon and grip the tree trunk, in order to remain in place at an elevated height. Such stands have proven to be prone to sudden and unexpected slippage or upset, which causes them to fall rapidly down the tree, or to abruptly shift positions, often causing the occupant of the stand to lose his or her balance and fall to the ground. At other times, hunters fall out of tree stands after falling asleep, or during the climbing operation, or when stepping from a fixed ladder onto the platform of a type of stand known as a "lock-on" treestand. Of those hunters who use elevated treestands, many will experience a fall from the stand at one time or other and unfortunately large numbers of those who do fall sustain serious, often catastrophic injuries, such as broken bones, ruptured spleens, internal bleeding, severed arteries, paralysis due to spinal injuries, or even death.

The use of a safety harness as a component of a fall-protection system, to arrest a person's fall from an elevated position, is well known in the art. Fall-arresting safety harnesses are commonly used, and are even mandated by law, in certain commercial and industrial applications, for workers working at elevated heights, such as ironworkers, arborists, window washers, sign installers, roofers, and many others. In the recreational sport of deer hunting, full-body safety harnesses, as well as chest-harnesses, and safety waist-belts, are likewise widely used as fall-arresting protective devices, in conjunction with elevated hunting stands.

However, traditional safety harnesses lack of any provision for permitting the wearer who experiences a fall to safely descend to the ground or other place of safety. Once suspended by a safety harness, only the most athletic and fit of hunters would typically have the capability to re-enter a tree stand, or to "hug the tree" and "shinny" down the tree trunk. This procedure would require the victim to cut the safety tether from which he is suspended, an incredibly dangerous and hazardous action, which can result in serious injury or death. Remaining suspended from a tree in a safety harness involves no better long-term survival prospects for the victim, due to the considerable danger and risk represented by the suspension trauma that is highly likely to occur very quickly after the fall. In the case of belt harnesses, it is not uncommon for asphyxiation to occur within less than one hour of becoming suspended. With chest harnesses, the survival time can be a bit longer. However, with full-body safety harnesses, which have been until recently thought of as safer than the belt or chest harnesses, the constriction of blood flow in the lower extremities which results from being suspended in such a harness can result in injury or even death within an amazingly short period of time, in some cases as little as 15 to 30 minutes. Furthermore, even if a hunter is fortunate enough to be discovered by rescuers within a short period after falling, and has not yet succumbed to the effects of suspension trauma, the danger to both fall victim and rescuers, and the extreme difficulty of getting the victim safely back to the ground presents a daunting challenge.

In summary, if a person falls in a remote location and finds himself suspended in a traditional full body safety harness which does not incorporate a system which provides self-recovery and/or controlled-descent capability, then although immediate injury or death from fall impact may be prevented, the fall victim still is exposed to a critical, life-threatening emergency situation. Accordingly, there is a need for a simple, reliable, lightweight, and economical emergency descent system for use in conjunction with a fall-arresting or other type of safety harness or safety belt. Further, there is a need for an improved safety harness system, for use not only by hunters, but also by rock climbers, recreational tree climbers, billboard installers, steel erectors, tower constructors and maintenance personnel, roofers, arborists, and others who work at elevated heights from the ground. Such a system should provide a controlled-descent system, to provide fall-arrest and self-recovery in the event of a fall, or in the event of the need for a person to escape under emergency circumstances from an elevated location in a building, such as from an upper floor of a multi-story home or office or commercial building.

SUMMARY OF INVENTION

In some aspects, the invention relates to a fall protection system harness, comprising: an adjustable waist belt extending around the waist of the user; a pair of shoulder straps extending from the waist belt over the shoulders of the user; an connecting strap for attaching the harness to an elevated structure; and a panel section adjacent to the rear of the user that extends outward to both sides of the user at waist level so that the panel section extends around the user's waist and encompasses the adjustable waist belt.

In some aspects, the invention relates to a fall protection system, comprising: a harness that is worn by a user a connecting strap with a first end that attaches to an anchor point located on a fixed structure and second end that attaches to a descent control mechanism; where the descent control mechanism is integrated within the harness, the descent control mechanism comprising, a quantity of descent line that supports the user when descending from the fixed structure, and a braking mechanism that restricts the rate of descent of the user by controlling the rate of pay out of the descent line.

In some aspects, the invention relates to a fall protection system, comprising: means for securing a user to an anchor point of a fixed structure with a harness; and means for allowing the user to control the rate of descent from the fixed structure that is integrated into harness.

In other aspects, the invention relates to a fall protection system, comprising: a harness with padded leg straps and a waist belt that is worn by a hunter in a treestand; a connecting strap with a shock absorbing tether that is attached to a tree; a stored length of descent line that attaches the connecting strap to the harness, where the descent line is stored in a pouch located on the rear of the harness; a controlled descent mechanism that allows the hunter to control the rate the descent if the hunter has fallen from the treestand; and where the controlled descent mechanism comprises a frictional braking system that includes serpentine path of the descent line by positioning opposed members spaced apart so that the descent line is forced into contact with other sections of the descent line moving in opposing directions so that a frictional braking force is produced against the descent line.

Other aspects and advantages of the invention will be apparent from the following description and the appended claims.

BRIEF DESCRIPTION OF DRAWINGS

It should be noted that identical features in different drawings are shown with the same reference numeral.

FIGS. 4-4B show views of attachment mechanisms for the storage units/fanny packs to the safety harness in accordance with one embodiment of the present invention.

DETAILED DESCRIPTION

Figure 1:
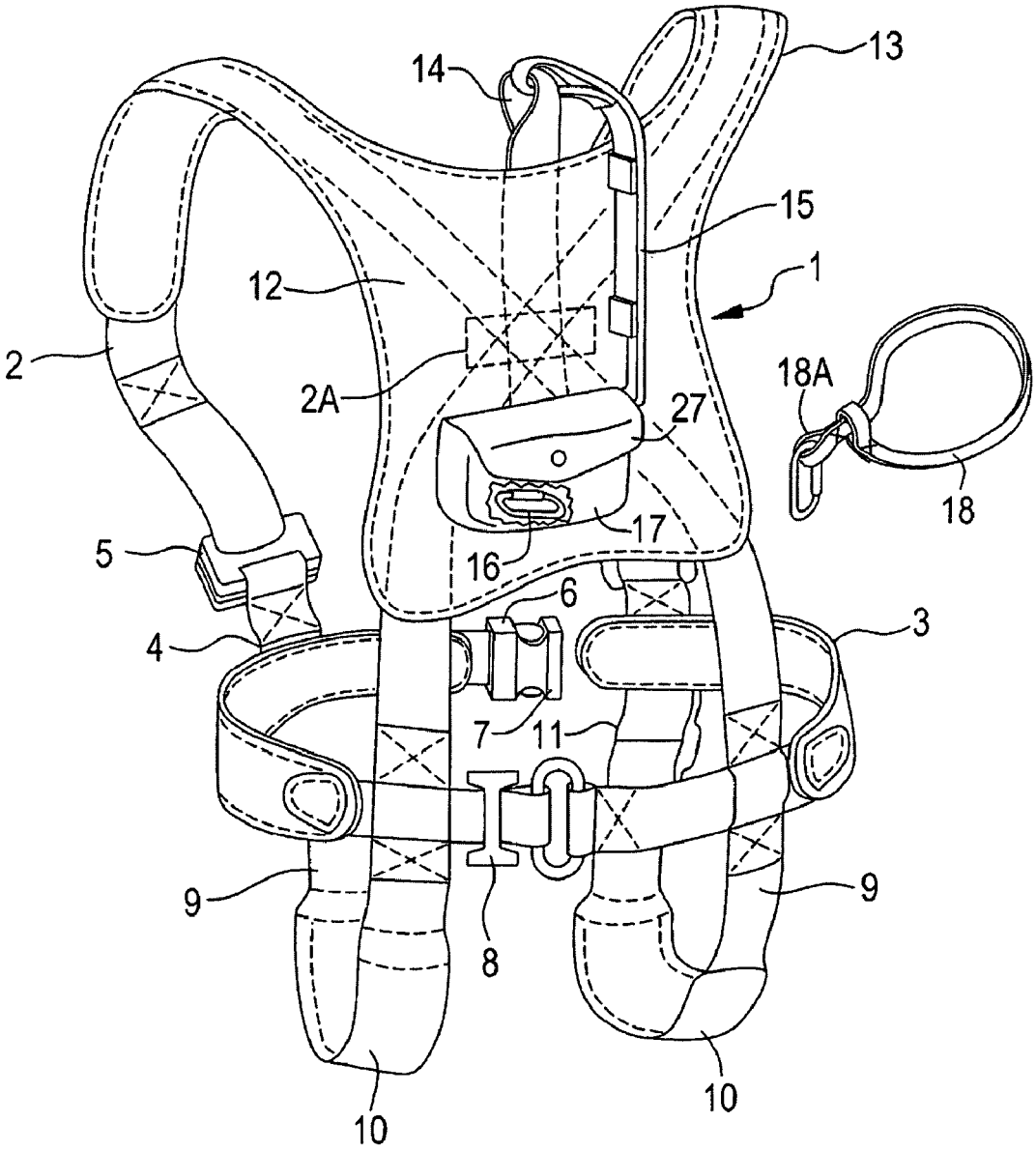
FIGS. 1-3 show views of a design for a fall-arresting safety harness, showing the shoulder straps, padded rear panel section, waist belt, belt and strap fasteners, leg straps, shoulder-strap cushions, shock absorbing tether, a sewn-in pocket on the rear panel section provided for storage of such tether on the harness, in accordance with one embodiment of the present invention.

The present invention is directed first to an emergency controlled descent system to provide a safe, gradual, and controlled descent from an elevated position back to the ground or to some other intermediate place of safety for a person who has experienced a fall, which fall has been arrested by a fall arresting device, such as a full body safety harness. In a one configuration, the emergency controlled descent system is used in conjunction with a fall-arresting safety harness, vest, or belt, by other types of attachment to or integration into the construction of, such safety harness, vest, or belt. Further, the invention is directed to an improved lightweight safety harness equipped with or attached to an emergency controlled descent system, to be worn by hunters or by persons working at elevated heights from the ground, including a fall-arresting and self-recovery system, ergonomically designed and configured to provide greater simplicity and convenience than conventional safety harnesses in donning and wearing of the device, improved comfort during suspension after a fall, and provided with compartments for convenient storage and ready access to items of gear and equipment carried by such hunters, climbers, workers, or others. Further, the device is directed to a personal-escape system for persons who may be trapped inside a burning building on an elevated floor, or on an elevated structure, such as an oil drilling or production rig or chemical plant tower, where an emergency situation such as a fire might require an immediate escape from such structure, involving a safe, controlled descent to the ground, or to the water, or to a lower level of such building or structure.

In general, the invention may include of a stored length of high-tensile-strength braided or woven webbing or other line, rope, or cable, made from a synthetic polymer or composite material, or a woven or braided metal material, which stored length of webbing or line is used as the connecting-support device for the fall victim during suspension and descent after a fall, and is contained within a housing, and mounted adjacent to and positioned in contact with a mechanical, friction-inducing braking system. A section of the descent webbing or line is passed through and makes contact with the braking system, and the distal end of such webbing or line which protrudes from the braking assembly is formed into a sewn, crimped, spliced, or otherwise fabricated loop, which is then attached to an anchor point or a shock-absorbing safety tether. The opposite end of the store of webbing or line is contained within the housing in such a way that it cannot exit the housing when all of the webbing or line has been withdrawn from the housing, which construction serves in such a way as to effectively anchor the line to the housing. The housing is, in turn, securely mounted to an elevated anchor point, such as a tree or pole, and attached to the safety harness, or in the alternative it may be constructed to attach to, or to be built as an integral part of the safety harness, vest, or belt, so that the store of webbing or line can be paid out gradually, and used as a suspension mechanism for lowering the wearer of the harness safely to the ground after sustaining a fall which has been arrested by the safety harness, vest, or belt (fall arresting device).

Upon sustaining such a fall, the webbing or line is paid out at a rate or velocity which is controlled by the braking mechanism of the controlled-descent system. The controlled descent device may be attached directly to or integrated into the construction of the fall-arresting safety harness in such a way that the protruding distal end of the descent webbing or line may then be connected to a tree, pole, or other secure anchor point in series with a shock-absorbing device or tether to limit impact forces in the event of a fall and suspension from said webbing or line. Alternatively, the controlled descent device may be attached directly to a tree, pole, or other secure elevated anchor point, and configured such that the distal end of the stored descent webbing or line extends from an opening in the lower part of the housing of such device, where it is connected either directly to the suspension point of a fall-arresting safety harness or belt, or in series first with a shock-absorbing device or tether member which is in turn then connected to the suspension point of a fall-arresting safety harness or belt. In the event of a fall, the controlled descent device so-configured would remain attached to the elevated anchor point, and the descent line or webbing would be pulled downward and paid out at a safe, controlled rate by the weight of the wearer of the fall-arresting safety harness.

The associated (attached or integral) fall-arresting safety suspension device may be a simple safety belt, "full-body" chest-and-shoulder harness, or a vest which incorporates a fall-arresting safety belt or safety harness. In one configuration a full-body safety harness includes several main components or sections, including a waist-belt, to which are attached a pair of shoulder straps at the rear of the harness, which straps extend from the waist belt, thence up and over the shoulders of the wearer, and continue downward to the waist band in the front of the wearer, and leg straps which extend from the waist belt downward through the crotch and back up to the waist belt on the opposite side of the wearer. In such a configuration, attached to the shoulder straps in the back is a panel section, roughly in the upper-center of the back, which panel section also incorporates two cushioned, upwardly-projecting cushioned segments, which are adjoined to the webbing shoulder straps, and which cushioned segments extend up over the shoulders of the wearer, and terminate in the chest region of the wearer. The rear panel serves as a mounting area for attachment or integration of the controlled descent system, and for a storage pouch for a shock-absorbing tether. Such rear panel and shoulder-strap cushion-sections also give the unit "body" and definition as a garment, and facilitate immediate understanding of how the device is worn, and easy installation.

In another configuration the harness is equipped with a pair of leg-straps which extend downward from the waist belt at the rear of the harness, each of which then is passed between the wearer's legs, and back up to a buckle or parachute-type connector at or near the waist belt in the front or at the side of the harness. Such leg-straps may be equipped with padding, or may be otherwise widened or enlarged, or formed into a "saddle" or "bicycle seat" configuration, to minimize constriction of blood flow, and to increase comfort to the wearer in the event of a fall, and potential survival time during suspension after an arrested fall. The waist belt is fastened around the waist with a buckle-type device, and is designed to be adjustable to accommodate individuals of different sizes and weight. The harness may also include an adjustable chest-strap with buckle, to provide additional security and comfort, and to minimize the chance that a person could in any way fall out of the harness no matter what his or her orientation is during or after a fall.

In addition to the controlled-descent system and safety harness combination, as described above in basic configurations, another embodiment of the improved safety harness is equipped with storage pouches, of the type found on a typical hiker's or hunter's fanny-pack or belt-pack, or a worker's tool belt. Such pouches may be built-in as permanent components, or detachable, attached by hook-and-loop fasteners, snaps, twist-lock fasteners, buckles and straps, "Buddy-Lock" attachments, etc. In particular, it is desirable for hunters for at least the rear-most storage pouch to be removable, so that once the hunter has ascended the tree and occupied the stand, he or she will be able to remove the rear "fanny-pack" pouch, and relocate it to a rail of the hunting tree stand or platform. This is important to hunters for several reasons: (1.) in order that the often-bulky gear can be removed from behind the hunter, so that he or she can slide back and sit more closely, in comfort, next to the tree trunk; (2.) so that the hunter can turn and move, to look in different areas, or to shoot, without the fanny pack encumbering such movement or making noise during such movement; and (3.) so that the hunter will have ready access to the gear contained in the fanny pack without excessive movement or the necessity of reaching behind and groping into a pack that he/she cannot see. Likewise, the ability to remove a tool belt from the harness and to re-attach it in a place which provides easy and safe access to the tools and gear contained therein is an important advantage for commercial or industrial workers who work in elevated locations.

Accordingly, a primary object of the invention is to provide a system which is capable of attachment to, or which can be integrated with or built into, a fall-arresting safety belt, harness, or vest, which system provides a user with the ability to safely descend to the ground, or to some other intermediate position of safety, such as a ladder rung or other platform, in a gradual and controlled manner, either automatically, or with minimal simple involvement on the part of the user to actuate the device and to initiate or to stop the descent, in the event the user experiences a fall from an elevated hunting stand or other such location and finds himself/herself suspended above the ground in the safety harness, after the fall is arrested by the harness.

A further object of the present invention is to provide the combination of a simple fall-arresting safety harness that is easy for the user to understand how to put on, and which is also easy and quick to put on, and which further provides cushioning protection in areas of key pressure points, to increase comfort while suspended after a fall, and which harness is equipped with one or more attached or built-in storage compartments to permit the storage and carrying various gear items or tools.

A further object of the present invention is to provide the combination of: (1) a simple fall-arresting safety harness, or vest, as described above, that is easy for the user to understand how to put on, and which is also easy and quick to put on, which further provides cushioning protection in areas of key pressure points, to increase comfort while suspended after a fall; and (2) an attached or integrated (built-in) self-recovery, controlled-descent system, to afford the wearer a controlled, gradual descent to the ground or other intermediate place of safety, at a safe rate of descent, in the event that the user experiences a fall which is arrested by the safety harness, in order to prevent a prolonged period of suspension in the safety harness, which prolonged suspension could lead to serious injury or death.

A further object of the invention is to provide a fall protection system which includes a fall-arresting safety harness or belt combined with and equipped with an emergency controlled-descent system, as described above, to provide a controlled, safe, gradual descent after an arrested fall, which system also features one or more attached or integrated compartments for storage for articles of gear, clothing and/or tools which may be utilized by the user, as well as mechanism for detaching and relocating certain of such gear-storage compartments while sitting in, working in, or otherwise occupying an elevated treestand or other elevated platform.

A further object of the invention is to provide an improved fall protection system to be worn by a hunter, worker, or other person engaging in various activities in elevated locations above the surface or the ground, including an improved safety harness which incorporates, in combination, a system to provide self-recovery in the form of a safe, controlled descent to the ground or other place of safety after an arrested fall, as described above, affording improved simplicity, safety, ease of installation and use, comfort, and convenience, along with the improvement of convenient storage capability, and further including a shock-absorbing tether for attachment of the fall protection system to an anchor point, to diminish and to limit the impact and shock-load forces exerted by gravity upon the wearer during the arrest of a fall, as the user comes to a relatively quick stop at the end of such tether as such initial fall is arrested.

A further object of the invention is to provide a controlled descent device which may be attached to a tree, post, or other elevated anchor point, which device is configured to permit attachment of the descent line or webbing stored by the device to a fall-arresting safety belt, vest, or harness, by use of a tether, which tether may be a simple length of line or webbing, a shock-absorbing tether, or a tether incorporating a shock-absorbing device. Such a controlled descent device would therefore be a stand-alone device capable of attachment to and use with existing safety harnesses or belts which the wearer might already own or possess, thereby eliminating the need to for the user to acquire a separate and discrete safety harness or belt for use only with such controlled descent device. This configuration permits the controlled descent device to be used with many different and existing types of harnesses, vests, and belts which exist in the field, thereby broadening its applicability without undue added cost.

A further object of the invention is to provide a controlled descent device which can mount upon a tree, post, or other secure elevated anchor point, configured to provide: (1) a safe descent after a fall which has been arrested by a fall-arresting safety harness or belt, when such harness or belt is attached to such controlled descent device by possibly a shock-absorbing tether; and (2) fall protection and controlled descent self-recovery for persons climbing to or descending from such elevated platforms as treestands, ladders, or other such elevated locations which may be encountered in hunting, commercial, or industrial applications. Such fall protection and self-recovery capability during climbing and ascent may be accomplished by first attaching the controlled descent device to the tree, post, or other elevated anchor point upon completion of an initial ascent to such location, then attaching a length of rope or line of a length sufficient to reach the ground or other place of safety from such elevated position, to the loop on the lower, distal end of the descent line or webbing stored by the controlled descent device. Such line or rope would be allowed to dangle, and extend from the controlled descent device to the ground or other safe descent location. Next, a rope-brake device such as a lever-box mechanism would be attached to the tether of the fall arresting safety belt or harness, and then mounted to such emergency descent rope or line. As the wearer of the fall arresting harness or belt would climb upward to the desired elevated location, he or she would release and slide the rope brake upward along the rope or line.

During descent from such elevated location, likewise, he or she would release and slide the rope brake downward along the rope, repeating the operation at various stages along the descent, until reaching the ground or other place of safety. In the event of a fall when utilizing such a configuration of the invention, the weight of the wearer would pull downward on the tether, locking the rope brake against the rope or line to arrest the fall at any point along the ascent or descent. In the event of such an arrested fall, the weight of the user would then cause the descent line or webbing to be paid-out at a gradual rate involving a safe downward velocity from the housing of the controlled descent device, thereby providing the fall victim with a safe and controlled descent back to the ground or other place of safety. During work or hunting from the elevated position, the user could leave the tether attached to the dangling safety rope via the rope brake, or the rope brake could be detached from the tether, with the tether being attached directly (by a carabineer or other connector) to the loop at the lower, distal end of the descent line or webbing stored by the controlled descent device. Such configuration would then provide fall-arrest as well as self-recovery protection for the user during the entire ascent, during time spent at the elevated location, and during the entire descent.

Referring to FIG. 1, in one embodiment, the harness 1 includes two webbing shoulder straps 2 attached to and extending from the waist belt 3 at the rear of the harness, over the shoulders and down the chest on either side of the neck of the wearer, and returning to the waist belt 3, at an attachment point 4, on the front of the waist belt 3. Shoulder straps 2 are equipped with adjustment device 5 such as a slide-buckle, to adjust the effective length of the straps, to accommodate and to properly fit wearers of different sizes and weights. Waist belt 3 extends from an attachment buckle 6 or other fastening member at one end of the belt, located roughly in the center of the front of the wearers abdomen, at the waist, thence around the waist of the wearer and back to the front, where the belt terminates in a fastener or attachment device 7 which mates with the buckle 6 or other fastening member located at the point of beginning of the belt 3. The waist belt 3 is likewise equipped with a slide-buckle or other adjustment device 8, to accommodate and to provide a proper fit to wearers of different sizes and weights.

Attached to waist band 3 at the right and left sides of the wearer are leg loops 9, which are equipped with cushioning members 10, and which, in use, are passed from the waist belt 3 down and around the back of each leg, through the crotch, and thence back up to a buckle or other fastening device 11 which is attached to the opposite end of the leg loops 9. Attached to the shoulder straps in the center of the back is the main rear body panel 12, which includes a panel of fabric, mesh, polymer, metal, or composite construction, attached to the shoulder straps 2, to give body and definition to the shape of the safety harness 1. In one embodiment, the rear body panel may be constructed to include cushioning material, and may include shoulder-strap cushion sections 13 extending from the rear body panel 12 upward and along each shoulder strap 2, continuing over each shoulder and part-way down the chest of the user. Attached to the safety harness 1, in the area of rear body panel 12, are one or more webbing sections 2-A, sewn-in to join the shoulder straps 2 together in the upper-central section of the back of the harness, and to form an anchor-point of great strength, such anchor point including a webbing loop 14, to which is attached the shock-absorbing tether 15, by a D-ring, carabineer, or other attachment device 16. Such rear body panel 12 may also be equipped with a fabric or plastic pouch 17, of a size and shape sufficient to contain and store the shock-absorbing tether 15, as well as the tree-anchor loop 18, and associated hardware such as locking carabineer 16. Such pouch 17 may be equipped with an overlapping flap 27 to prevent intrusion of rain, leaves, or debris.

Figure 2:
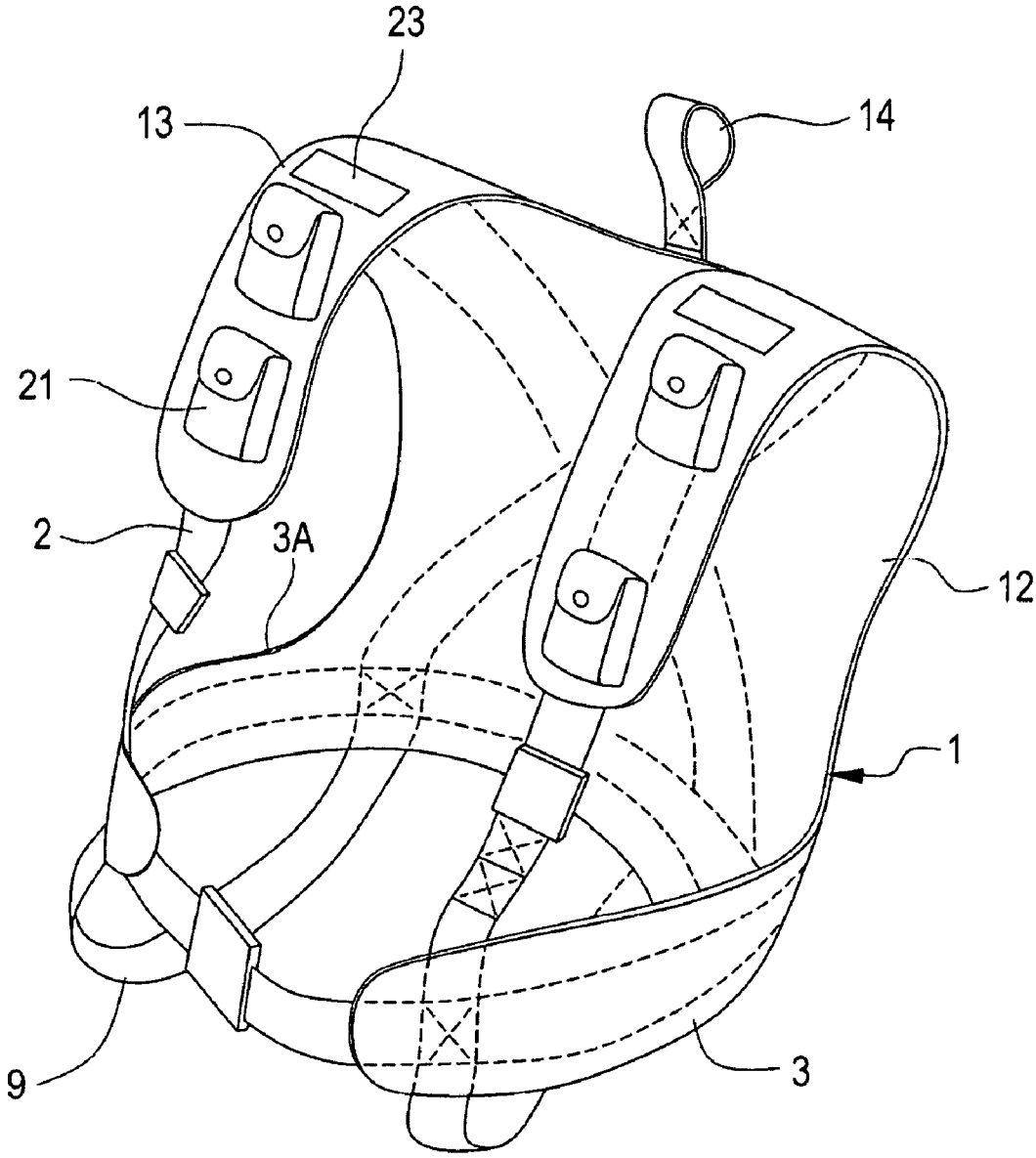

In another embodiment of an improved fall-arresting safety harness, as shown in FIG. 2, the shoulder-strap cushion sections 13 may also be equipped with one or more compartments 21, located on the front of such shoulder-strap cushion sections 13, generally in the upper chest or lapel area of the user. Such compartments 21 may be used for convenient storage of small items which are frequently used by the hunter, and to which easy and immediate access may be required, such as a mini-flashlight, hunting knife, compass, global positioning system navigation device, walkie-talkie radio transceiver, cellular phone, matches, grunt or other game call, extra ammunition, safety whistle, extra flashlight batteries, and the like.

By manufacturing the webbing straps 2 and 9 from a fabric having a printed or otherwise-applied camouflage pattern, and by manufacturing the rear body panel 12 and shoulder-strap cushion sections 13 from a fabric printed with a camouflage pattern, the safety harness 1 can be effectively camouflaged such that is not readily visible to game, and as such will not alarm game animals. Likewise, in the case of industrial, commercial, or other recreation activities wherein the safety harness might be used, such webbing straps 2 and 9, and rear body panel 12 and shoulder-strap cushion sections 13 may be made of a brightly colored fabric, such as a high-visibility or fluorescent chartreuse or safety-orange material, for increased visibility. For additional night-time safety and visibility to other hunters, the rear panel 12 and shoulder-strap cushion sections 13 may be equipped with one or more patches 23 of a retro-reflective material, such as 3M's SCOTCHBRITE, or REFLEXITE.

As will be seen by further referral to FIG. 2, the waist belt 3 can include a cushioned or reinforced section 3A, which includes a further extension of the rear panel section 12. Such cushioned and/or reinforced section is designed to provide additional comfort to the wearer, and to give substance and body to the waist belt, in order that it might serve as a substantial mounting platform for built-in or detachable storage compartments.

Figure 3:
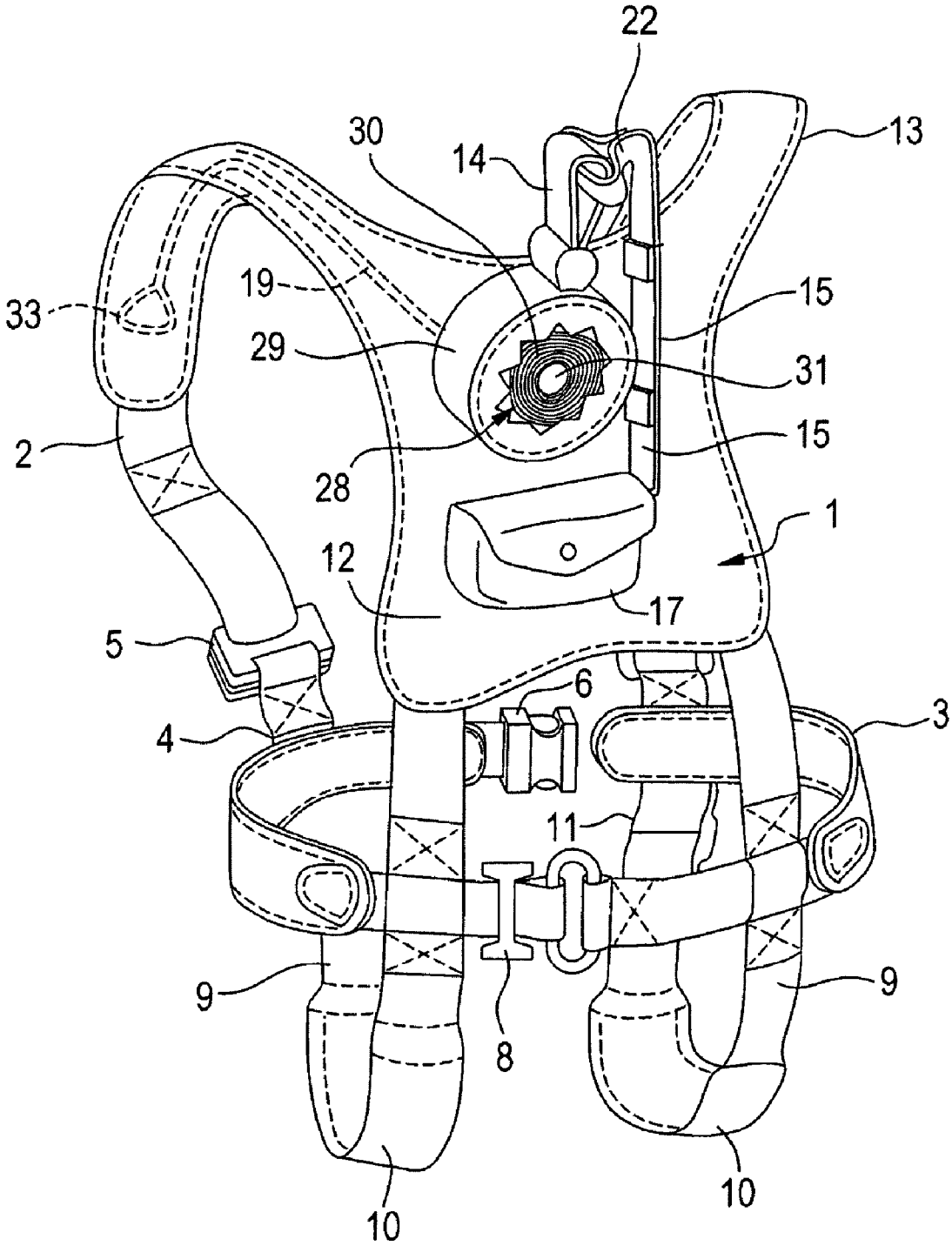
Figure 15:
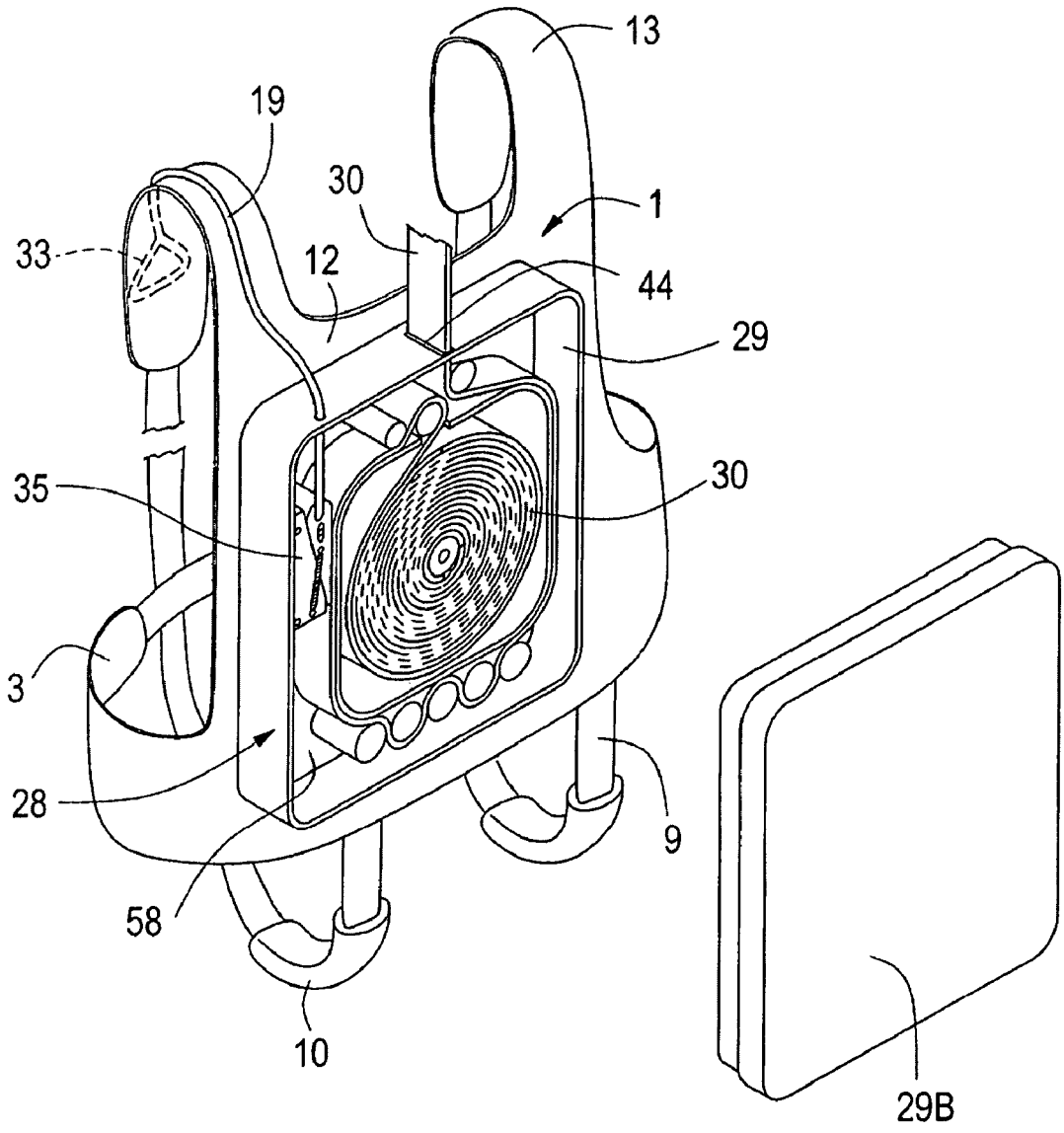
FIGS. 15 and 16 are views of the internal components of one configuration of an emergency descent system utilizing a braking drum in accordance with one embodiment of the present invention.

Referring to FIG. 3, the safety harness 1 incorporates an emergency descent apparatus 28, which is housed within a housing 29 which is attached to the safety harness 1 in the area of the rear body panel 12. Within housing 29 is contained a store of nylon webbing 30, which is wound into a coil, around a central spool 31. A shock-absorbing tether 15 is attached to the upper end of the length of nylon webbing 30, at loop 14. The emergency controlled descent device may be actuated in the event of a fall which has been arrested by the safety harness and tether, by the wearer's pulling on handle 33, which is attached to cable or strap 19, which releases the positive-locking mechanism 35, as shown in FIG. 15.

Figure 14:
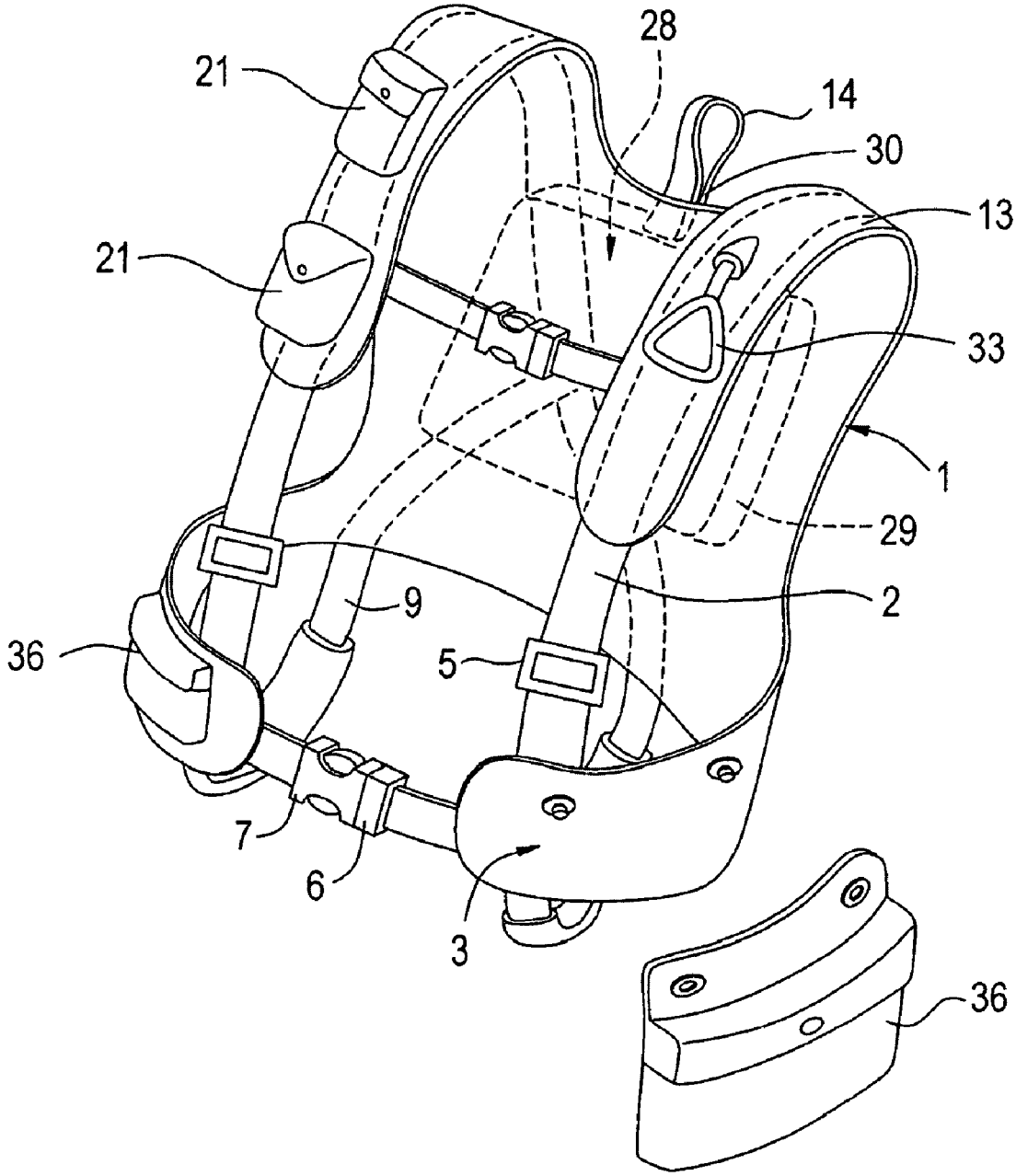
FIG. 14 is a view of one embodiment of a "rip-cord-type" actuator and brake-controller mounted in the lapel-area of the shoulder-strap of a safety harness equipped with an emergency descent system in accordance with one embodiment of the present invention.

Referring to FIGS. 3 and 14, it will be seen that safety harness 1 is equipped with a rear storage pouch 17, and side storage compartments or pouches 36. The emergency controlled descent system 28 is contained within housing 29, which, as illustrated, includes a fabric enclosure integrated with and secured to the rear panel section 12 of safety harness 1.

FIGS. 4-4B depict a mounting mechanism for a removable storage pouch or fanny pack 17. Twist-lock male studs 37 may be mounted on the waist belt 3 of safety harness 1, to mate with matching grommets 38 mounted upon the storage pouch or fanny pack 17. Other mountings, such as hook-and-loop straps, straps and buckles, "Buddy-Lock" fasteners, snaps, buttons, or other fasteners may be used to attach such storage pouch or fanny pack 17, as well.

Figure 5:
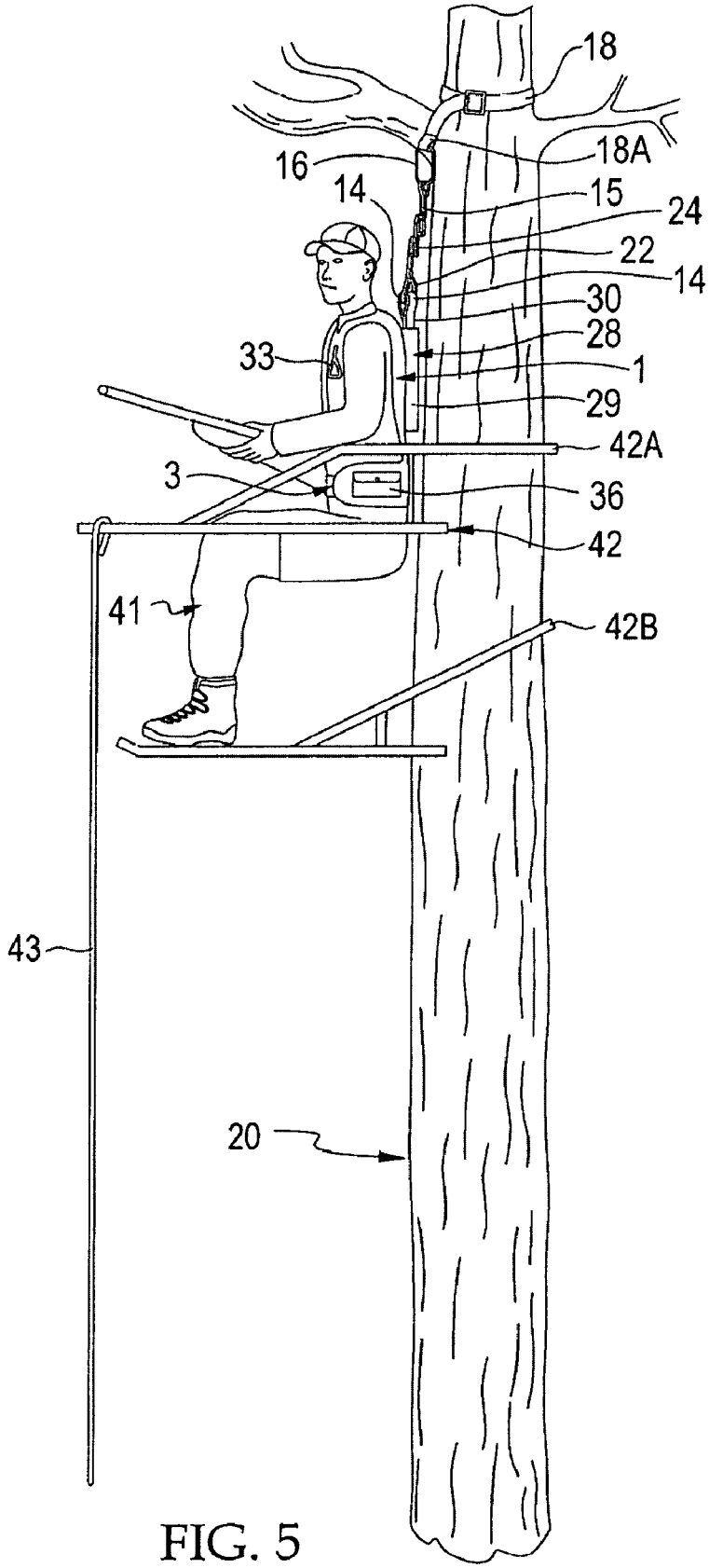
FIG. 5 is a view of a hunter sitting in an elevated tree stand, wearing an improved safety harness which incorporates an integral system to provide a controlled descent to the ground in accordance with one embodiment of the present invention.
Figure 12:
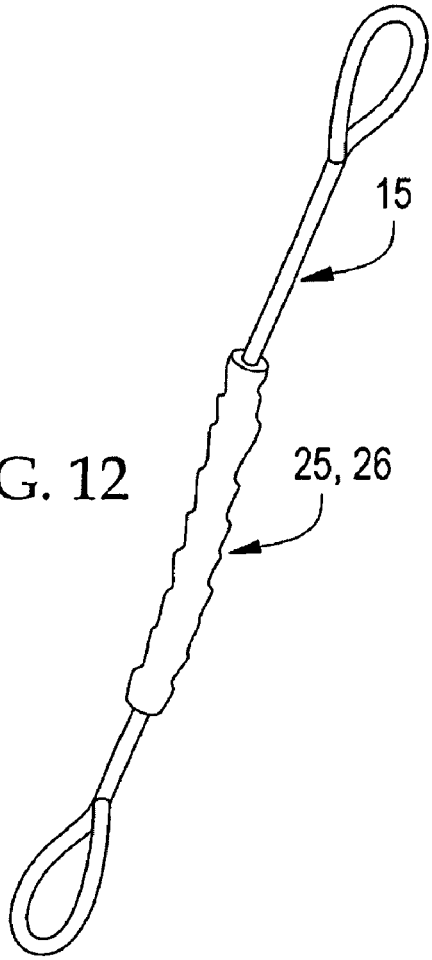
FIGS. 12 and 13 are views of a bungee-cord-type of shock absorbing tether in accordance with one embodiment of the present invention.
Figure 13:
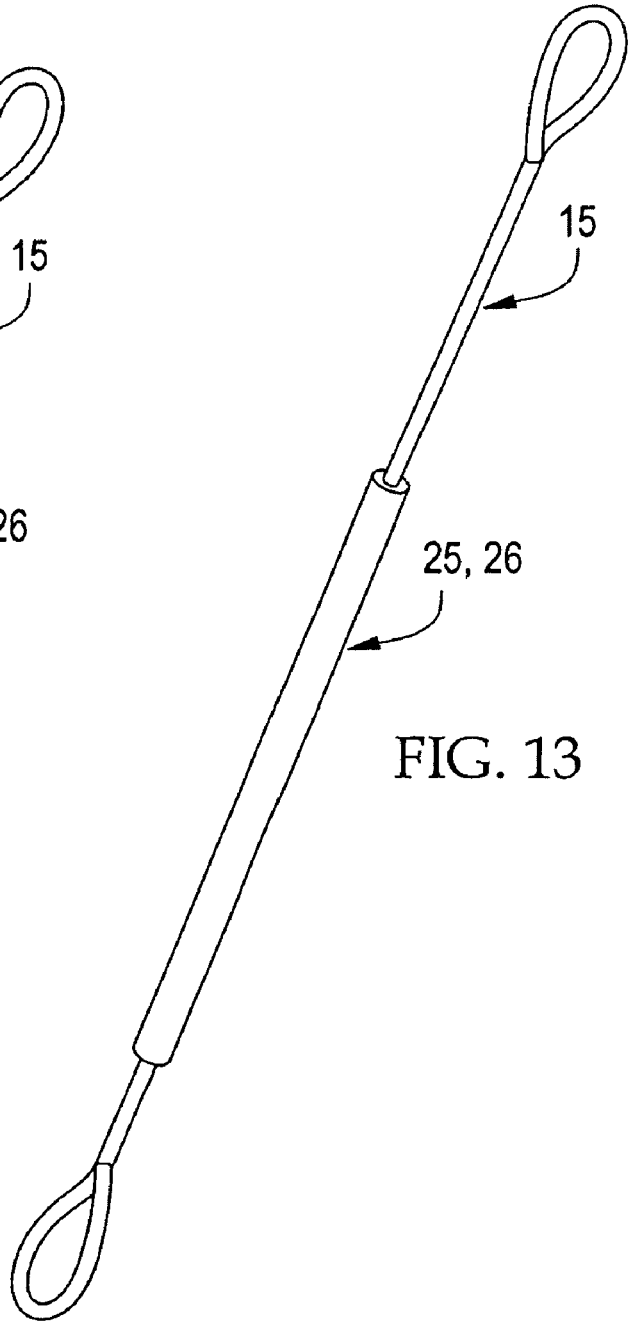

As will be seen by reference to FIG. 5, the safety harness 1 is designed to be installed such that the tree-anchor-loop 18 is first secured to the trunk of a tree 20, or to such other elevated and secure structure as may safely be used to support the weight of the harness wearer. Next the wearer of the harness 1 removes the shock-absorbing tether 15 from its associated storage pouch 17, and the locking carabineer or other attachment device 16 is attached securely to the loop 18A located on the tree-anchor-loop 18. In the event of a fall, the shock-absorbing tether 15 would be pulled into its fully extended position. When the tether 15 reaches its fullest extension, the wearer's fall is arrested in a controlled, cushioned manner, as the staged, tear-away shock-absorbing feature of the tether 15 is deployed. Such shock-absorption is usually accomplished by a series of fold-over, sewn-in, tear-away loops 24 in the tether 15, which progressively deploy as the person falls, slowing the fall gently, as opposed to causing an abrupt stop at the end of the tether, the shock and trauma of which abrupt stop could result in injury or death. Another technique of absorbing the shock-load of a fall involves using a shock-absorbing tether 15, as seen in FIGS. 12 and 13, which incorporates a length of compressed bungee-cord 25 sewn into an outer, high-strength sleeve 26, which provides fall shock-protection through the cushioning resilience of the bungee cord 25, and limits travel to the length of the sleeve 26.

Referring to FIG. 5, it will be seen that the hunter 41 is seated within a two-section climbing treestand 42 including an upper, seating section 42 A, and a lower, foot platform section 42 B. The hunter 41 is wearing a fall-protection device per the current invention, including a safety harness 1, to which is mounted an emergency controlled-descent device 28, contained within a housing 29, which controlled-descent device includes a store of line or webbing 30, the upper end of which line or webbing is formed into a loop 14 which is attached to a shock-absorbing tether 15. In turn, the shock absorbing tether 15 is attached to tree 20 by use of a tree anchor belt 18, via loop 18A and a connector device 16. Such connector device 16 may be a device such as a carabineer, locking carabineer, snap-hook, or threaded chain link. The tether 15 and tree anchor belt 18 may be constructed of a heavy-duty, high-tensile-strength webbing material, constructed of nylon, polypropylene, fiberglass, or such other polymeric or composite materials as may provide sufficient strength, flexibility, durability, and light weight. It will also be seen that said safety harness 1 is equipped with storage compartments 36 mounted at the side of the waist belt 3.

To determine that the hunting or work elevation is not greater than the length of the stored line or webbing 30, a small drop-gauge 43 is employed, such gauge made of a length of light line equal to the length of stored line or webbing, the lower end of which can be dropped to the ground to test the distance. If the lower end of such gauge reaches the ground or other platform, then the hunter, worker, or other worker is assured that the length of webbing or line is sufficient for the hunter, worker, or other wearer to reach the ground or other place of safety in the event that an arrested fall occurs, necessitating the use of the controlled-descent device to achieve a controlled descent back to the ground or such other place of safety. In the event that the full extent of the length of webbing or line 30 is used in a descent, when there is no webbing or line remaining in storage, and the lower, or bitter, end 30A of such webbing or line has been reached, such lower end 30A of such line or webbing 30 is configured such that it is contained within, and cannot escape from, the housing 29 of the controlled descent device 28, preventing an accidental fall in the event that all of the webbing 30 is utilized in a descent prior to the feet of the hunter, worker, or other wearer actually touching the ground in such descent.

Figure 6:
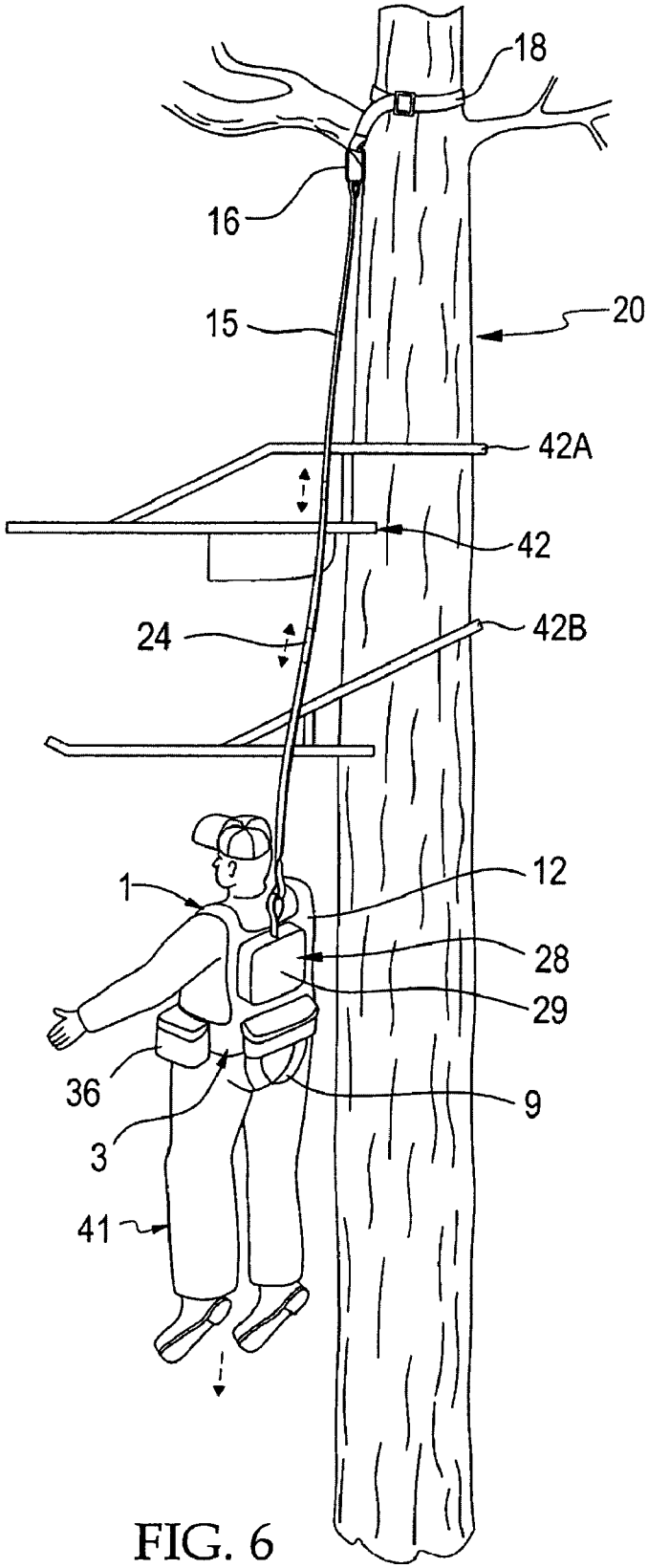
FIG. 6 is a view showing a hunter suspended from the safety harness following a fall, with the tear-away sections of the shock-absorbing safety tether.

In FIG. 6, a hunter 41 who has fallen from his treestand is shown. His fall has been arrested by the fall-arresting safety harness 1, acting in conjunction with the shock-absorbing tether 15, which is mounted to the tree 20 via tree anchor belt 18 and connector 16. The shock-absorbing tear-away sections 24 have deployed sequentially, as the fall progressed, to limit the impact forces of arresting the fall which are transmitted to the body of the wearer. As shown in the illustration in FIG. 6, the fall of the hunter 41 has been arrested, such that his uncontrolled descent has been stopped. The controlled-descent device 28 mounted to the rear panel 12 of safety harness 1 has not yet been deployed, and the hunter 41 is now suspended within the safety harness 1, with his weight being supported primarily by leg straps 9 and waist belt 3.

Figure 7:
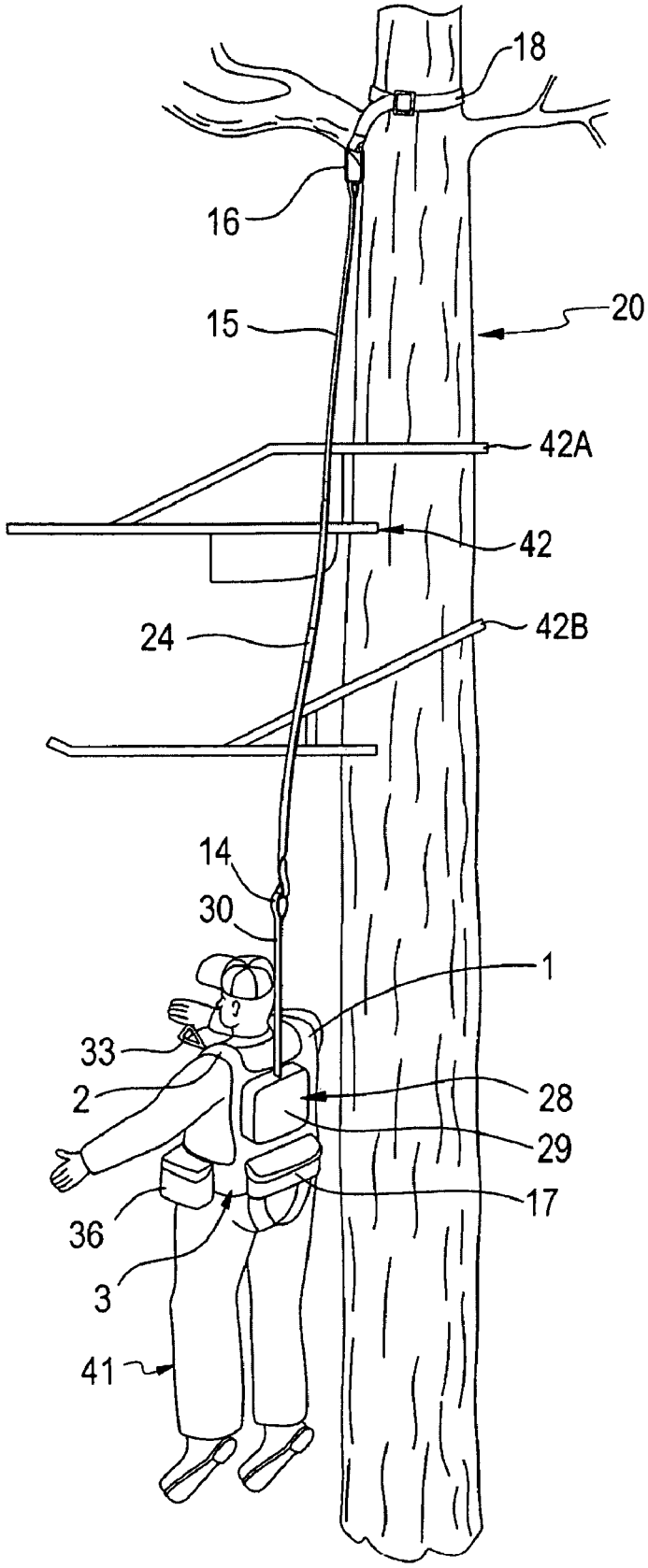
FIG. 7 is a view showing a hunter suspended from the safety harness following a fall, with the shock-absorbing safety tether having been deployed to gradually reduce and to limit the fall impact forces on the hunter in accordance with one embodiment of the present invention.

In FIG. 7, the hunter 41 has initiated a controlled-descent by actuating the brake release mechanism of the controlled descent device 28. Such release is effected by pulling on the handle 33, located on the front left shoulder strap 2 of harness 1, which action serves to move the actuating mechanism of the positive locking brake, as shown in FIG. 7, which releases the locking pressure against the line or webbing 30 which prevented such line or webbing from paying out due to the force of gravity being exerted upon the line or webbing at loop 14. Upon release of such locking pressure, the line or webbing 30 begins to pay out from the store of line or webbing at a gradual rate, to provide a safe descent to the ground or to some other platform of safety for the hunter 41. Such line or webbing 30 continues to pay out until either the hunter 41 reaches the ground or another platform of safety.

When the hunter, worker, or other wearer of such fall protection system 28 descends to the point where he or she is able to stand upon such ground or platform, the force which pulled the line or webbing 30 from the store of webbing is relieved. The design contemplates that the hunter 41 (or other wearer of the device) will not be hunting or working from a position that is higher from a place of safety or from the ground than equal to the length of the stored line or webbing.

Figure 8:
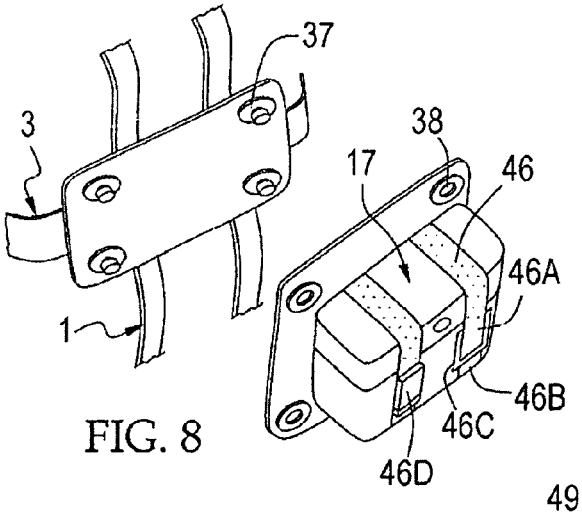
FIGS. 8-9C are views of a storage pouch in accordance with one embodiment of the present invention.

FIG. 8 shows one method of attachment of a rear storage compartment or "fanny pack" 17 to the waist belt 3 of a fall-arresting safety harness 1, as per the invention, involving twist-lock male studs 37 mounted on the waist belt 3, which mate with matching female grommets 38 mounted upon the inward-facing, rear surface of fanny pack 17. In addition, the fanny pack 17 is shown equipped with a pair of additional, external fabric straps 46, which may be of a woven or braided webbing material, or an elastic material. Such straps 46 include two upper and two lower strap sections, 46 A and 46 B, respectively, which are attached to the top and the bottom, respectively, of the fanny pack 17, and which upper and lower strap sections 46A and 46B are fastened, tightened, and adjusted by use of mating hook-and-loop sections 46C attached to such strap sections. Alternatively, such straps 46 may be secured, tightened, or adjusted by an adjustable buckle or snap-buckle mechanism 46D, as shown on one of the straps in FIG. 8. Such straps 46 are included in the device to enable the temporary attachment and carrying of items of desired gear which are too bulky or too large to carry in the fanny pack 17, such as coats, sweaters, gloves, face masks, rain suits or raincoats, or other such gear.

Figure 9:
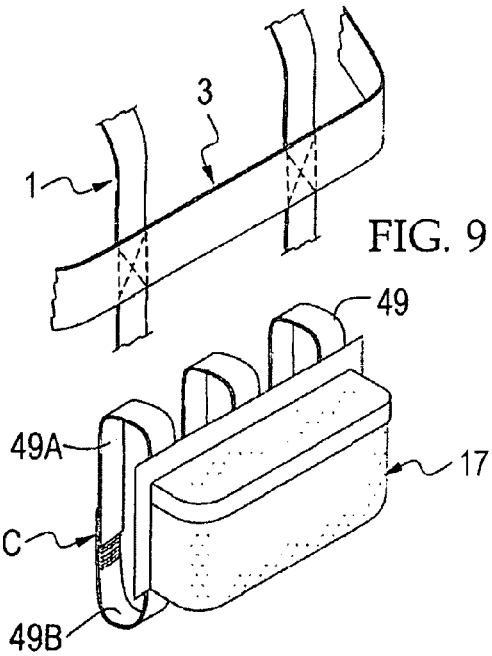
Figure 9A:
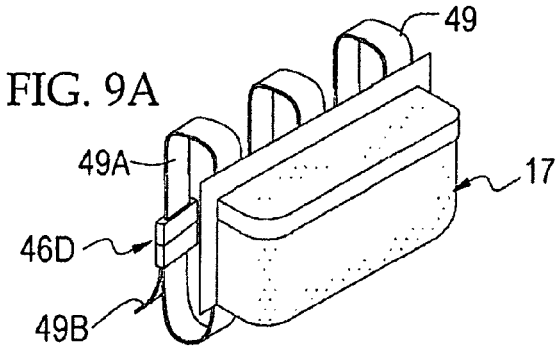

FIGS. 9 and 9A show another configuration for attachment of a fanny pack 17 to the waist belt 3 of a fall arresting safety harness 1. Such attachment of the fanny pack 17 involves the use of webbing or belt straps 49, oriented vertically and mounted upon the inner face of such fanny pack 17. Such straps 49 each have an upper section 49A and a lower section 49B. To attach the fanny pack 17 to the waist belt 3 of the fall-arresting safety harness 1, the upper sections 49A are passed over and around the waist belt 3, and fastened to the respective lower strap sections 49B by use of hook-and-loop fasteners 49C or by another type of fastener such as an adjustable snap-buckle 46D.

Figure 9B:
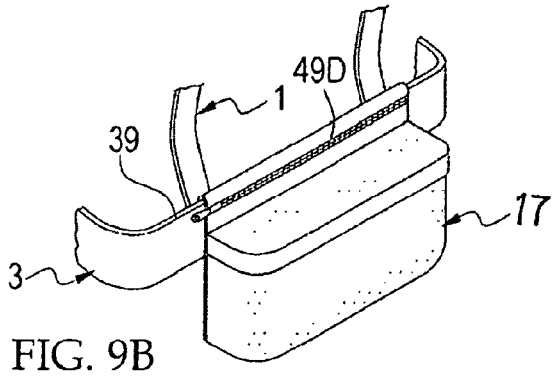
Figure 9C:
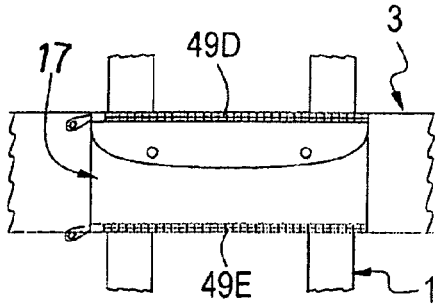

FIGS. 9B and 9C show yet another construction which may be employed to attach a fanny pack 17, or a similar storage pouch or unit to the waist belt 3 of a fall-arresting safety harness 1, which involves a length of a common zipper 49D, one half of which is attached to waist belt 3, and the other mating half of which is built into the top of the fanny pack 17, so that the fanny pack 17 or other such storage compartment, unit, or module may be easily and quickly attached to or removed from the waist belt 3. A second zipper 49E across the bottom of the fanny pack 17 may also be added to provide greater security and stability to the attachment, as shown in FIG. 9C.

Figure 10:
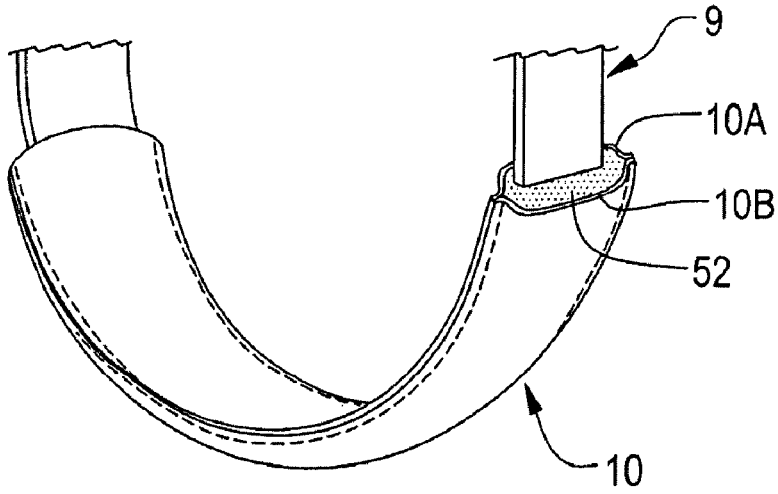
FIG. 10 is a view showing one leg strap of the safety harness, including a cushioning device for such leg strap in accordance with one embodiment of the present invention.

Referring to FIG. 10, a section of one of the leg straps 9 of a fall arresting safety harness is shown, with a surrounding cushioned section 10, which in an embodiment may be constructed of an outer top layer 10A and a bottom layer 10B of a fabric material, which layers are sewn together to surround and encompass the lower portion of leg strap 9. Such surrounding cushioned section 10 is filled with a resilient cushioning material 10C, which material may be made of elastomeric foam, thermoplastic rubber foam such as ethylene vinyl acetate, a natural or synthetic felt or fibrous material, or expanded polymer foam, such as expanded polyethylene or polyvinyl chloride. Such cushioned section 10 is shaped, sized, and configured to provide an optimum level of comfort to the wearer, both while seated, and while standing or walking. A pair of such cushioned sections 10 are positioned on the leg straps 9 of the design of the invention for an improved safety harness, and such sections 10 are provided in order to minimize discomfort to a wearer of such harness when suspended in such harness after experiencing an arrested fall while wearing such harness, and to reduce the constriction of blood vessels in the groin region during such suspension, in an attempt to maintain as much blood flow back from the legs to the heart as possible, and thereby to delay somewhat the onset of the potentially deadly condition known as suspension trauma.

Figure 11:
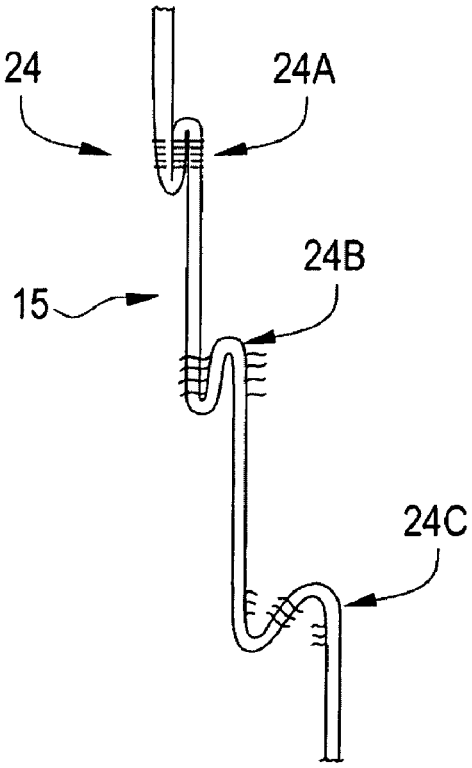
FIGS. 11-11A are views showing a shock-absorbing tether in accordance with one embodiment of the present invention.

In FIG. 11, the sequence of deployment of tear-away shock-absorbing strips 24 is shown. In the case of the uppermost such strip 24A, the force of the fall has not yet caused such section to tear away and unfold to deploy. In the case of the middle shock-absorbing strip section 24B, sufficient force has been exerted by gravitational pull on the tether to partially tear away the shock absorbing section 24B from the main body of the tether 15, and the section 24B is shown to be partially unfolded. Section 24C, the lowest of the shock-absorbing sections shown, is shown as having been fully torn away from the body of tether 15, and is in the process of lengthening the tether as the section 24C unfolds.

Figure 11A:
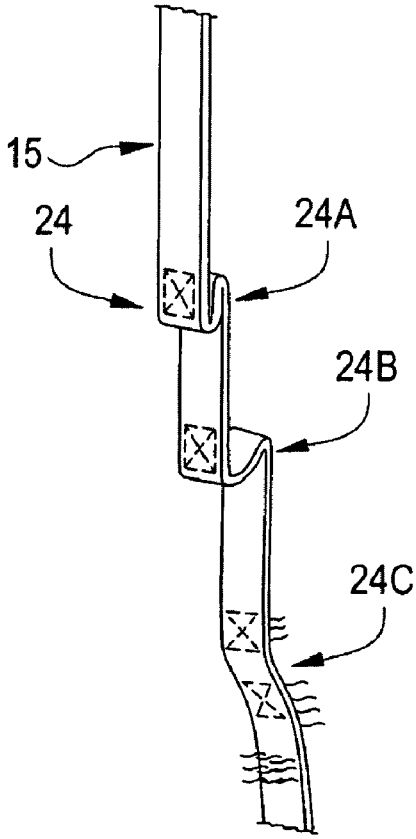

Such gradual unfolding and lengthening, in such a way as to absorb a portion of the shock load arising from the impact of the arrest of a fall of a person who is connected to such a shock absorbing tether 15 is further depicted in FIG. 11A, which again shows the sequence in which such a tether may deploy to reduce the potentially injurious or life-threatening loads which may be caused by an unrestrained fall which is arrested by such a tether 15 attached to a fall-arresting safety harness.

FIGS. 12 and 13 show another type of shock-absorbing tether 15 which may be used in combination with a fall-arresting safety harness to cushion the impact forces of an arrested fall. Such a tether 15 includes a length of rope, a portion of which is "wadded-up" within a sleeve 26 made of a resilient, bungee-cord-type of material. When sufficient force is applied to the two ends of the tether 15, the bungee-cord sleeve stretches, as in FIG. 13, allowing the "wadded-up" or compressed section of the rope tether 25 to extend to its full length. Such extension of the tether 25 is impeded by the elastic resistance afforded by the bungee-cord sleeve 26. A benefit of this type of design is that the tether can recover some of its elasticity by contracting to a shorter length after the sudden impact of a fall has been absorbed, thereby enabling a degree of subsequent shock absorption in the event of further sudden descents or "jerky" downward movements which are arrested by the tether 15.

Figure 25:
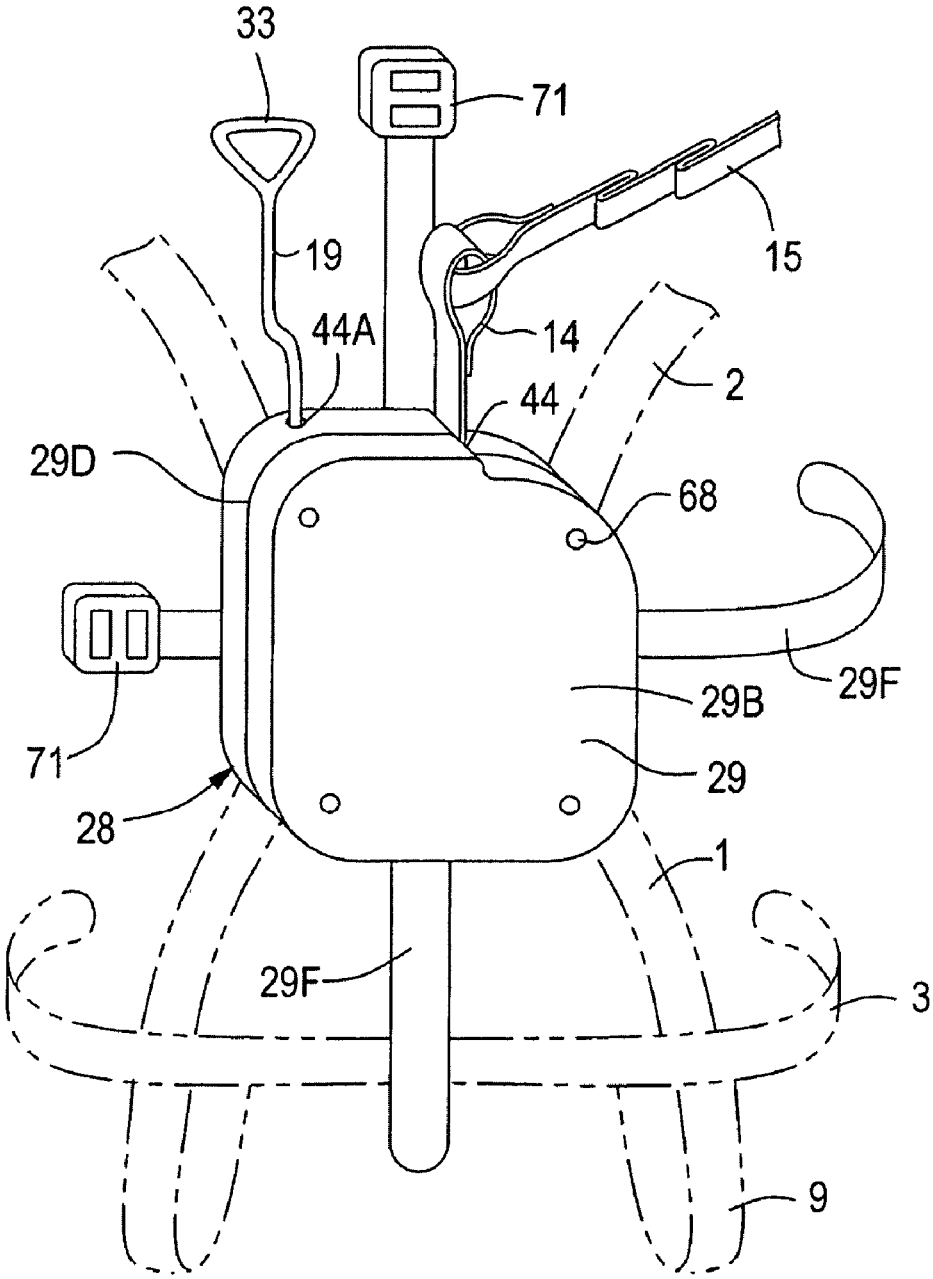
FIG. 25 shows an exterior view of a controlled-descent device contained within an outer housing in accordance with one embodiment of the present invention.

In FIG. 25, an exterior view of an emergency controlled descent device 28 has the enclosure 29 for the device made from a fabric or other flexible, durable material, such as a heavy-gauge PVC sheeting, or Cordura or other heavy duty textile or fabric material. Alternatively, the enclosure could be fabricated or molded from a rigid or semi-rigid plastic material. For applications involving hunting, such fabric would be imprinted with a colored camouflage pattern. The upper end of the store of webbing or line is shown protruding from the enclosure 29 through seal 44, and terminating in connector loop 14, which attaches to a shock-absorbing safety tether 15. The straps 29F are utilized to attach the controlled descent device 28 to a fall-arresting safety harness, either of the improved type as depicted elsewhere herein, or of a more basic commercially-available model. The lanyard 19 is shown, which is attached to brake/lock actuator handle 33. In operation, the descender 28 would be attached to a fall-arresting safety harness via straps 29F. Shock absorbing tether 15 would be attached to a tree by a tree anchor loop 18 as shown elsewhere herein. Such an attachment mechanism provides for the ability to use the descender on a number of different safety harnesses, if desired by the wearer. In the configuration as shown, the enclosure/housing 29 is equipped with a cover flap 29B, which is closed and attached to the body of enclosure/housing 29 by a form of zipper mechanism 29D, to protect the inner components of the descender 28 from rain, dirt, leaves, and other environmental contaminants.

In FIG. 15, the enclosure 29 housing the controlled descent device 28 and the controlled-descent mechanism within are depicted, with cover flap 29B opened, to show the stored coil of line or webbing 30 and the positive brake-lock 35. Such flap enclosure or housing 29, including flap 29B, are constructed of a waterproof fabric, textile, or polymeric material, and equipped with overlapping flaps or other water-resistant closure to seal-off and isolate the descender mechanism 28 within the housing 29, and to protect such descender mechanism and its components from water, dust, or other environmental contaminants such as trash and/or leaves which might possibly interfere with or adversely affect the performance of such mechanism 28.

A controlled descent device 28 has straps that are used to mount the controlled descent device to an existing fall arresting safety harness, such straps representing an alternate mounting configuration, in that they may be constructed of metal or a synthetic fabric or webbing material of suitable strength and durability, or other such material of sufficient durability and strength, and attached by removable fasteners to the internal base mounting plate of the controlled descent device 28.

Referring to FIG. 14, a perspective frontal view shows an improved design of a fall-arresting safety harness, incorporating a built-in emergency controlled-descent device 28. The harness 1 is equipped with shoulder straps 2 which have cushioned sections 13, a cushioned, reinforced waist belt 3 which is adapted for attachment of storage pouch 36 on the left side and across the rear, a chest strap, lapel-mounted storage pockets 21, and attached brake/lock actuator handle 33, as well as the upper end loop 14 of the stored length of webbing or line 30 contained in the enclosure 29 of the controlled-descent device 28, which is connected to shock absorbing safety tether 15. Also shown is a permanently-attached storage pouch 36, which is integrated into the construction of waist belt 3, and which is shown to represent that in another embodiment of such an improved safety harness, such storage pouches may be permanently built-into such systems, as well as removably attached, as per storage pouch 36.

Figure 16:
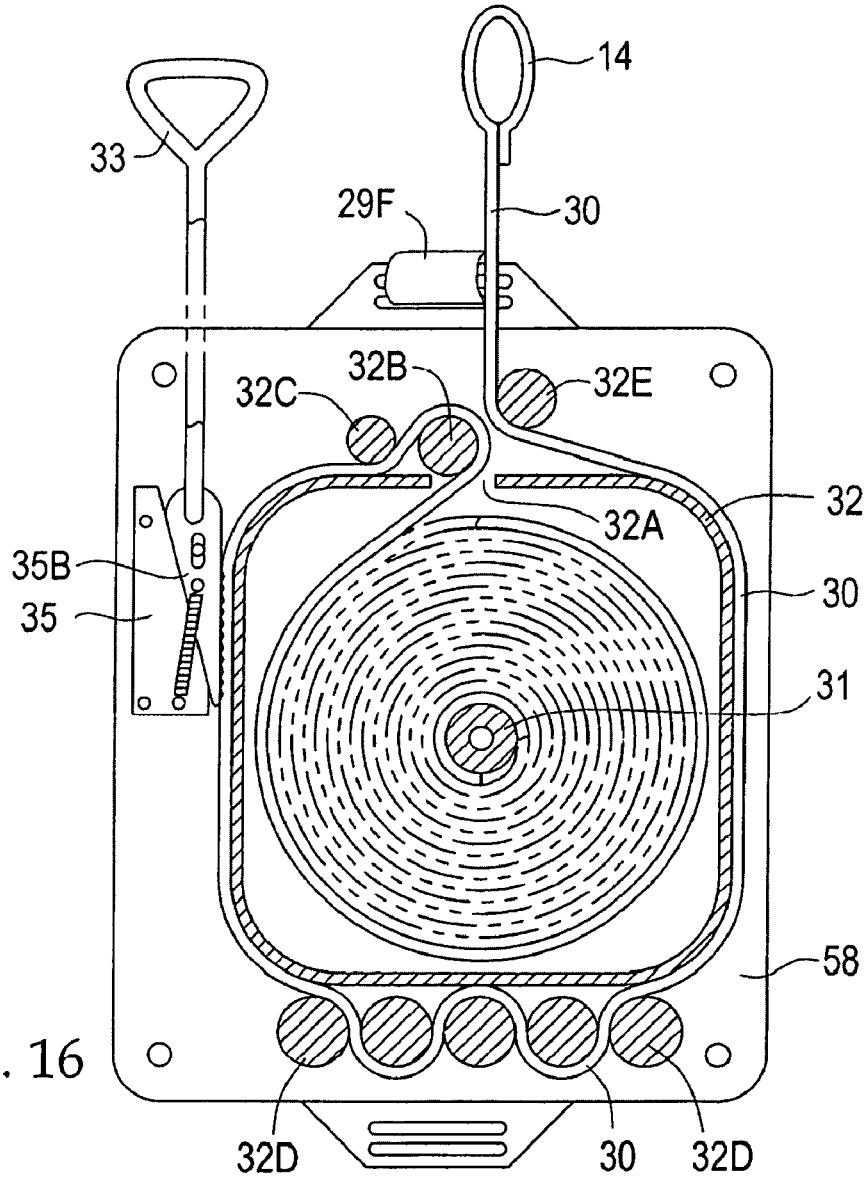

FIGS. 15 and 16 show one embodiment of an improved fall protection system, including an improved safety harness 1, in combination with an emergency controlled-descent device 28, housed in enclosure 29, located generally in the area of the rear panel 12 of the safety harness 1. The store of webbing 30 as shown is housed within an enclosing wall 32, which enclosing wall includes both a container for such store of webbing 30 and a braking drum surface to provide a baseline level of frictional resistance to restrict the velocity of the wearer's descent in the event of a fall. The webbing is arranged within the device such that it exits enclosing wall 32 through opening 32A, and is then passed around capstan 32B, and under capstan 32C, and thence proceeds through a series of capstans 32D positioned below the enclosing wall 32, after which the webbing continues to pass around the exterior of enclosing wall 32, under guide capstan 32E, out of housing 29 through seal 44, where the upper end of such webbing terminates in loop 14. The outer surface of wall 32 and the various contact surfaces of capstans 32B through 32E including the primary braking system, which provides the baseline amount of friction to provide the user a controlled descent at a safe velocity. In particular, significant frictional resistance is created by the passage of the webbing through the serpentine path by the array of capstan-like members 32D. Such baseline frictional resistance may be varied to accommodate users of different weight ranges by-passing one or more of the capstans 32D in the path of the webbing as it is threaded around the enclosing wall/braking drum 32. The housing 29 is equipped with a cover 29B, and the entire controlled-descent assembly 28 is attached to or integrated into the construction of fall-arresting safety harness 1, by use of a base mounting plate 58. Locking-brake 35 is provided to enable the wearer to control and regulate the rate of descent, and also to positively stop the descent, if required. Such brake 35 is actuated by handle 33.

In one embodiment, such enclosing wall 32 may be constructed of aluminum or other lightweight metal, or a suitably strong and heat-resistant polymer or composite polymer (such as glass-reinforced polyester), and such enclosure 29 and cover 29B may likewise be constructed of a lightweight metal, polymer, or composite material, or of a sturdy, waterproof textile or fabric material or plastic sheeting material, imprinted with a camouflage pattern in an embodiment for use in hunting, or in an appropriately high-visibility color such as orange or lime-yellow for industrial or commercial safety applications.

FIGS. 15 and 16 depict another rear view of an improved fall-arresting safety harness 1, equipped with an emergency controlled-descent device 28. In these views, the cover 29B is shown, as are webbing-strap attachments used to attach the base plate 58 of controlled-descent device 28 to the reinforced rear panel section 12 of safety harness 1.

The path of the webbing 30 is clearly seen, as it unwinds from the coil, and proceeds around the outer surface of enclosing wall 32. The function of brake/lock 35 is also more clearly shown, as a spring-loaded wedge 35B, designed to impinge upon the surface of webbing 30 shortly after such webbing emerges from the interior of enclosing wall 32. Brake/lock 35 is located in such position near the point where the webbing or line 30 exits the enclosing wall 32, because such location is the area wherein the amount of force required to stop the pay-out of the webbing under load (as after an arrested fall has taken place) is far less than the amount of force which would be required to stop the payout of the webbing at points beyond the serpentine path described by the primary braking capstans 32D. The point of greatest force, and therefore the greatest frictional force on the webbing is approximately at the location of the last, supporting contact, which is at guide capstan 32E. To place a locking-brake mechanism in such area would require such mechanism to be able to exert far more force that is required at the location of the locking-brake mechanism 35 as shown.

Figure 17:
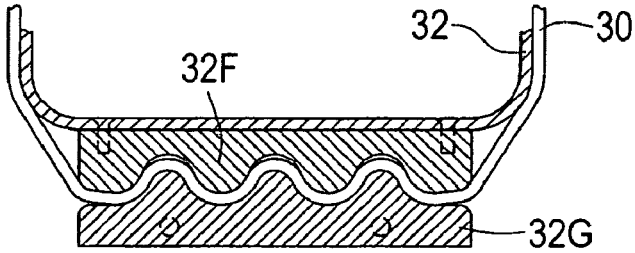
FIG. 17 shows an alternative design for a primary descent-control velocity braking system for a controlled-descent system that utilizes friction-inducing, braking pad segments in accordance with one embodiment of the present invention.

FIG. 17 reveals an alternate embodiment for the primary braking section of the emergency controlled-descent device as shown in FIG. 16. It is constructed of two halves 32F and 32G, the pair having matching interior profiles, such that positioning them adjacent one another and spaced apart by a distance approximately equal to the thickness of the webbing 30 includes a serpentine path for the webbing 30 to pass through, producing a substantial baseline frictional resistance to the passage of such line, even under a heavy load, as after an arrested fall. Such serpentine-path braking halves may be constructed of a metal such as aluminum, or a suitably heat-resistant polymer material, or a suitable composite material such as a fiberglass-reinforced-plastic.

Figure 18:
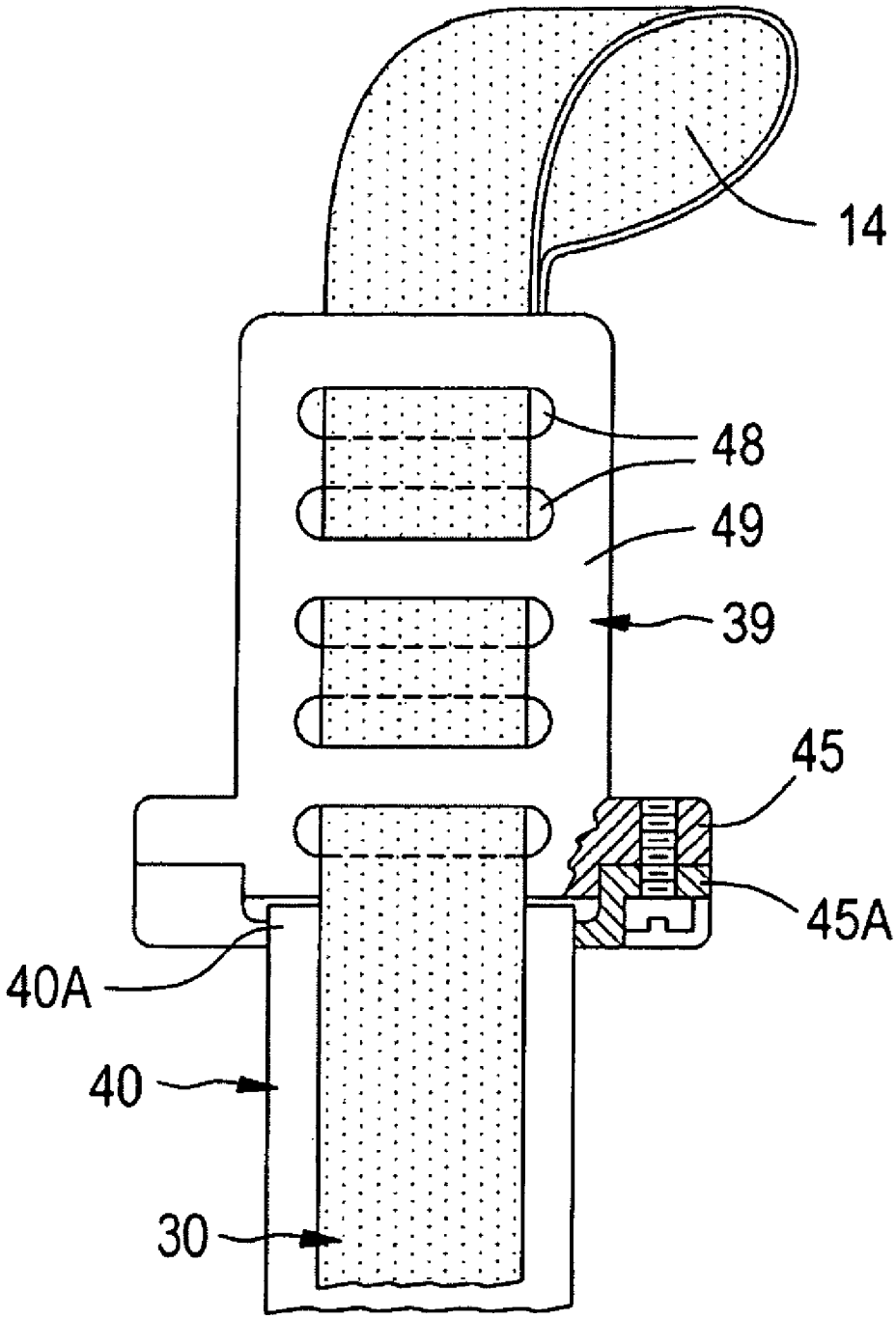
FIG. 18 shows a view of a braking system for an emergency controlled descent device that utilizes a flat metal or composite plastic bar in accordance with one embodiment of the present invention.

FIG. 18 depicts yet another alternate embodiment for the primary braking apparatus of an emergency controlled descent device. In the present configuration, the brake includes a flat bar 39, which bar is equipped with a series of parallel-spaced, rounded slots 48. The lower end of such bar is equipped with an extended boss section 45, through which are inserted two threaded holes. A mating yoke assembly 45A is attached to the boss section 45 of the bar 39, to which is attached one end of a webbing strap 40, which is formed into a loop 40A, and the other end of which webbing strap 40 is attached to a fall-arresting safety harness 1. The top end of webbing 30 after it emerges from the braking bar 39 is formed into loop 14, which is, in turn, attached to a loop 22 at the bottom end of a shock-absorbing safety tether 15, as depicted elsewhere. Upon the occurrence of a fall, or when a need arises to conduct a controlled descent from an elevated position, webbing 30 deploys and begins to pay out through the slots 48, through which the webbing passes in serpentine fashion, from front to back and from back to front, until it emerges at the top of the bar 39. Such serpentine path and the sizing and placement of the bar 39 and slots 48 determine a baseline level of frictional resistance to the line's passage therethrough, which limits the velocity of the descent, based upon the weight of the user. For users of greater or lesser weight ranges, the frictional resistance can be pre-set by passing the webbing through more or fewer slots, as desired, to produce the appropriate controlled descent velocity for a given weight range.

Figure 19:
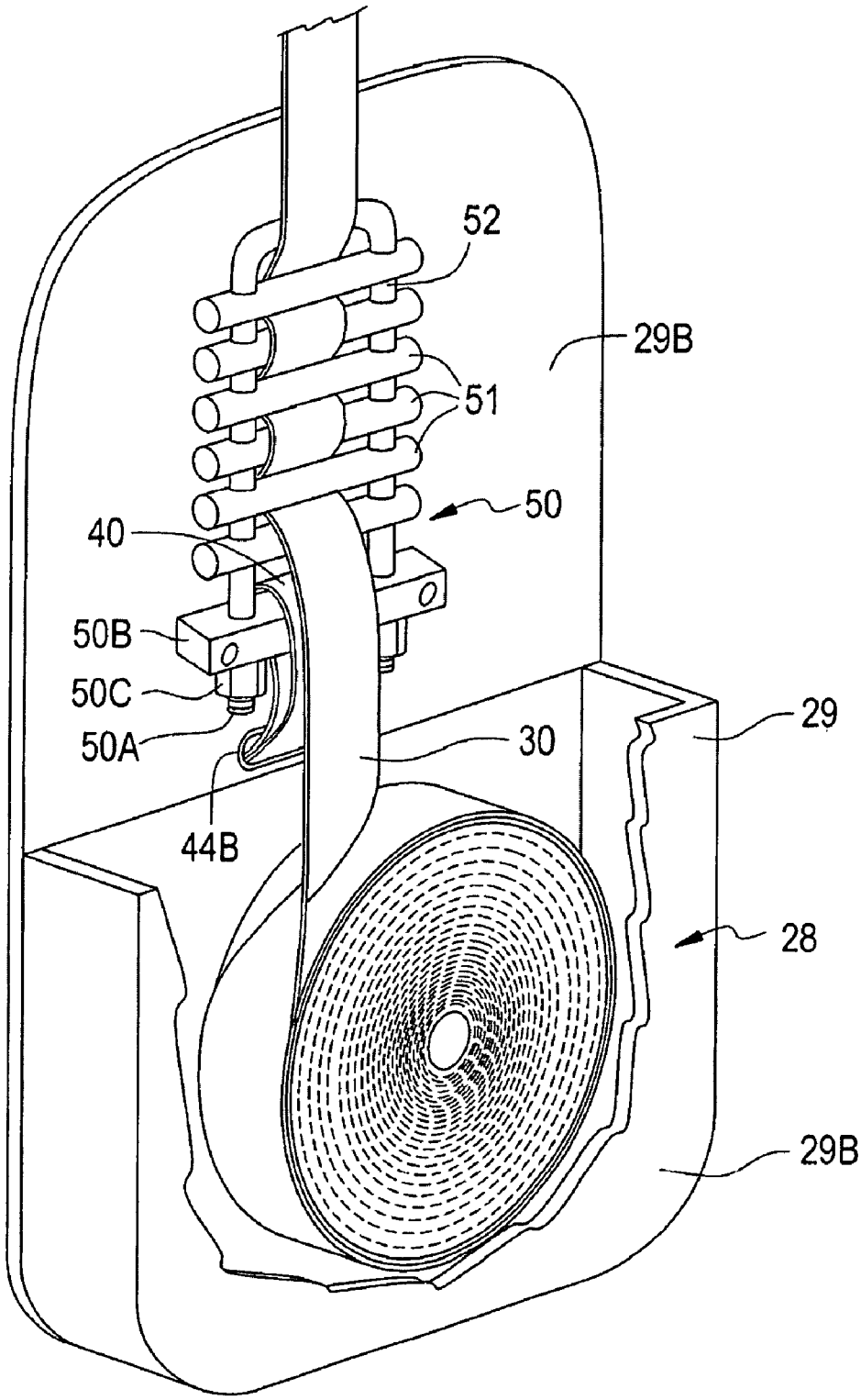
FIG. 19 is a perspective cut-away view of a descent device with a plurality of bars used for braking.

Referring to FIGS. 18 and 19, a rear perspective view of an embodiment of a controlled descent device, employing a "flat-bar" braking system as shown in FIG. 18 or a rappelling rack device 50 as shown in FIG. 19, is shown, including a coil of high-tensile-strength webbing or line 30 of appropriate length, size and strength, housed within an enclosure 29 made of a canvas-like fabric or a flexible plastic or elastomeric material, said enclosure having a closure flap 29B made of the same material as the enclosure 29. Said flap 29B may be held closed by a variety of closure techniques, including hook-and-loop fastener strips or it may be sewn closed or heat-sealed closed, to permit one-time, emergency use only. On the underside of flap 29B is mounted a braking device including a flat-bar, serpentine-path assembly, as shown in FIG. 18, with continuing reference to FIG. 19. The bottom end of such flat bar 39 is securely attached to a safety harness 1 by a section of webbing, line, or other connecting material 40, which section may be constructed of fabric, textile, plastic, composite plastic, metal, or other suitably strong and durable material. Such section 40 passes through the back wall of enclosure 29, through seal, and is then attached to such safety harness 1, or passed around the area of intersection of the shoulder straps on the rear of harness 1, and thence is connected back to a base mounting plate housed within said enclosure 29.

An improved fall safety system, including a fall arresting safety harness 1 to which is attached or built-in a controlled descent device 28, includes a series of bars 51 mounted upon two parallel rails 52, to form a braking member device analogous to a rappelling rack of a type commonly used in mountaineering and technical rope climbing. The coil of webbing 30 rests freely, in "free-floating" fashion, within enclosure 29. The webbing 30, as it exits the coil, is passed back and forth through the bars 51 of the braking device or rappelling rack 50, eventually exiting the device after passing through the bars most distant from the coil. The base of the braking device 50 may be formed by a u-bolt type of construction, wherein the two parallel side rails 52 of the two elongated, straight sections of such U-bolt are included, and the base is formed by the bar 50B which connects the two elongated, parallel, straight sections of the "U" bolt. As shown, such base may include a bottom bar 50B nearest to the coil, which is attached to the two parallel rails 52 by threaded nuts 50C screwed onto the threaded ends of rails 50A. Said bottom bar includes an attachment point for the anchor loop 40, which is attached to and a part of the fall-arresting safety harness 1, which loop is passed into the flexible enclosure 29 through a slotted elastomeric sealing member 44B which is firmly affixed to the back wall of enclosure 29, and which loop 40 thereby serves as an anchor-attachment point for the apparatus 50 to the safety harness 1. The upper end of the webbing 30 is formed into a sewn loop 14, and permanently attached to shock-absorbing tether 15, via a loop 22 sewn into the proximal (lower) end of shock-absorbing tether 15 (shown elsewhere herein).

In the event of an accidental fall which is arrested by an improved safety harness as shown in FIG. 19, the fall is first arrested by the shock-absorbing tether 15 and the safety harness 1. Next the weight of the individual as he/she reaches the end of the tether 15 exerts sufficient force to pull up and open the flap 29B, orienting the braking device 50 in a vertical direction, from whence the weight of the person begins to pull against the webbing 30, which begins to pay out gradually against the frictional resistance created by contact of the webbing with the alternating surfaces of the bars 51 which include the serpentine path of the braking device 50, producing a slow and controlled descent, until the person reaches the ground. The coil of webbing 30 can be as long as may be contained compactly in the housing, but generally a length of approximately 30' provides sufficient length for most situations, given that the height of the person and the length of the tether can be added to the length of the webbing to derive the maximum height from which a person can descend and still touch the ground. Even if the amount of the webbing is insufficient by several feet, the safety of the individual is still greatly enhanced, even if he/she were still suspended several feet above the ground when the end of the webbing is reached, which situation might require the person to cut the webbing 30 and drop the remaining several feet, as compared to the original predicament of being suspended 30 feet or higher off the ground, in a safety harness, with no safe way to get down.

Figures 20, 20A:
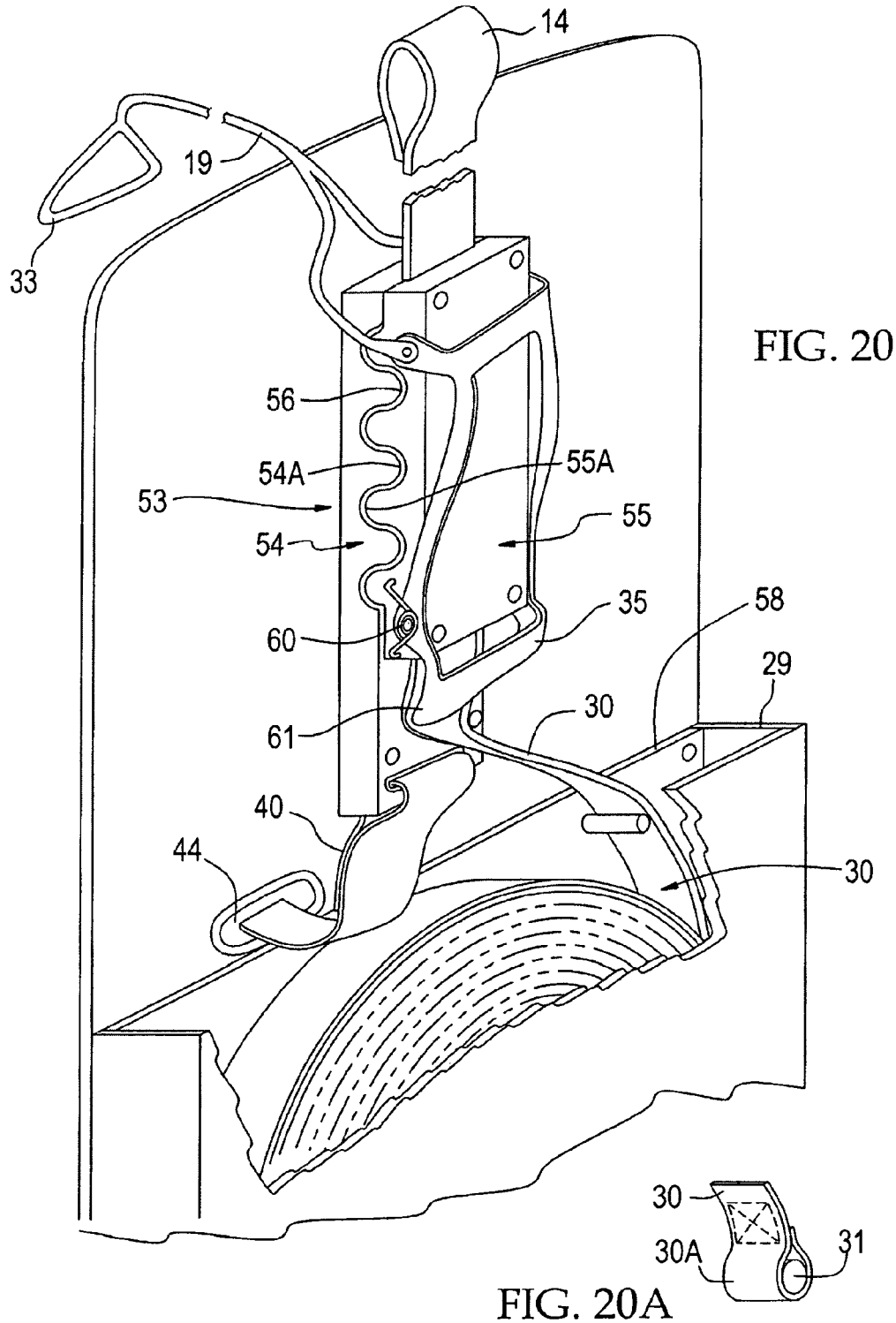
FIGS. 20 and 20A show a descent device with a serpentine path through facing bars.

Referring to FIGS. 20 and 20A, another embodiment of a controlled-descent system is depicted, which includes an outer fabric enclosure 29 containing a store of webbing or line 30, and an attached braking device 53 including a flat metal bar 54, a lower end of which 54 is attached to the tether-attachment point of a safety harness 40, or is otherwise secured to said harness. Said metal or composite plastic bar has a first, or outer surface 54A which is configured to include one-half of a serpentine path, and is mounted adjacent to a second flat bar 55, which second bar 55 is equipped with an interior surfaces 55A including a serpentine path which mirrors and mates with the surface 54A in such first bar 54. Such bars 54 and 55 are mounted one to another such that the space between such mating convoluted surfaces includes a serpentine path 56, through which space the descent webbing or line 30 can be passed. Such webbing 30, in following such a serpentine path 56 contacts and rubs against first one side, then the other of such path, in forceful contact with the male lobes of such serpentine path, in order to generate a frictional drag on said webbing or line, and thereby controlling the rate at which such webbing or line can pay out during a controlled descent, with the upper end loop 14 of such webbing or line 30 attached to the bottom end loop 22 of such shock-absorbing safety tether 15. The bottom or inner end 30A of such webbing or line 30 is configured such that when essentially all of the webbing or line has been paid out, the bitter end of the webbing 30A is contained, and not permitted to pass through the brake, effectively terminating the descent at that point. The configuration of the serpentine path may be altered to include more or fewer convolutions on surfaces 54A and 55A to produce, respectively, more or less frictional drag on the webbing or line as needed, depending on the weight of the wearer/fall victim. In addition, other techniques may be provided to increase the friction on such webbing or line either before, during, or after it passes through said serpentine-path braking system, to generate more or less friction, as needed, or to firmly jam against the webbing or line in order to completely stop the payout of the line or webbing in order to prevent or interrupt a descent. An example of such a device is shown, including a spring-loaded positive locking device 35, which device is attached to a release lanyard 19 connected to an actuator handle 33. Upon pulling the handle 33, the force of the spring 60 is overcome, which releases the braking surface of the device 61 from contact with the webbing or line 30, thereby releasing the positive-braking friction imposed by the device 35 upon the webbing or line 30 when it is in the normal, fall-arresting mode.

Figure 21:
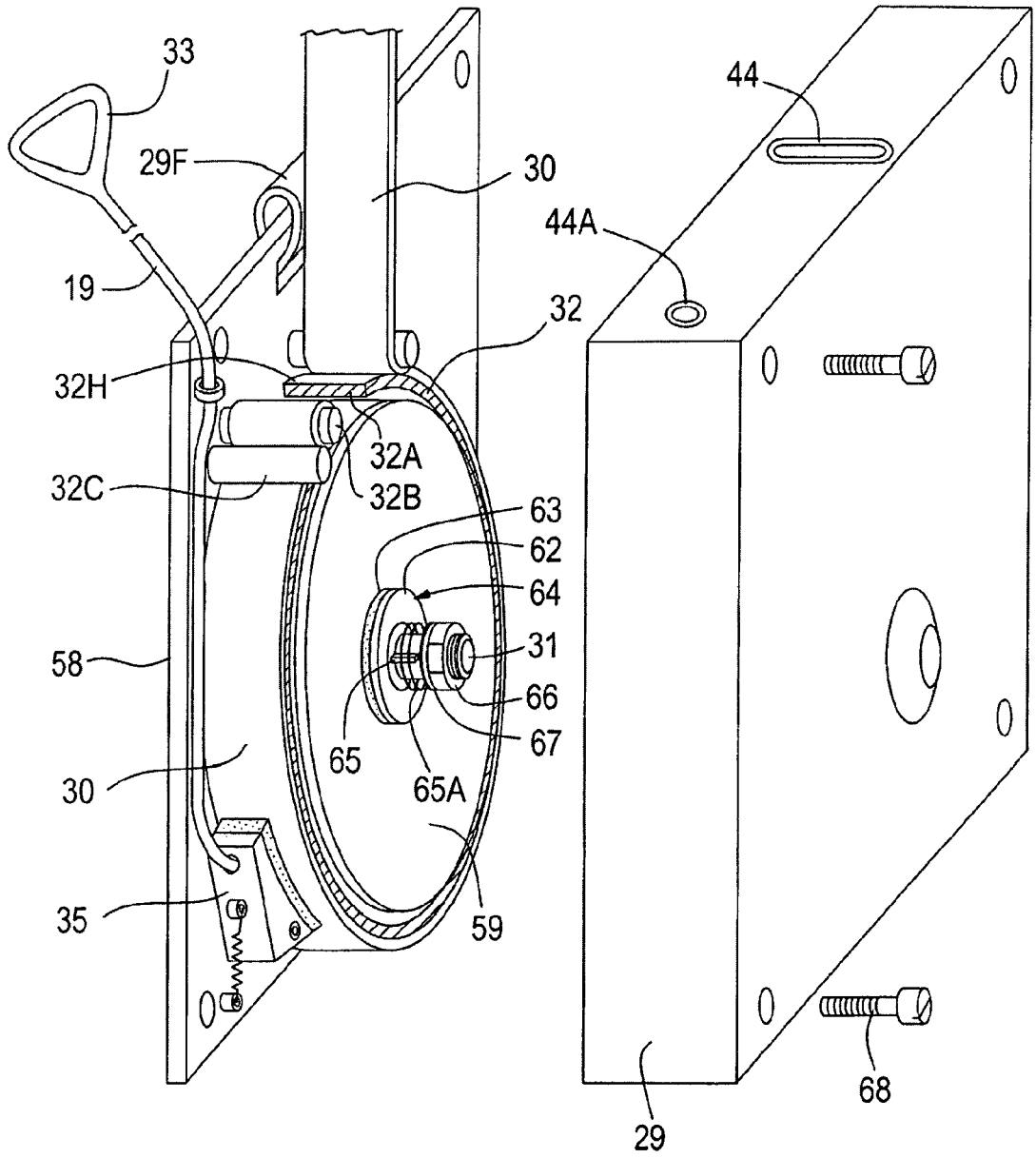
FIGS. 21-24 show views of a controlled-descent system featuring a descent line made of rope or cable, which line passes from the interior storage chamber and utilizes a "braking drum" or "capstan" type of braking mechanism in accordance with one embodiment of the present invention.

Referring to FIG. 21, an alternative configuration for a braking system for a controlled-descent system is shown. In such configuration, a descent line made of rope or cable 30, passes from the interior storage chamber inside the surrounding wall 32, and upon exiting therefrom is forced into firm contact with the outer surface of such surrounding wall by capstans 32B and 32C, whereupon such outer surface 32H includes a "braking drum" or "capstan" type of braking mechanism. In such configuration, the line may be wrapped around the drum one or more times, to adjust the braking resistance generated to retard the rate of descent of victims of varying weights, before exiting the system, where the end of such line is formed into a loop 14 (shown in other figures), which is attached to a shock absorbing tether 15 (shown in other figures), or other attachment point of an elevated surface. Additional braking and stop-and-release mechanism 35 may also be employed, as shown, to initiate a descent, or to interrupt a descent, after a fall. Such additional braking mechanisms may include a "drag-washer"-type braking system wherein the coil of webbing or line 30 is contained on a spool having a pair of containment flanges 59, and which spool and integral flanges are rotatably mounted upon a central, threaded spindle 31, and held in place thereon by a washer 62 having an inner surface to which is mounted a disc 63 of heat-absorbing braking material or "drag-washer" material. The interior bore of such brake-disc- and washer combination 64 is keyed to mate with a matching projection 65 on the spindle 31 to prevent rotation of the washer assembly 64 with respect to the spindle 31. The braking surface 63 of the washer is held in firm contact with the outer face of flange 59 by a compression spring 65A, which spring is compressed and held in place by lock nut 66 and flat washer 67. The firm contact of the braking surface 63 with the outer flange face 59 presents substantial friction resistance to rotation of the flange 59, thereby adding to the frictional resistance on the line or webbing 30 produced by contact with the outer surface 32H of enclosing wall 32. Such frictional resistance may be adjusted to accommodate a given weight range of wearer by tightening or loosening the nut 66.

An embodiment of enclosure 29 is likewise shown in FIG. 21. Such enclosure in such embodiment may be made of formed metal or plastic, and attached to base plate 58 by use of bolts 68. Such enclosure 29 is equipped with elastomeric sealing grommets 44 and 44A, to permit sealing around the webbing 30 and lanyard 19 as such webbing and lanyard pass through the outer wall of such enclosure 29. Such elastomeric sealing grommets may be supplemented by additional resilient sealing and adhesive material applied to said webbing 30 and lanyard 19 at the point where such webbing (or line) and lanyard 19 pass through the wall of enclosure 29.

Figure 22:
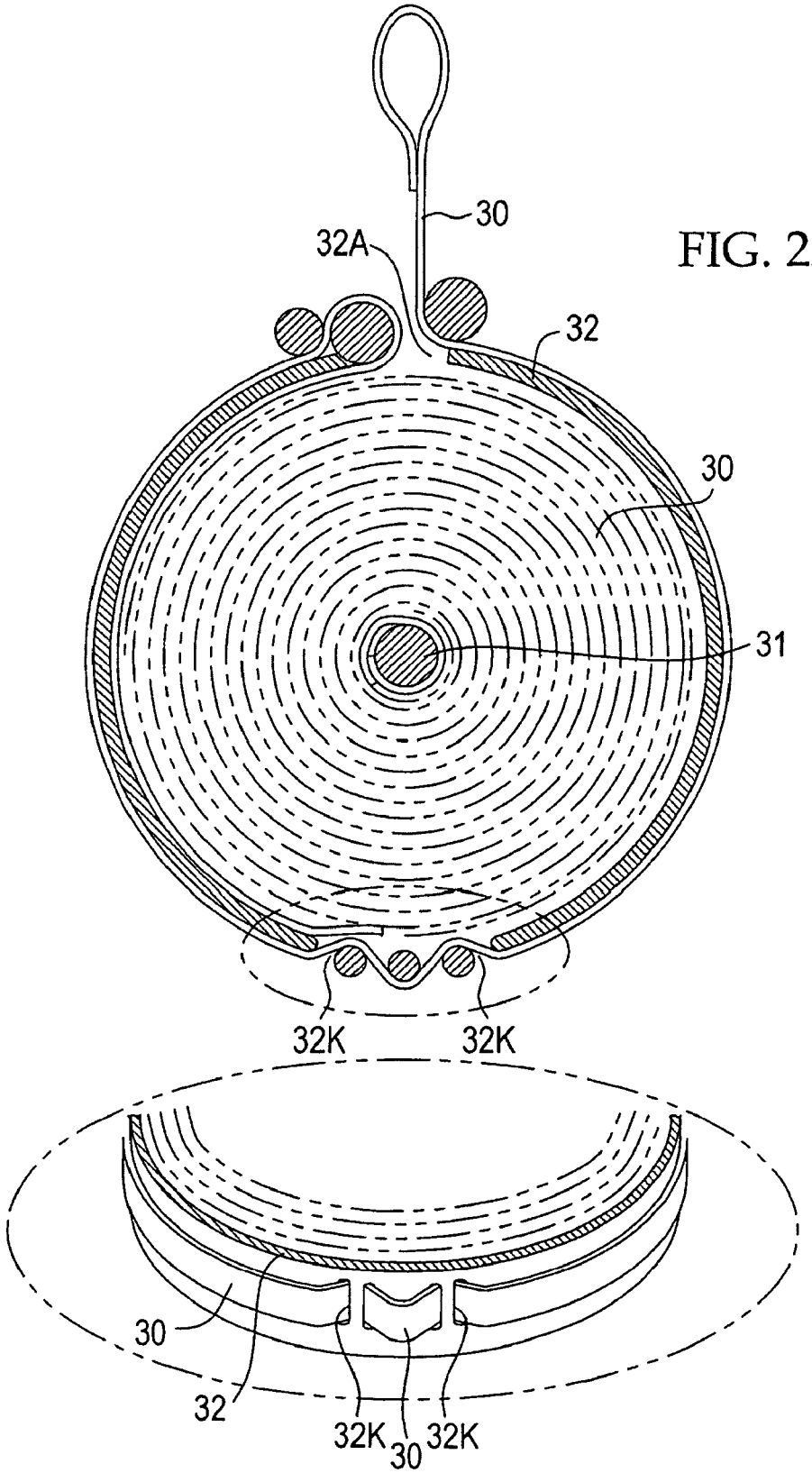
Figure 23:
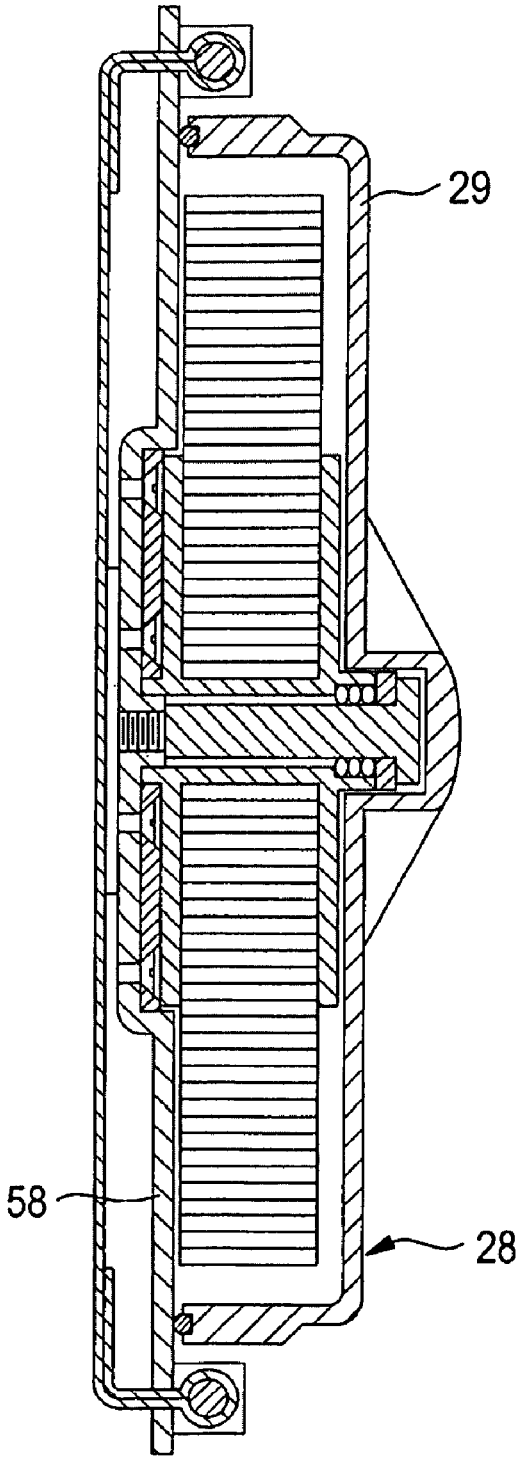

FIG. 22 is a drawing which depicts another possible design for the primary braking system of a controlled descent device, such braking system including an enclosing wall 32 made of aluminum or other lightweight metal or other suitably strong and heat resistant polymer or composite polymer material, having an inner surface and an outer surface, said enclosing wall surrounding a space which contains a store of webbing or line 30, and having an opening 32A at the top of such enclosing wall. Into the surface of such enclosing wall are positioned a series of rounded slots 32K which penetrate the surrounding wall 32. When the webbing or line 30 is drawn from within its storage space inside enclosing wall 32, and passed around the outer surface of wall 32, and thence through the series of slots 32K, in back-and-forth direction, such slots 32K include a serpentine path through which the webbing or line 30 is passed in order to generate frictional drag on such line or webbing, in order to achieve a controlled payout of such line or webbing under the load created by the weight of the wearer in the event that such wearer experiences a fall which is arrested by a fall-arresting safety harness.

Such design incorporates, integrates, and combines the line or webbing storage function with the braking function in the function of the single enclosing wall 32 surrounding the store of line or webbing 30, and may be supplemented by other braking components or other positive-locking and release mechanisms, as elsewhere described by drawings and specification included herein Such braking force as generated by the frictional resistance created by passage of the webbing under load through such slots 32K, in serpentine fashion, may be adjusted by utilizing more or fewer slots, and by changing the spacing of such slots. In addition, supplemental stopping mechanisms or positive-locking brake mechanisms may be employed, as per the configurations shown as No. 35 elsewhere herein.

Figure 24:
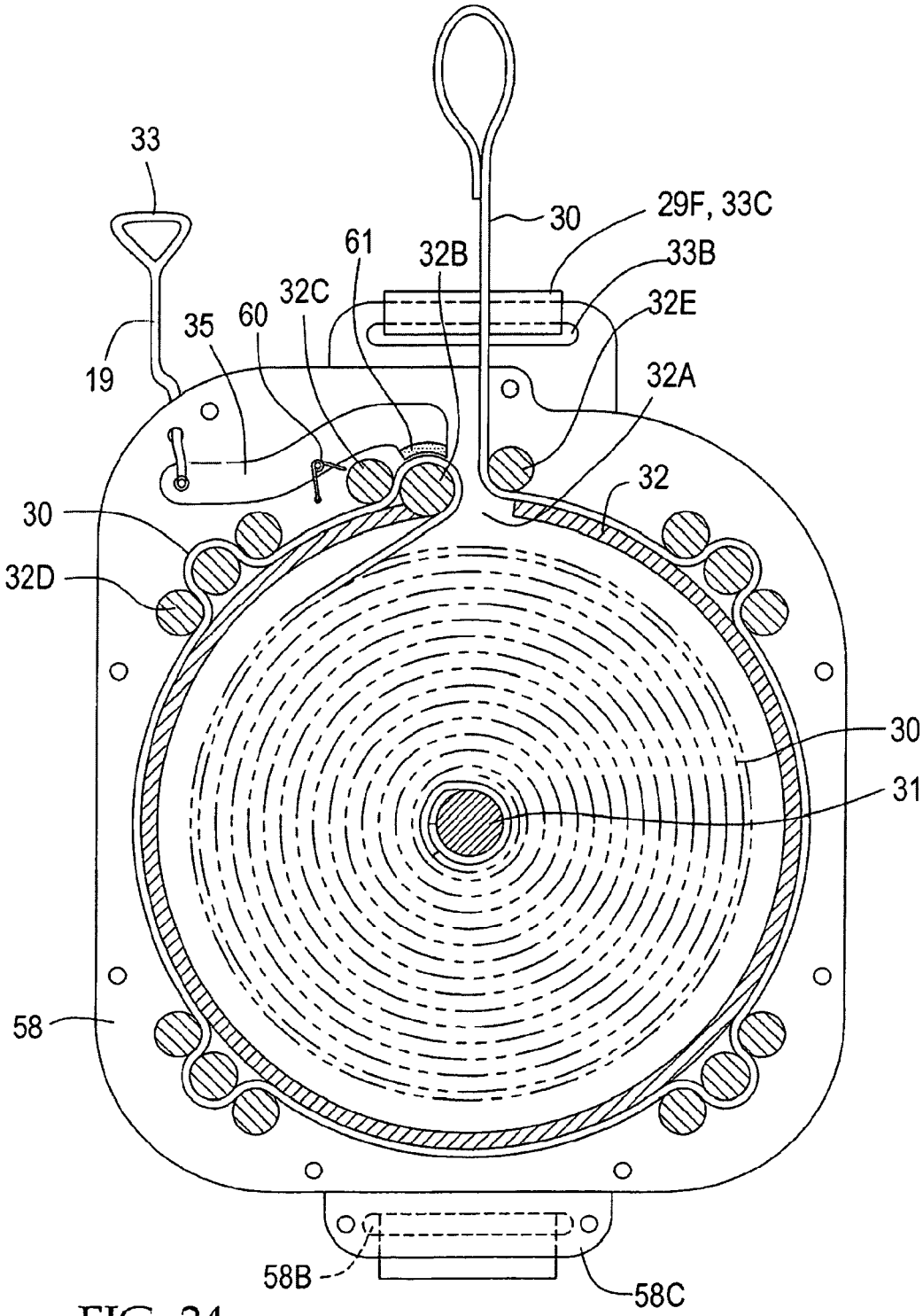

Referring to FIG. 24, the internal components of another configuration of a braking system for an emergency descent system are shown, depicted as attached to a mounting plate 58, designed to be incorporated into or attached to a fall arresting safety harness. In this embodiment of the design, an enclosing wall 32 having inner and outer surfaces includes an enclosing wall to contain a store of line or webbing 30, and serves the additional purpose of a braking drum, or friction-inducing device. Upon exiting from the opening 32A in the enclosing wall 32, line 30 is passed around and between fixed capstans 32B and 32 C, which capstans press the webbing 30 into firm contact with the outer surface of enclosing wall 32. One or more groups of spools, fixed stanchions, or capstans 32D may be attached to the base plate 58 in close proximity to the outer surface of enclosing wall 32, to hold such webbing or line 30 in close, firm contact with such outer surface of enclosing wall 32, and to include a series of friction-inducing serpentine paths in the areas where such capstans are mounted, through which the emergency-descent webbing or line 30 may be passed, with such friction as is created by such braking drum and capstans restricting the rate or velocity at which such webbing or line 30 is paid out against the weight of the wearer, in the event such wearer experiences a fall which has been arrested by the fall-arresting safety harness 1 (as shown elsewhere herein).

Such controlled line or webbing payout velocity produces a controlled-rate descent after a fall which is arrested by a fall-arresting safety device. A lever-actuated, spring-loaded positive braking and release mechanism 35 is also shown, including a spring 60 for maintaining such brake and release mechanism in either normally-open, or normally-closed position, and a heat absorbing, friction-inducing braking pad section 61 which is pressed against the webbing 30 adjacent to capstan 32B in order to slow or to stop a descent. Such positive braking-lock is positioned thusly because such location is where the least amount of force is necessary to achieve positive braking or full stop of the payout of the webbing or line (i.e., before the webbing or line passes through other elements of the primary braking system). In addition, the attachment of the device to a safety harness is done with webbing straps 29F, at mounting slots 33B. One end of such webbing strap may be sewn into a permanent loop 33C, which is attached to slot 33B. After passing such length of webbing 29F around the shoulder strap area of a fall-arresting safety harness, such webbing is returned to the base plate 58, and passed through a second slot 58B, and thence may be clamped securely to such base plate 58 by clamping block 58C. Other techniques of attachment of such controlled descent device may be employed without departing from the spirit or the scope of the invention.

In FIG. 25, an exterior view of a controlled-descent device 28 is shown, as such a device would be packaged and contained within an outer housing 29, which housing 29 may be formed of plastic, metal, fabric, or other such materials, and adapted for attachment to the rear of a fall-arresting safety harness 1, by a pair of webbing-straps 29F equipped with fastening devices 71, such as buckles, or various forms of rope or webbing clamps or clamp-blocks, screws, bolts, pins, or other fasteners, to secure such webbing straps 29F around the rear section of the shoulder straps 2 of such harness, in the area where such straps converge or cross, which is the point of maximum strength and the anchor point on such harnesses. Also shown are weather-proof grommet-seals 44 and 44A, as well as shock-absorbing tether 15.

Figure 26:
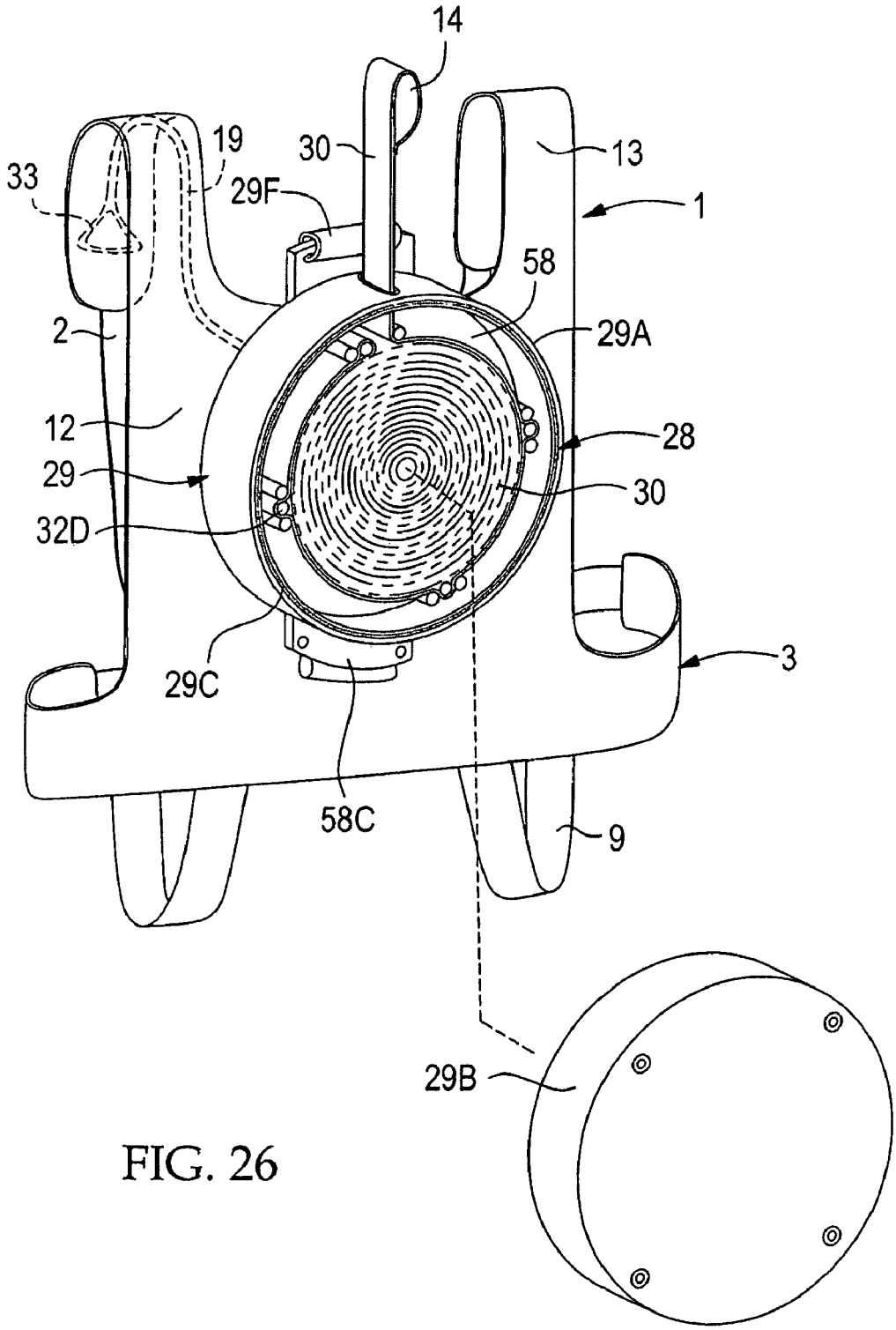
FIG. 26 shows a view of a fall-arresting safety harness in combination with an emergency controlled-descent device that utilizes a series of strategically-positioned stanchions or fixed capstans in accordance with one embodiment of the present invention.
Figure 27A:
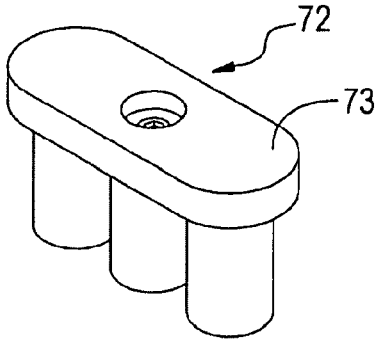
FIGS. 27A-30 show various configurations and mounting assemblies for capstan "modules" in accordance with one embodiment of the present invention.
Figure 27B:
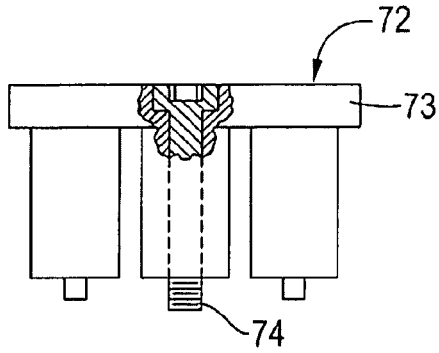
Figure 27C:
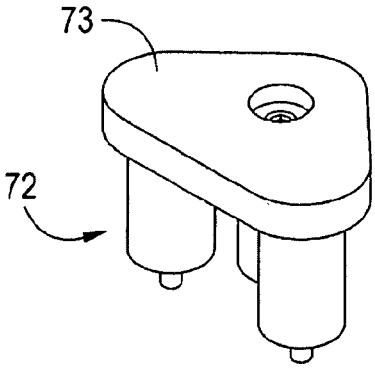
Figure 28:
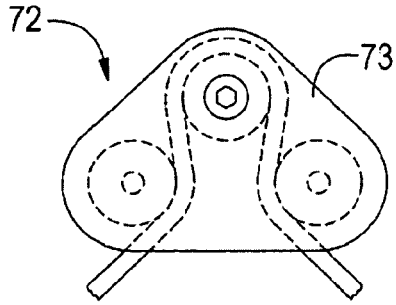
Figure 29:
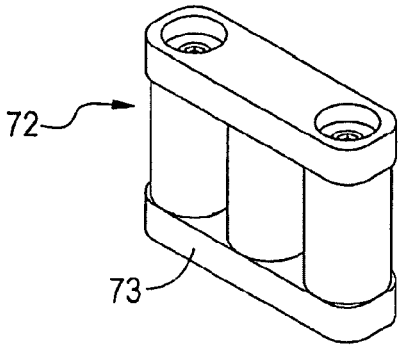
Figure 30:
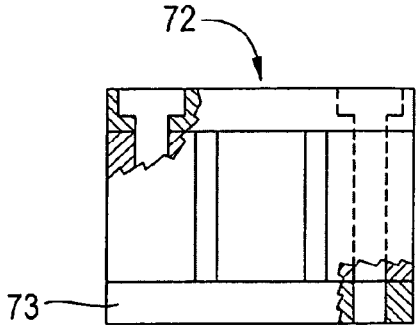

In FIG. 26, a perspective view of an embodiment of an improved fall-protection system is shown, which system includes, first, an improved fall-arresting safety harness 1, combined, secondly, with an emergency controlled-descent device 28, showing the harness 1 and components thereof, as well as the controlled-descent device 28, including one section or half 29A of a two-piece enclosure 29 attached to or integrated into the rear panel 12 of the safety harness 1, which enclosure houses the store of line or webbing 30, primary braking mechanisms including a series of one or more strategically-positioned arrays of stanchions or fixed capstans 32D through which the webbing is passed after unwinding from the coil of webbing or line, and in addition a positive stop-and-release braking mechanism 35 designed to initiate or to interrupt a controlled descent. In addition, a cover section 29B of the enclosure 29 of the controlled-descent device is shown, such housing and cover manufactured from a suitable thermoplastic polymer, composite polymer, thermosetting polymer, metal, such as aluminum, fabric such as a waterproof Cordura-type canvas material, or a vinyl-lined or other-polymer- or elastomer-lined fabric made of either natural or synthetic fibers. Such enclosure section 29A is equipped with a resilient sealing member, or O-ring, 29C, such that when sections 29A and 29B are mounted to one another to house the controlled descent device 28, the interior of such enclosure 29 thus formed will be sealed from water intrusion, and protected from dust, trash, leaves, or other environmental contaminants which could affect the performance of the interior components of such controlled-descent system 28.

A key feature of this embodiment of a controlled descent device having a store of webbing or line 30 is that said store of webbing or line 30 is contained within the space defined by the positioning of the series of capstans around such store of webbing or line. Threading such webbing or line through such series of capstans 32D positioned around the mounting plate 58 allows the webbing to include its own self-containing storage area without the necessity for any type of walled enclosure, thereby saving weight and simplifying construction and assembly, and thereby lowering the costs to manufacture the device. FIG. 26 further shows the various elements of the integrated safety-harness-and-controlled-descent-system, such as the leg straps 9 of the harness 1, shoulder straps 2, shoulder strap cushioned area 13, webbing section used for attachment of the controlled-descent device 29F, waist belt 3, tether-attachment loop 14, and stop-brake actuator handle 33 and lanyard 19.

FIGS. 27A-30 show various possible configurations and mounting assemblies for capstan array "modules" which may be employed as the primary braking mechanisms for a controlled-descent device as described above and as shown in FIG. 26. Such arrays 72 may be constructed from a combination of capstans attached to a master mounting plate 73, and mounted to the mounting plate 58 by a fastening device such as a screw or bolt 74. Alternatively, such capstan arrays may be milled, molded or cast from a suitable metallic or polymer or composite polymer material. A further alternative, to produce a higher-strength capstan array would be to form such parts from a high-strength, lightweight metallic material by forging such parts.

Figure 31:
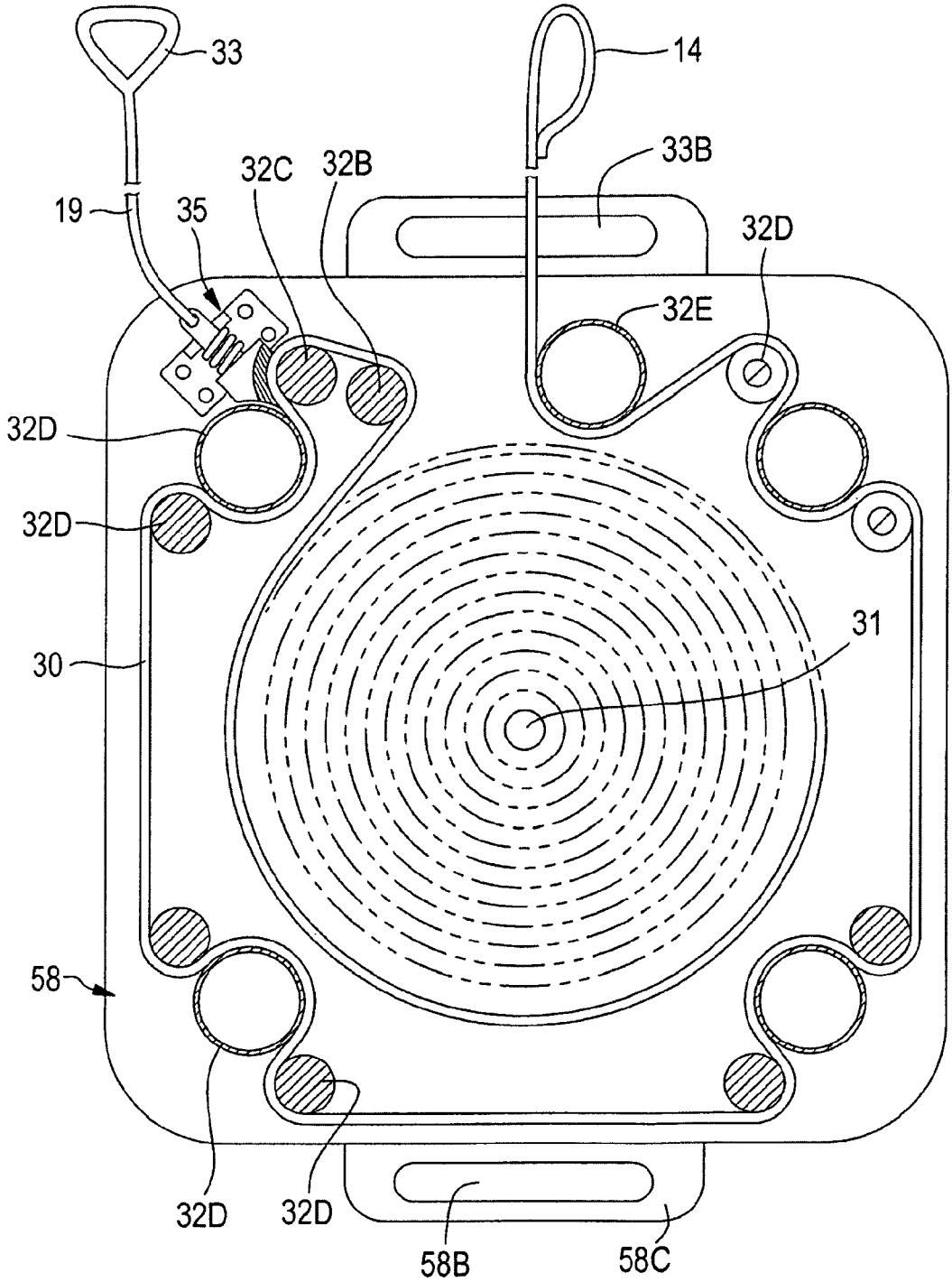
FIGS. 31 and 32 show views of the geometry of a braking system in accordance with one embodiment of the present invention.
Figure 32:
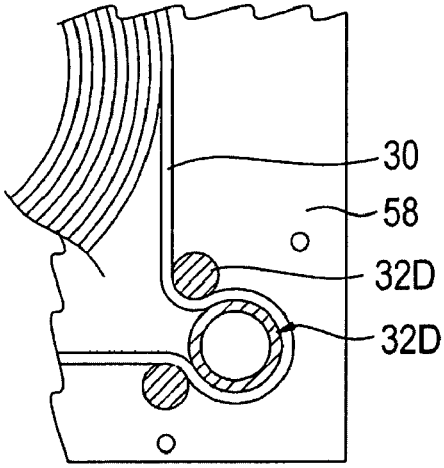

FIGS. 31 and 32 depict an additional embodiment of a braking system for a controlled descent device. The geometries depicted may be created by a variety of techniques other than by forming the lobes or nodes 32B-32E as part of the surrounding wall; for example, such nodes or lobes could be included of a series of larger-diameter tubes or rods 32B-32E affixed to the base plate 58, in combination with stanchions or capstans 32D, to accomplish a similar travel path and to induce frictional resistance on the line or webbing. Likewise, if sufficient numbers of tubes and capstans 32D are employed around the perimeter, it would even be possible to construct a braking system as shown, wherein the positioning of the braking nodes 32B-32E defines a path for the webbing or line such that the webbing or line includes its own enclosure for the store of webbing or line, thereby eliminating the need for a distinct and separate surrounding wall, eliminating the need to manufacture and install such enclosing wall 32, and thereby reducing the weight and complexity of the system.

Figure 33:
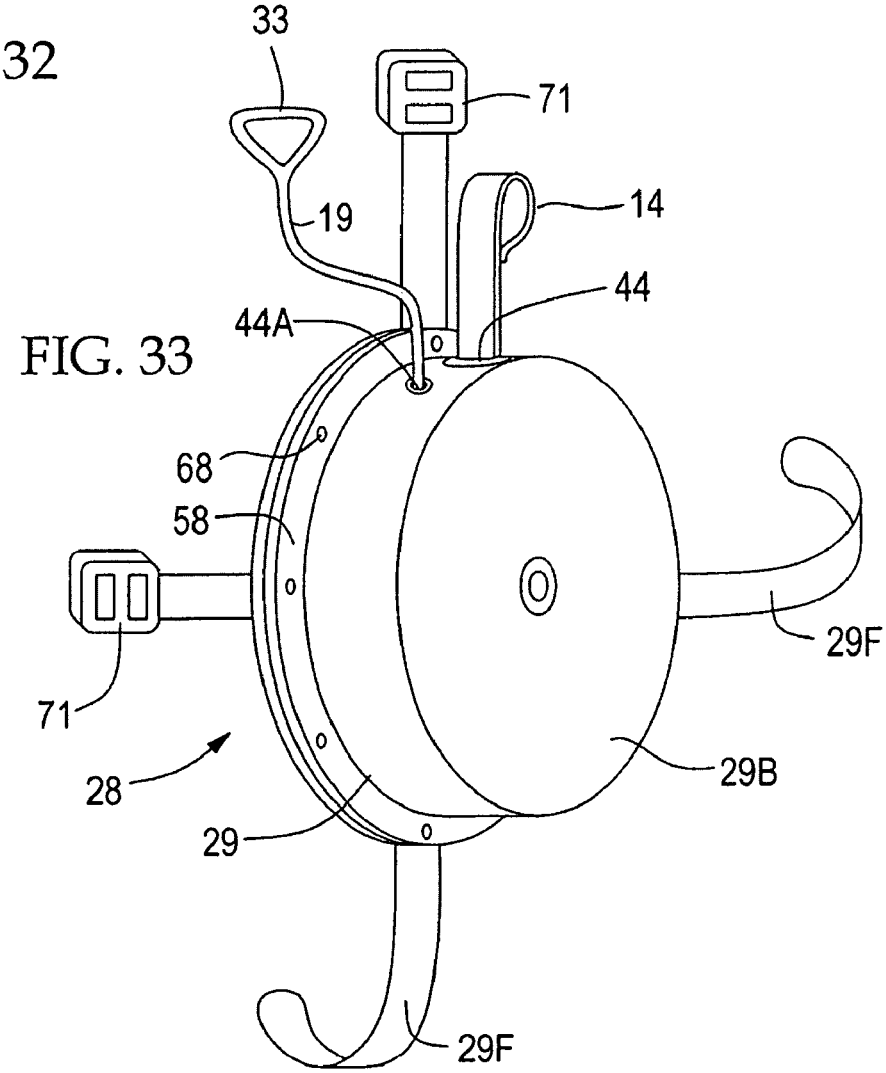
FIG. 33 shows an exterior view of an embodiment of an emergency controlled-descent device, such device being housed within a housing which is attached to a base plate in accordance with one embodiment of the present invention.

FIG. 33 shows an exterior view of another embodiment of an emergency controlled-descent device, such device being housed within a housing which is attached to a base plate 58, and which is further adapted for attachment to a fall-arresting safety harness by a pair of webbing belt-straps 29F, each of which is equipped with fastening devices 71 to secure the device 28 to said safety harness 1 (as depicted elsewhere). In this embodiment, the enclosure 29 is included of base mounting plate 58, to which is attached enclosure cover 29 B, which attachment is effected by screws or bolts 68, or by other fastening devices. Positioned between base mounting plate 58 and cover 29B is a resilient sealing gasket member 29C (as depicted elsewhere herein), which gasket member, in combination with sealing members 44 and 44A prevent the intrusion of water or other environmental contaminants into the interior of the enclosure 29, thereby protecting the interior components of such controlled-descent system 28.

Figure 34:
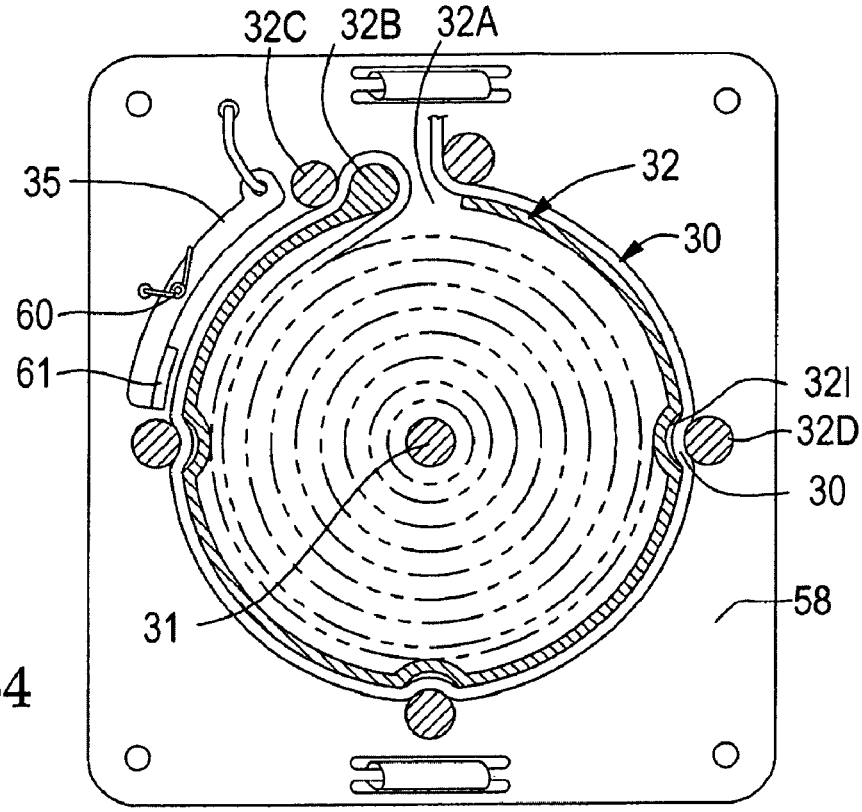
FIGS. 34 and 35 show a views which depict alternative designs for the primary braking system of a controlled descent device incorporating a wall surrounding a store of line or webbing in accordance with one embodiment of the present invention.

FIG. 34 depicts another embodiment of a primary braking system for a controlled descent device, such embodiment incorporating an enclosing wall 32 surrounding a store of line or webbing 30, which wall 32 is configured approximately in the shape of a cylinder, with indentations 32I in the surface of such wall 32 at one or more key points around the perimeter of such wall 32, adjacent to which indentations are positioned fixed stanchions or capstans 32D, utilized to redirect the travel of a length of webbing or line through such indentions 32I and around such capstans 32D, to increase frictional drag upon such line or webbing at such points. The addition of more of such indentions 32I and fixed capstans 32D, or the elimination of one or more of such capstans 32D, may be employed to adjust the amount of frictional drag needed to provide a controlled payout of the line or webbing 30, resulting in a controlled descent for a wearer of a given weight range, when such device 28 is attached to or incorporated into a fall-arresting safety harness. The current embodiment integrates the line or webbing storage function with the braking function in the single enclosing wall 32 surrounding the store of line or webbing, and may be supplemented by other braking components or other positive-locking and release mechanisms, such as the braking lock-and-release mechanism 35 as shown, and as elsewhere described in the drawings and specification.

Figure 35:
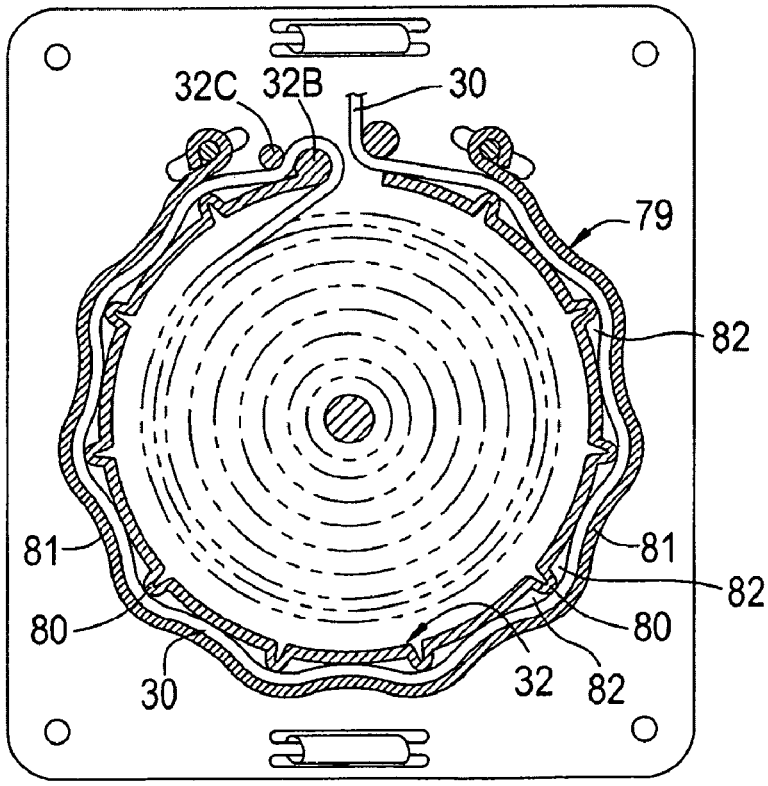

Referring to FIG. 35, an embodiment of an improved braking device for a controlled-descent system is shown, including a surrounding wall 32, which wall 32 surrounds, encloses, and contains a store of webbing or line 30, and which wall 32 is included of a fabricated or extruded section of a suitably heat-resistant material such as aluminum or a heat-resistant polymer compound or composite material. The surrounding wall 32 is equipped with one or protruding lobes 80 which, when multiple lobes 80 are employed, are spaced generally at regular intervals around the circumference of such surrounding wall 32, such that such lobes are generally of a height which is at least equal to or greater than the thickness of such webbing or line 30. Likewise, the device is equipped with an approximately mating outer enclosing wall 79 fabricated or extruded in similar manner and of similar materials as the inner surrounding wall, the minimum, minor diameter of the inner surface of which enclosing wall 79 is approximately equal to the outer diameter of the inner enclosing wall 32, plus twice the thickness of the webbing or line being utilized. In addition, such outer enclosing wall 79 is equipped with a series of inwardly-projecting nodes 81 which include the minor diameter as mentioned above, and which nodes 81, when the such outer enclosing wall 79 is placed over the inner enclosing wall 32, with the webbing or line passed through and occupying the annular space between such members, rest in the recesses between the male, outwardly projecting nodes 80 of the outer surface of the inner enclosing wall.

Figure 36:
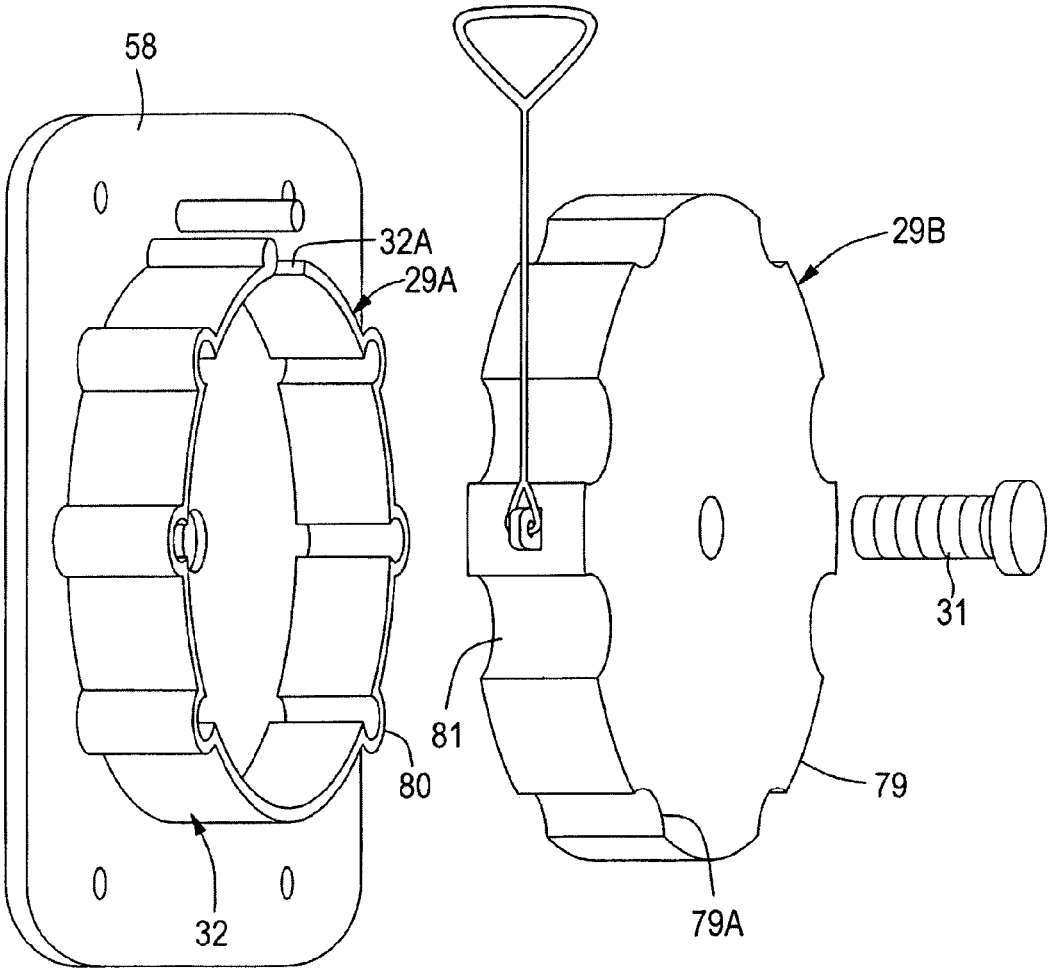
FIG. 36 is a perspective view of the inner surrounding wall, attached to a base mounting plate, and an outer enclosing wall as depicted in FIG. 35 in accordance with one embodiment of the present invention.

Given that the length of webbing or line is "sandwiched" between such inner and outer wall 32, 79, such that rotation of such inner and outer walls with respect to one another results in an impingement of the respective outwardly and inwardly projecting nodes 80 and 81, respectively, upon such webbing or line 30, greatly increasing frictional resistance to passage of the line 30 around and through such annular space. Such variable frictional resistance can be controlled, even to the point of clamping the webbing or line 30 and preventing any payout of such webbing or line 30, by sufficient rotation of the inner and outer walls 32 and 79, respectively, with respect to one another. Such rotation may be effected by a cable-actuated or line-actuated, spring-loaded mechanism, such as is shown in FIG. 36, thereby including an effective braking system for the controlled payout of line in the event of an accidental fall or other emergency requiring the wearer to descent in a controlled, gradual manner. Such braking system offers the advantages of great simplicity, being constructed from just two primary, probably extruded, major components, which increases dependability while reducing weight, material costs, and assembly costs.

FIG. 36 depicts the inner and outer enclosing walls 32 and 79, respectively, of the embodiment of a braking mechanism for a controlled-descent device as described above and depicted in FIG. 35, above. Referring now to FIGS. 35 and 36, the figures show the base mounting plate 58, to which is attached or integrated the inner enclosing wall 32, the entire assembly of which is designed to be attached to or integrated into the construction of a fall-arresting safety harness 1, as previously described and depicted herein. As shown, the inner enclosing wall 32 is integral with base mounting plate 58. An outer enclosing wall 79 is formed such that it includes the side wall of a closed-end cylinder. Such enclosing wall 79 is formed with one or more indentations 79A in such enclosing wall 79, producing one or more radially-inward projecting nodes or lobes 81 around the inner surface of enclosing wall 79. The outer enclosing wall 79 may be telescopically positioned to fit over inner enclosing wall 32 in such a way that nodes 81 rest between the male nodes 80 which project radially outward from the outer surface of inner enclosing wall 32, with an annular space between such inner wall 32 and outer enclosing wall 79 which approximates the thickness of the descent webbing or line 30. Such inner and outer walls 32 and 79, respectively, can be mounted together in such telescoping relationship via a central mounting bolt, including a central hub 31, which passes through the center of the faces of each of such members, and which also can hold the loop 30A at the innermost end of the coil of webbing or line 30.

Once the two sections, which together then include enclosure 29, are mounted together in a telescoping relationship, with the store of webbing or line contained within the chamber inside the interior surface of enclosing wall 32, and passing through the annular space 82 between the outer surface of enclosing wall 32 and the inner surface of enclosing wall 79, the outer enclosing wall 79 can then be rotated with respect to the inner wall 32, in order to bring the male lobes 80 into an interfering relationship with female, inwardly projecting nodes 81, thereby reducing the thickness of the annular space 82 between the two enclosing walls, thereby squeezing the webbing or line 30 at the points where such annular spaces 82 are so constricted. Such rotation resulting in constriction of the annular space 82 results in greatly increased frictional resistance on the webbing or line 30 which is so compressed by the interacting lobes 80 and 81, which friction may be used to restrict the velocity at which the store of line or webbing 30 is paid out from the webbing or line storage chamber defined by the interior of enclosing wall 32, to effect a controlled descent at a gradual rate after an arrested fall. Such rotation and resultant braking (or, alternatively, release) of the webbing or line may be effected by the wearer, by pulling on the positive brake-stop lanyard using the actuator handle. As can be seen from the drawing, the spring which holds the two enclosing walls in the desired neutral position during normal use can be sized, positioned, and mounted such that positive rotation of the outer wall, with automatic return to a null position, may be effected, thereby including an effective braking system to restrict the velocity of the line or webbing 30 paid out after a fall, to provide a controlled, gradual descent for the wearer.

Figure 37:
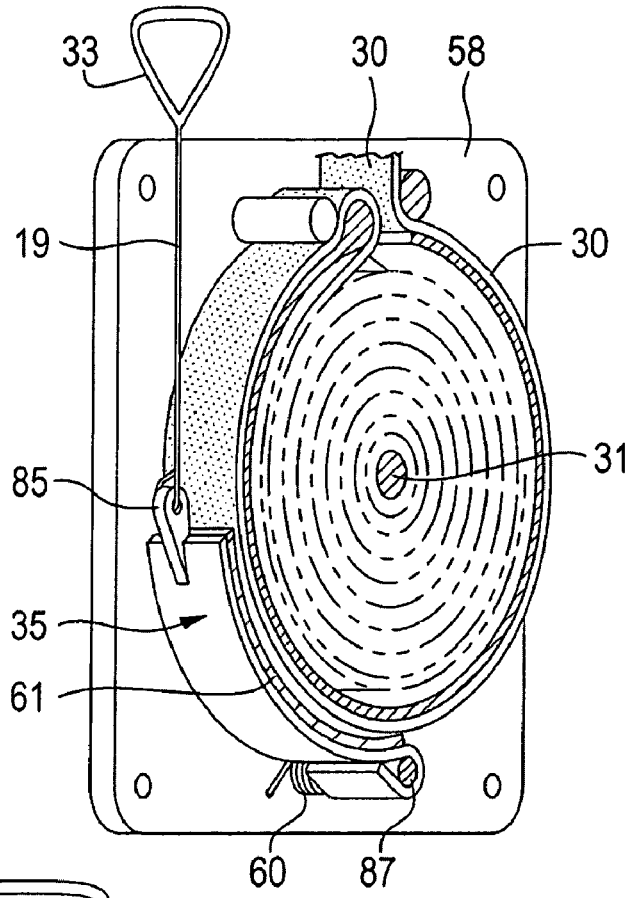
FIG. 37 shows a view of a device with a line clamp with a pull-pin-release in accordance with one embodiment of the present invention.
Figure 38:
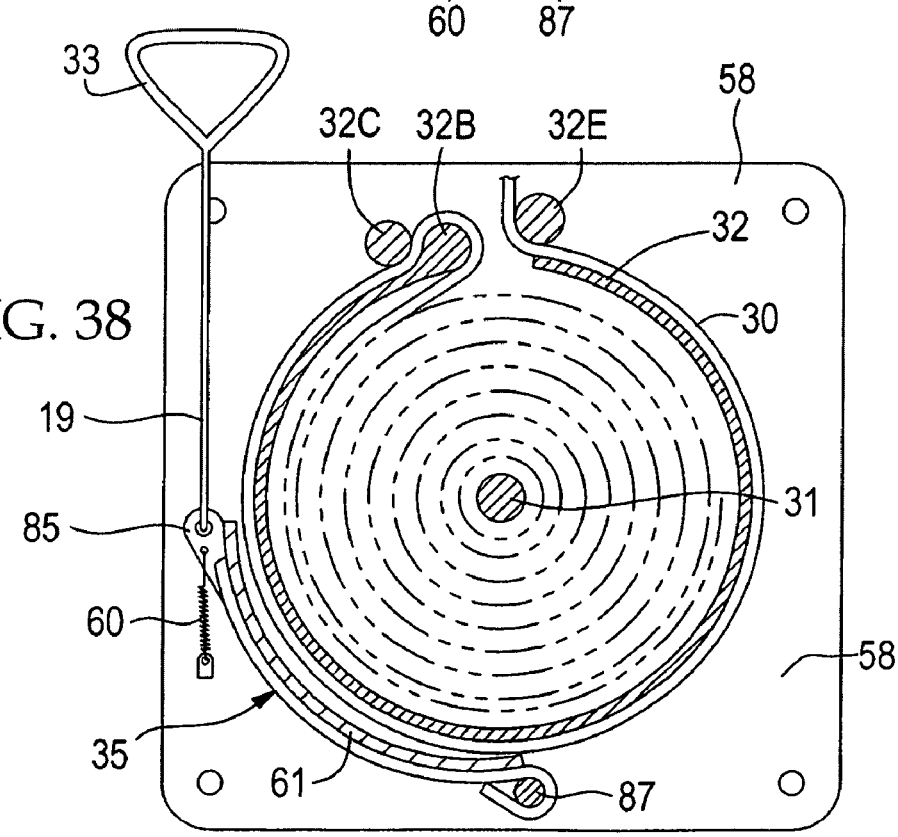
FIG. 38 shows a view of an alternative design for the primary braking system of a controlled descent device incorporating a wall surrounding a store of line or webbing, which surrounding wall is configured generally in the shape of a cylinder in accordance with one embodiment of the present invention.

In FIG. 37, an alternative configuration is shown wherein another device 35 including a braking-strap is employed to slow or to stop the webbing or line 30 from paying out, when activated after a fall by the wearer. The strap 35 is pivotally mounted at one end to a pivot pin 87, spring-loaded by spring 60, and equipped with a friction-inducing, heat-absorbing brake pad 61, which pad 61 is forced against the coil of webbing or line 30 to impede or slow the rate of descent in a controlled descent after an arrested fall. If configured as a "normally-closed" (clamped or locked-down) system, the brake drum included by enclosing wall 32 could serve as a primary braking mechanism, and the braking-strap mechanism 35 could be released by pulling on a cable-actuator 33 to relieve the strap from firm contact with the webbing or line 30 in order to initiate the controlled payout of the line or webbing 30, and the resultant rate of descent of the wearer. Alternatively, the braking strap mechanism 35 may be used as a positive stop-lock by configuring the braking strap device 35 as shown in FIG. 38, in a "normally-open" mode. In the event that an arrested fall is experienced, the descent of the wearer would begin automatically. Such descent can be slowed, then, or brought to a complete stop, by actuating (pulling) the handle 33 to force the braking pad 61 into firm, frictional contact with the webbing or line 30. Such webbing or line is slowed primarily by frictional contact with the outer surface of enclosing wall 32, which contact is imposed by capstans 32B, 32C, and 32E.

As with other designs shown herein, such pivoting-strap braking mechanism may be supplemented by other braking components or combined with other positive-locking and release mechanisms, as elsewhere described in the drawings and specification, without departing from the spirit and scope of the invention.

FIG. 38 is a perspective drawing which further depicts an embodiment of the primary braking system of a controlled descent device, as described above and depicted in FIG. 37. Such design incorporates a wall 32 surrounding a store of line or webbing 30, which surrounding wall 32 is configured generally in the shape of a cylinder, and the outer surface of which wall 32 serves as a friction-inducing braking surface to increase frictional drag upon such line or webbing 30 during the controlled descent of a wearer of the device. The design is further equipped with a pivoting strap 35 to include an additional braking surface, which strap may be forced, by lever and/or cable 19 actuation, into firm contact with the webbing or line 30 as it passes around the outer surface of the surrounding wall 32 during a descent, in order to induce more friction, and therefore to further retard the rate of payout of such line or webbing, to slow a descent, or in order to bring such a descent to a halt. By re-configuring the lever and by using a compression spring instead of an extension spring 60, the mechanism may be employed in a "normally-closed" mode, in which mode the strap is held in firm contact with the webbing or line 30 to create sufficient friction to prevent the webbing or line 30 from moving even under load as induced by the weight of a fall victim until after a fall occurs. Through the use of a remote-cable "rip-cord-type" actuator 33 moving a lever arm 85, the force of the spring which holds the braking pad 61 against the webbing or line 30 may be overcome, such that the braking strap can be moved away from contact with such webbing or line 30, thereby releasing it to pay out gradually at the rate determined by the primary braking system.

Figure 39:
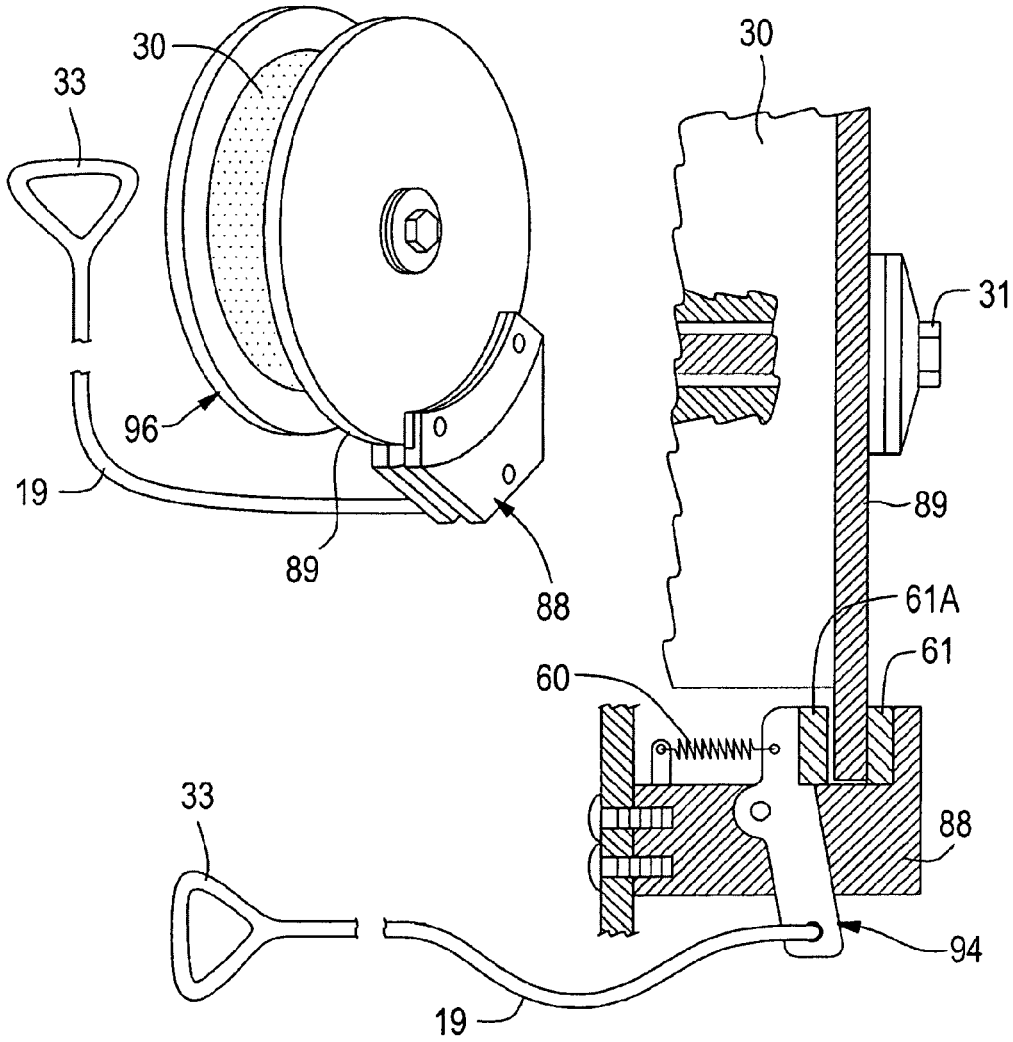
FIG. 39 shows a view of a design of a line-storage and braking system for an emergency controlled-descent device in accordance with one embodiment of the present invention.

FIG. 39 shows yet another embodiment of a store of a line-storage and braking system for an emergency controlled-descent device, incorporating a main spool 96 containing a coil of webbing or line 30, and having at least one outer spool-flange 89 having a diameter larger than the diameter of such coil of webbing or line 30, with such spool 96 and flange 89 mounted upon a central shaft 31 in such a manner that rotation of such spool and flange are permitted. Primary braking, as well as a positive-stop locking function are accomplished in this embodiment by the use of a manually-actuated disc brake mechanism 88 similar to an automotive disc braking design. The protruding, larger-diameter flange section 89 serves as the disc, or rotor, and a lever-actuated braking mechanism 88 is employed to clamp a friction-inducing braking-pad surface 61A against the rotor flange 89, and to sandwich such rotor flange 89 between such braking pads 61A and 61, thereby controlling the rate at which the spool 96 of line or webbing 30 rotates, and therefore the rate at which such line or webbing 30 is paid out, during a fall.

Such braking mechanism 88 may be equipped with a fixed braking pad 93, as described above, which bears upon the rotor, which fixed braking pad is set to provide a "baseline" amount of frictional drag which provides a descent within an acceptable velocity range for persons within a given weight range. By actuating the spring-loaded lever mechanism 94 provided, via the cable 19 and handle 33 provided, the lever 94 can be used as a brake caliper to force the braking pad 61A firmly against the rotor to stop rotation of the spool, and payout of the line or webbing 30. Alternatively, in a normally closed configuration, a compression spring may be employed in the braking system to maintain the braking pad 61A in firm, forcible contact to prevent rotation of the spool. In the event of a fall, the wearer could release the braking pad 61A from contact with the flange/rotor 89, in order to initiate a controlled, gradual descent at a safe velocity, by pulling on the cable actuator handle 33 to affect the release of pressure by the brake pad 61A against the flange rotor 89.

Figure 40:
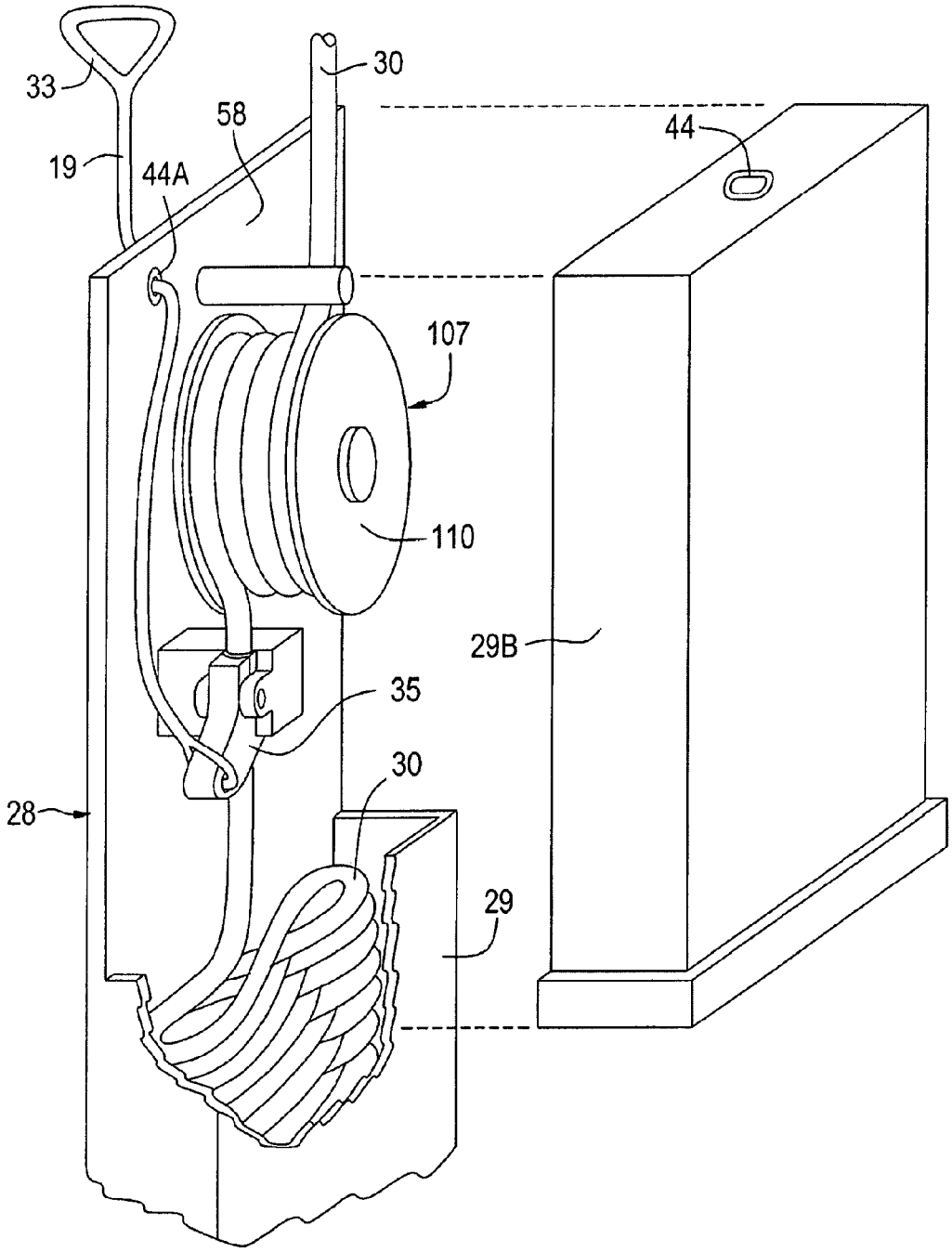
FIG. 40 shows a view of a "capstan-type" braking device for a controlled descent device in accordance with one embodiment of the present invention.

FIG. 40 shows a view of a "capstan-type" braking device 107 for a controlled descent device 28, which may be configured to be attached to or integrated into the construction of a fall-arresting safety harness 1 (as shown elsewhere herein). In the present design, a store of rope 30 is contained within a housing 29 as shown, which is likewise attached to a base plate 58, to which base plate 58 is mounted a capstan-type device 107, around which the rope or line 30 is passed several times before being guided out the top of such device. The top of such rope or line 30 would terminate in a loop as shown in other drawings which are included herein. A primary braking device 107 is shown which imposes a certain baseline frictional resistance, or "drag", upon the rope. Such resistance may be variable, and may be set to provide an optimum controlled descent velocity for persons within one or more weight ranges. In addition, such braking device 107 includes secondary, positive-locking braking or stop mechanism 35, which mechanism is actuated by pulling a handle 33 connected to the positive-locking brake device 35 by a length of cable or line 19. Such primary capstan braking device 107 functions much in the same manner as a capstan drum on a boat or ship, or a windlass drum in stationary position on a boat or ship.

By taking several turns around such drum 110, the mechanical advantage gained thereby is sufficiently great that relatively small amounts of force are required to control the payout of the line 30. In the current design, the forces acting upon the primary and positive-locking braking system(s) 107 and 109, respectively, are greatly reduced by virtue of the mechanical advantage gained from having the line pass around the capstan 110 several times. Depending upon the weight of the wearer of a safety harness, more or fewer turns around the capstan could be employed to pre-set the friction and thereby to adjust the friction to produce the desired rate of descent for wearers within a given weight range. Also shown is a cover member 29B, which is configured to complete the enclosure 29, and equipped with appropriate sealing mechanisms to provide a weatherproof seal between such cover member 29B and such enclosure 29, and additional sealing mechanisms 44 and 44A, such as an elastomeric grommet or other sealing mechanisms, to provide a weatherproof, leak-proof seal around such line 30 and cable 19 at the points where such cable 19 and line 30 exit the enclosure 29 or the cover 29B.

Figure 41:
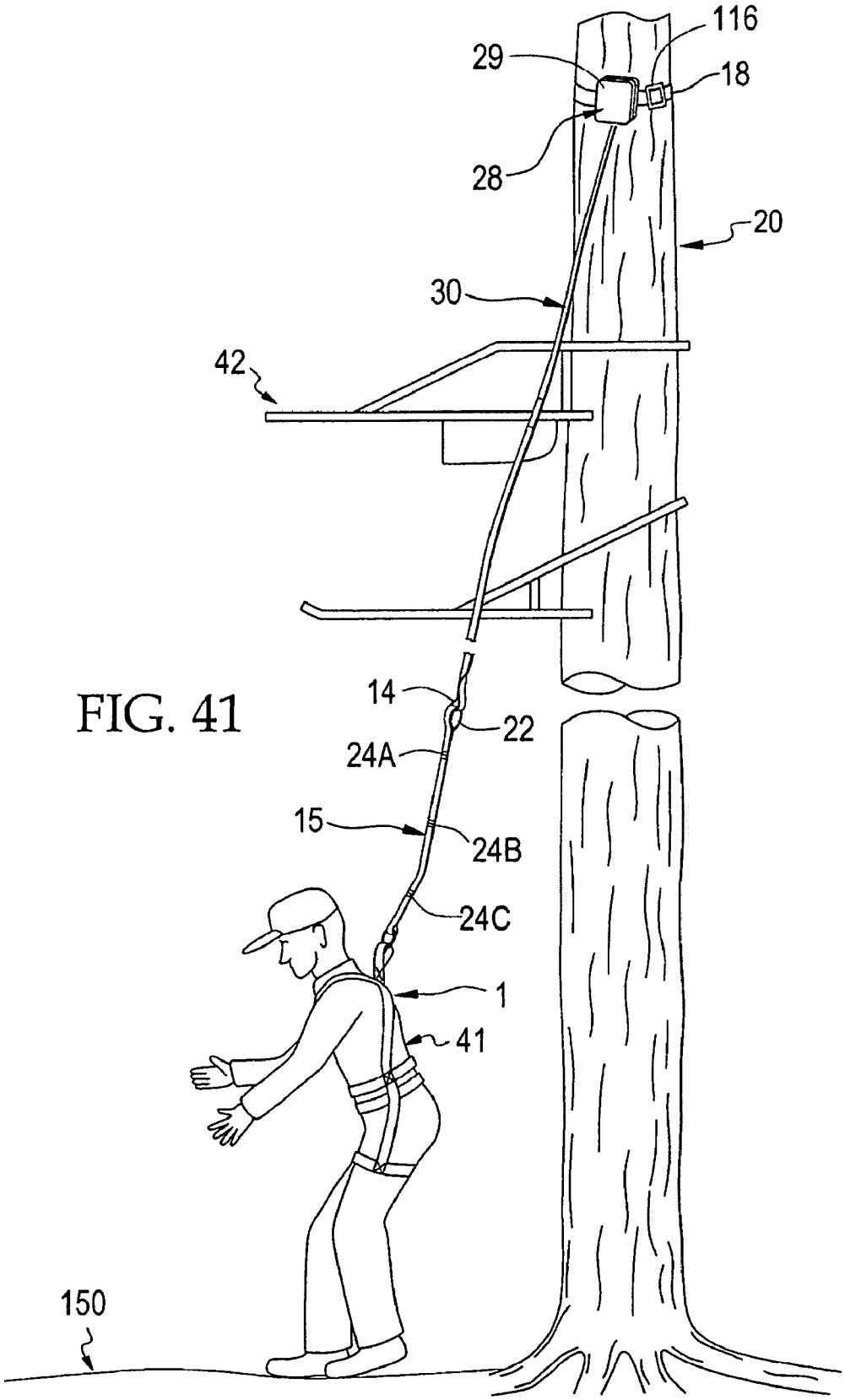
FIGS. 41-50 show views of an alternate configuration for a fall protection system with a controlled descent device that is securely mounted to the trunk of a tree, pole, or other elevated structure in accordance with one embodiment of the present invention.

Referring to FIG. 41, one embodiment of the invention is shown, including, in combination, a controlled descent device 28, attached to an elevated point on a tree 20, by a tree-anchor belt or strap, which may also be configured as a cable, cord, or chain 18. Such belt, strap, cable, cord, or chain may be included of a material having a high tensile strength such as a webbing constructed of polyester, nylon, or other polymers, a twisted or braided rope or cable constructed of nylon, polyester, or other polymer or composite-polymer material, or fabricated from twisted, woven, or braided strands of metal, or connected links of fabricated metal, such as steel or stainless steel. Such tree-anchor belt, as shown in FIG. 41, is manufactured from a high-strength polyester woven webbing material, and is equipped with a fastening and tightening mechanism, such as a buckle 116, which may likewise be formed of a polymeric, metallic, or composite material. Further, the combination of the embodiment as shown includes a length of webbing or line 30, which has been gradually pulled from a coil of such webbing stored within the enclosure 29 of the controlled descent device 28 by the weight of a hunter 41 who has experienced a fall from a treestand 42, which hunter 41 was wearing a fall-arresting safety harness 1 which is connected, as shown, to the emergency-descent webbing 30 via an attached shock-absorbing safety tether 15, via loop 22 in such tether, and loop 14 at the lower end of such emergency descent webbing or line 30.

Note that upon experiencing the fall, the hunter came to the end of the shock absorbing tether 15 during his descent, whereupon a series of sewn-in, tear-away shock-absorbing strips 24A, 24B, and 24C, respectively have deployed to reduce the impact force of such fall on the body of the hunter 41. Likewise, upon such fall and deployment of the shock-absorbing strips 24A, 24B, and 24C of the safety tether, the load forces exerted by the downward momentum of the hunter during his initial descent caused the webbing 30 to begin to be pulled forcibly from the controlled descent device 28. During such initial fall and thereafter, the rate of descent of the hunter 41 is limited and controlled by the braking system internal to the controlled descent device (shown in subsequent Figures), which prevents the webbing or line 30 from being paid-out rapidly, thereby maintaining a safe and gentle descent rate for the hunter 41, until he reaches the ground or some other intermediate place of safe support 150, and can once again stand on his own. If the hunter 41 had not had a controlled descent device 28 such as is shown, installed between his shock-absorbing tether 15 and the anchor belt 18, he would have been suspended in mid-air, and could be subject to the effects of suspension trauma involving interrupted blood flow to the brain and possible death, within a very short period of time. Even if such suspension trauma happened to be avoided, the hunter 41 is left in a helpless position hanging from the tree.

While certain highly agile and athletic individuals might be able to extricate themselves from such a situation by hugging the tree, then cutting the tether, and gradually climbing down the shaft of the tree trunk, such individuals include a minority of hunters, most of whom would be severely injured or killed if they attempted such a maneuver. Even if the hunter 41, had he been suspended without benefit of the controlled descent device 28, and had been fortunate enough to have had comrades come to his aid, bringing someone down from such a precarious situation is also extremely dangerous to all involved. Hence, the benefit of using the controlled descent device 28 in combination with a fall-arresting safety harness 1 is readily apparent.

Figure 42:
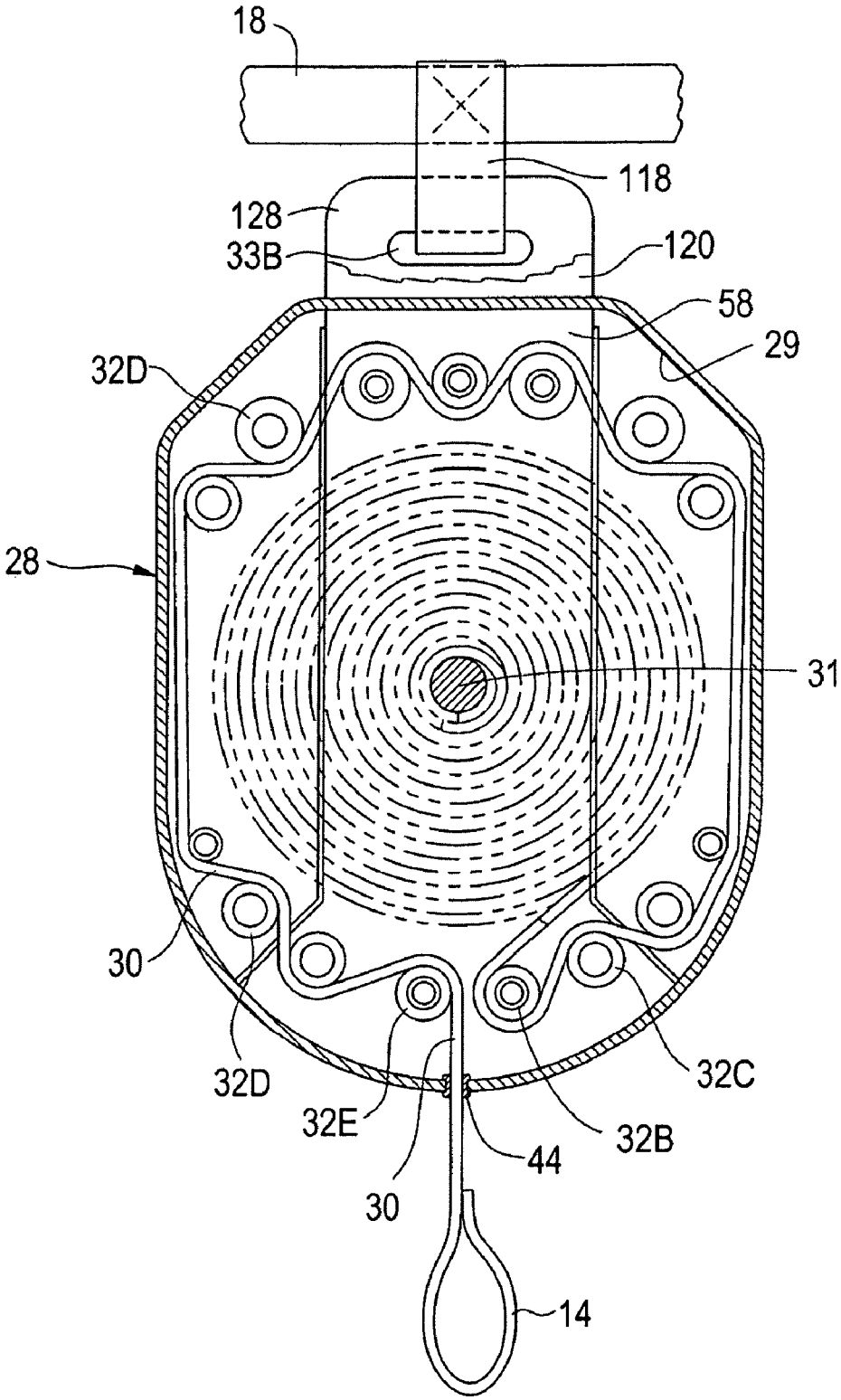

Referring now to FIG. 42, the controlled descent device 28 of the invention, in an embodiment, includes a housing 29, and housing cover 29A, which contain and protect the store of emergency-descent webbing or line 30. One embodiment of a structure utilized for attaching such controlled descent device 28 to a tree or other elevated structure is shown, including an upper extension 120 of the interior base plate 58 and top plate 128. Such upper extension 120 is fitted with a slot of or other opening 33B, to accept passage of a connecting member 118, which as shown is constructed of a polymeric high-strength webbing material, but which may also include a carabineer, snap, chain link, or other mechanical connection, which connecting member 118 connects the controlled descent device to a tree-or-post anchor belt, cord, cable, chain, or line 18, which is in turn equipped with a device such as a buckle 116 to allow securing the controlled descent device 28 to such tree or other elevated location, and tightening of such connecting member 116 to such tree or other elevated position. The loop 14 in the lower end of the stored length of emergency descent webbing, by which the device is connected to a shock-absorbing tether of a fall-arresting safety harness or belt, or directly to such fall-arresting safety harness or belt, is also clearly shown.

FIG. 42 shows an embodiment of the controlled descent device 28 of the invention, depicting the array of internal braking bars 32B, 32C, 32D, and 32E, the positioning of which include a serpentine path through which the emergency-descent webbing 30 passes on its way to exiting the housing 29 of the controlled descent device 28 at the location of the weather-seal grommet 44 at the lower end of housing 29. The stored coil of emergency-descent webbing can be seen, as well as the path which it traverses around and through the serpentine path included by the strategically-placed braking tubes or bollards 32B-32E. Also shown is the mounting extension 120 of base plates 58 and 128, through which connecting member 118 is passed, and which joins the controlled descent device to tree-or-post anchor belt 18. At the center of the coil of emergency-descent webbing is shown a central bar or pin 31, which is inserted into loop 30A at the upper terminal, bitter end of the webbing 30. Such pin 31 is not attached or affixed on either end to any structure, but rather, fits snugly within loop 30A, and rotates with loop 30A as the webbing 30 is gradually withdrawn after a fall.

Figure 43:
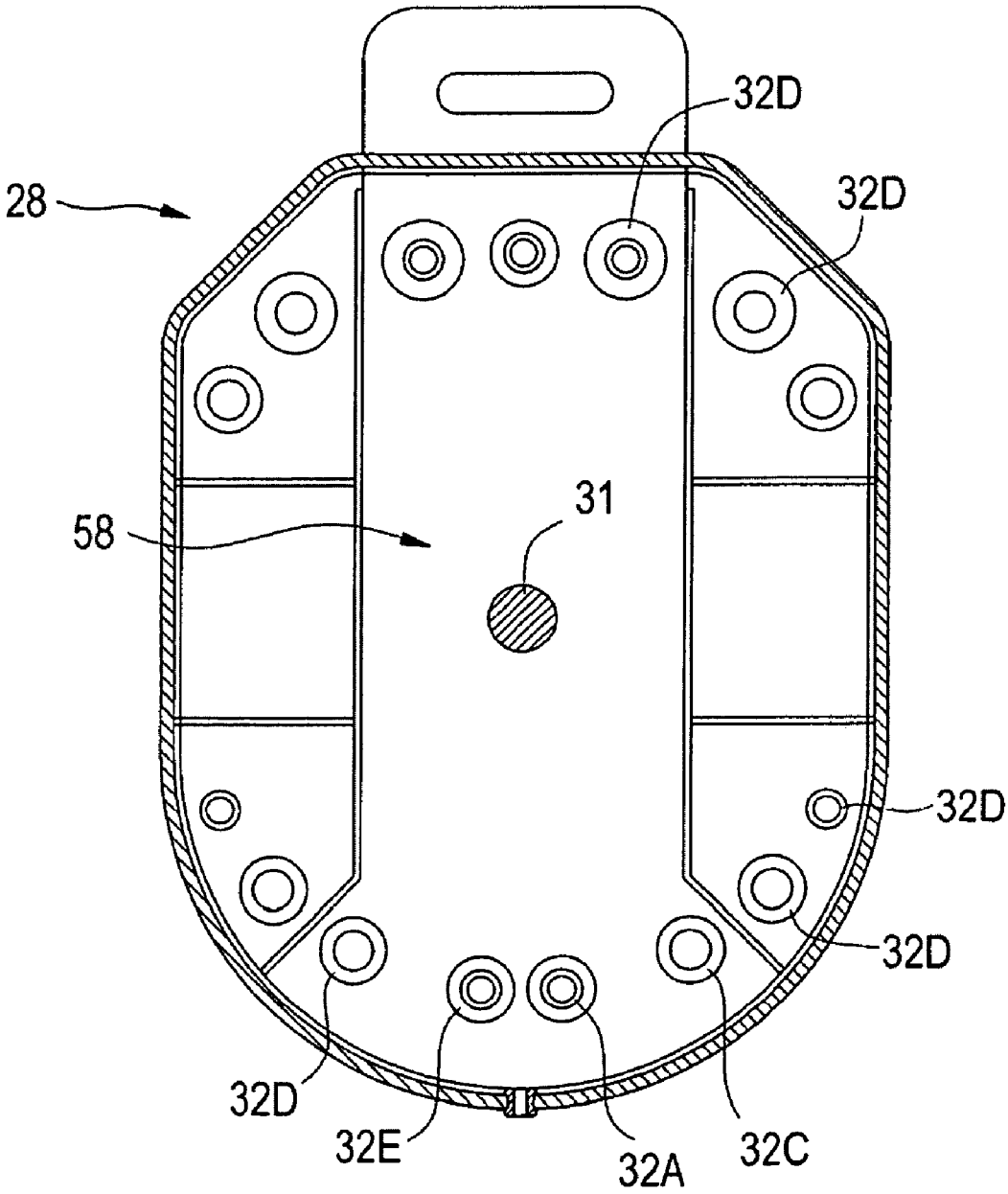
Figure 44:
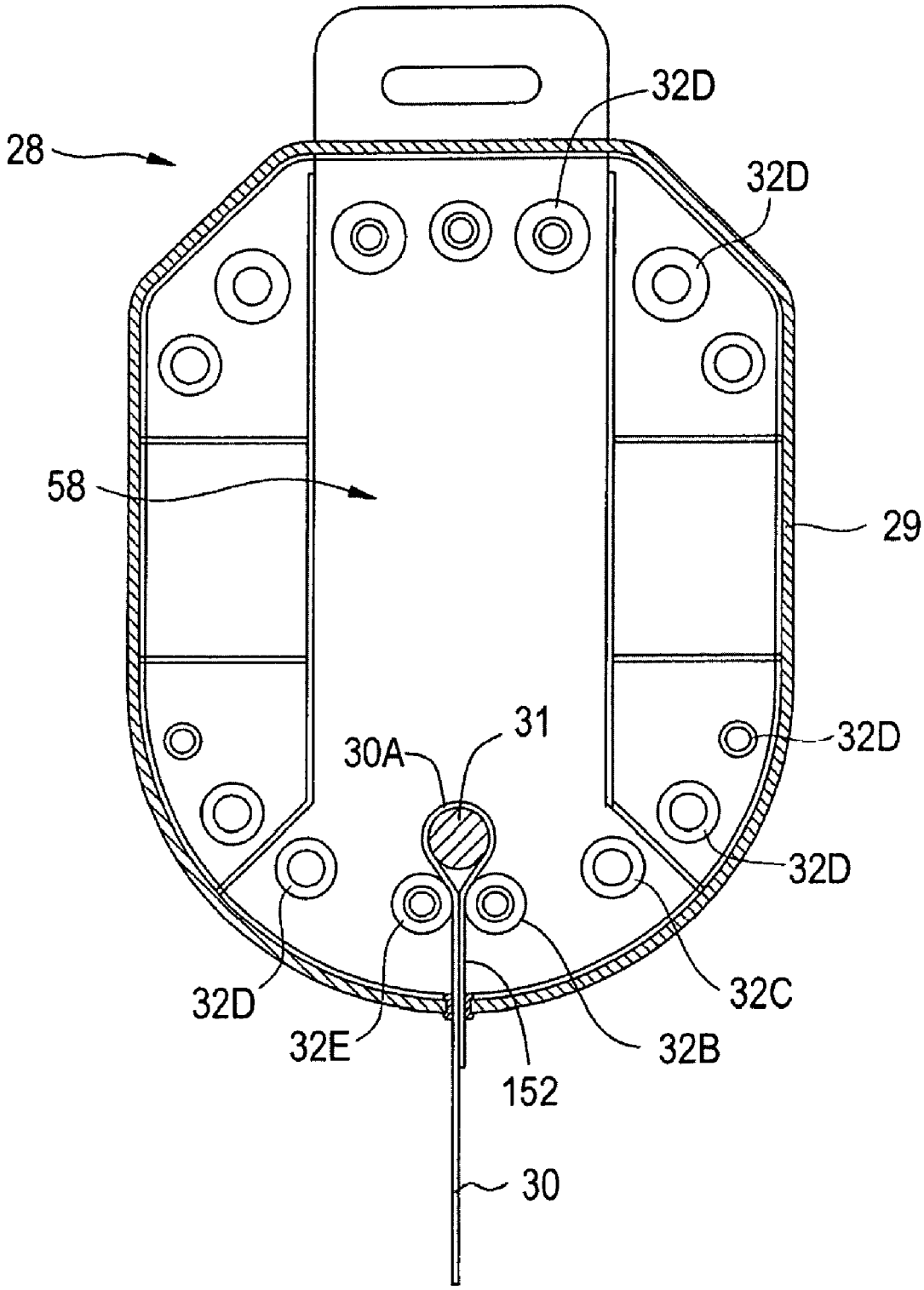

In FIGS. 43 and 44, top plate 128 has been removed, along with the coil of webbing 30, in order to show the metal braking tubes or bollards 32B-32E as they are attached to base plate 58. Also shown are intermediate guide and braking bars 32D, which in this embodiment are shown as molded into and integral with the bottom half of enclosure 29. Also in this embodiment, a central axle pin 31 is shown, which pin inserts into the terminal loop 30A at the upper, bitter end of the emergency-descent webbing 30, to include a positive stop when the full extent of such emergency-descent webbing 30 has been extracted from the controlled-descent device 28.

FIG. 44 shows that as the full amount of the emergency-descent webbing is withdrawn from the controlled descent device enclosure 29, when the end of the webbing is reached, loop 30A, containing pin 31 is of such a diameter that the assembly cannot pass through the gap 152 between the first and last braking tubes 32B, 32E, thereby including a positive stopping mechanism to prevent further escape of the remaining emergency-descent webbing 30 from the enclosure 29 of the controlled descent device 28.

Figure 45:
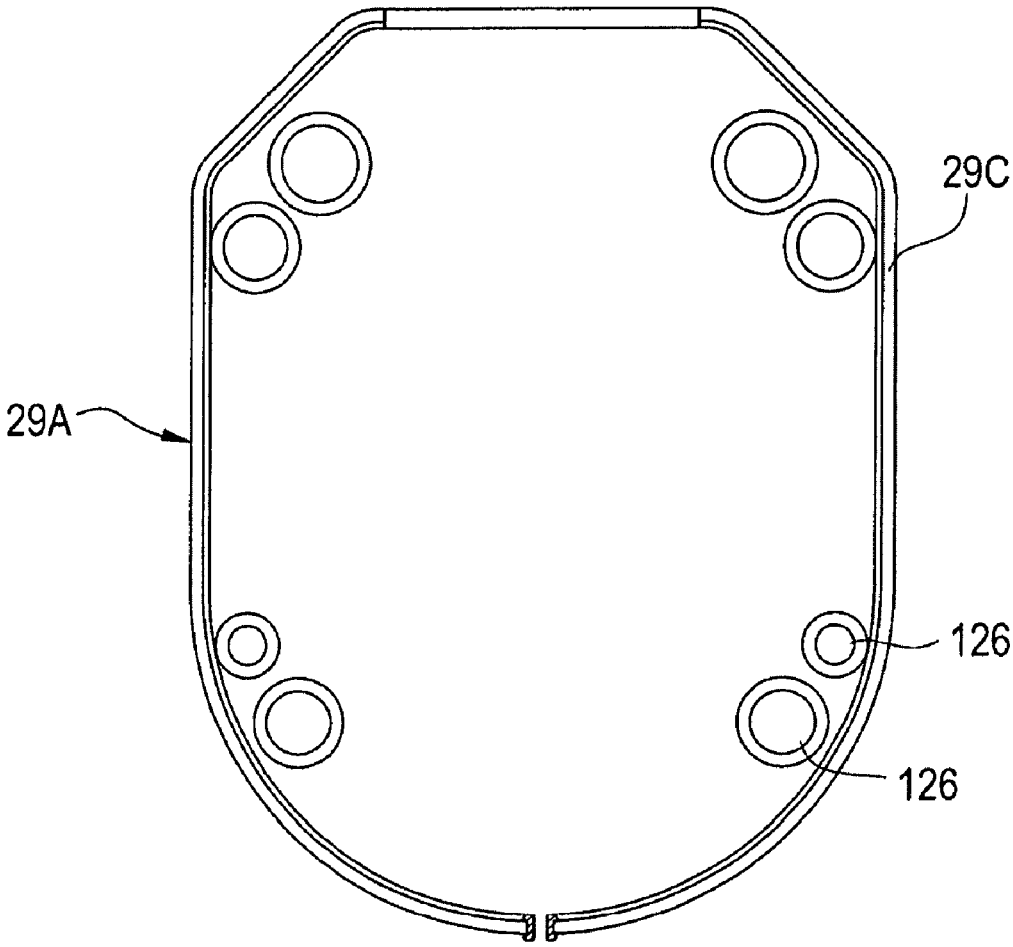
Figure 46:
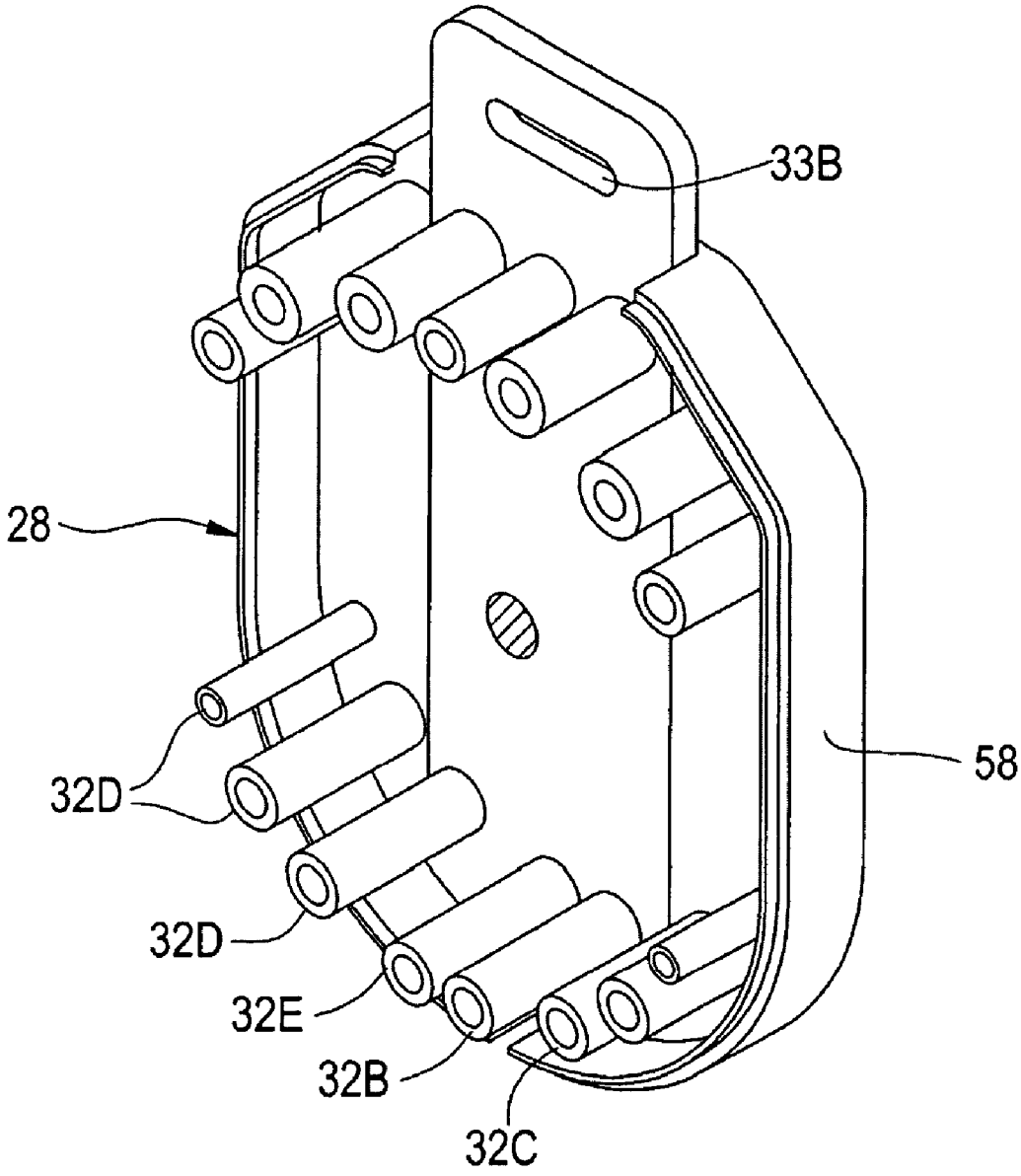

FIG. 45 is an interior view of the enclosure lid 29A which shows molded in tubes 126 which serve as guide and support receptacles for the ends of molded-in guide and brake tubes 32D, as shown on other Figures. Such guide and support receptacles provide support and strength to such tubes, in order to increase the sideways load-bearing capacity and rigidity of such tubes 32D, and also serve as guides for such braking tubes 32D during assembly when top lid 29A is attached to the bottom half of enclosure 29. A grommet-seal 29C made of resilient elastomeric or other resilient material is provided around the perimeter of lid 29A, to provide a weather-tight protective seal when lid 29A is joined with bottom enclosure section 29. FIG. 46 is a perspective view showing the various braking and guide tubes 32B-32E inside the enclosure 29 of the controlled-descent device 28. Upper plate 128 has been removed to better illustrate this configuration of the braking and guide tubes. Base plate 58 is shown, with braking bars 32B-32E attached.

Figure 47:
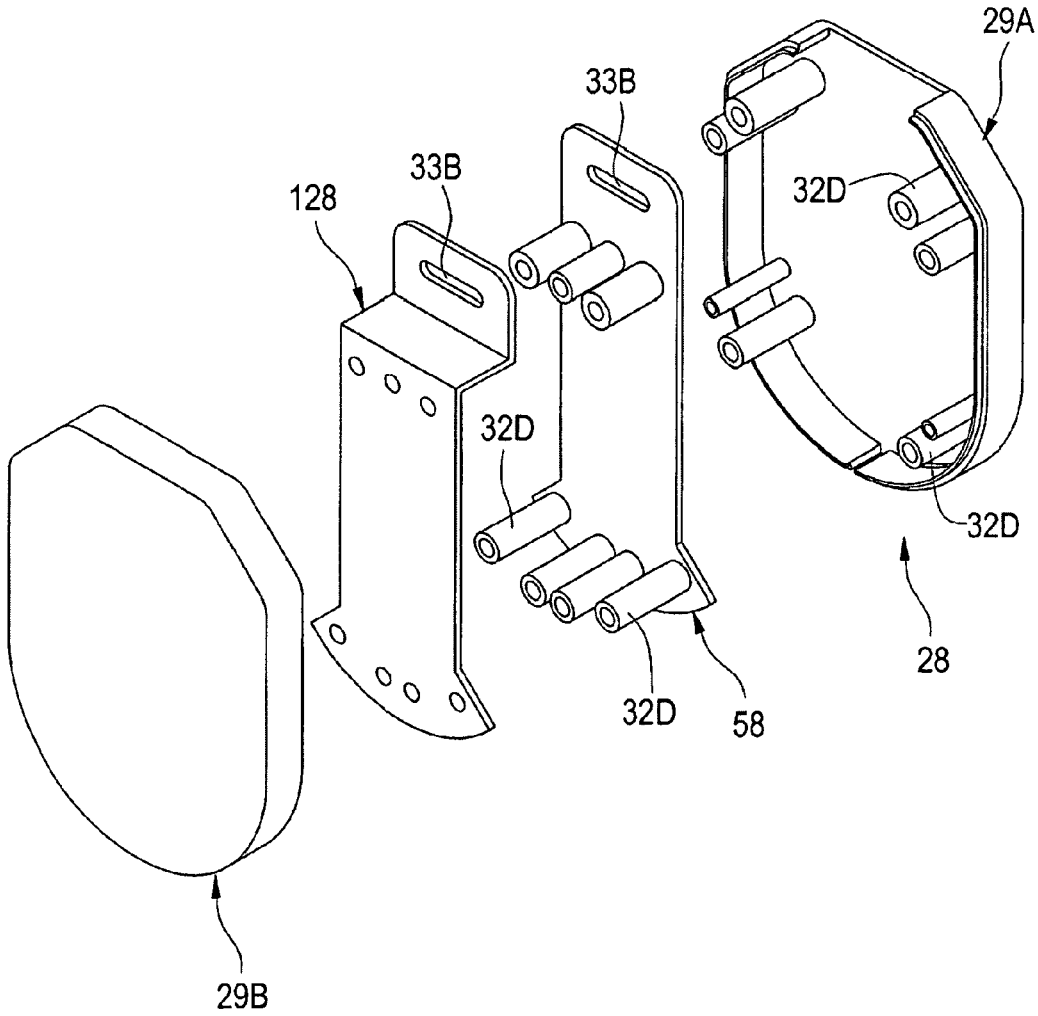
Figure 47A:
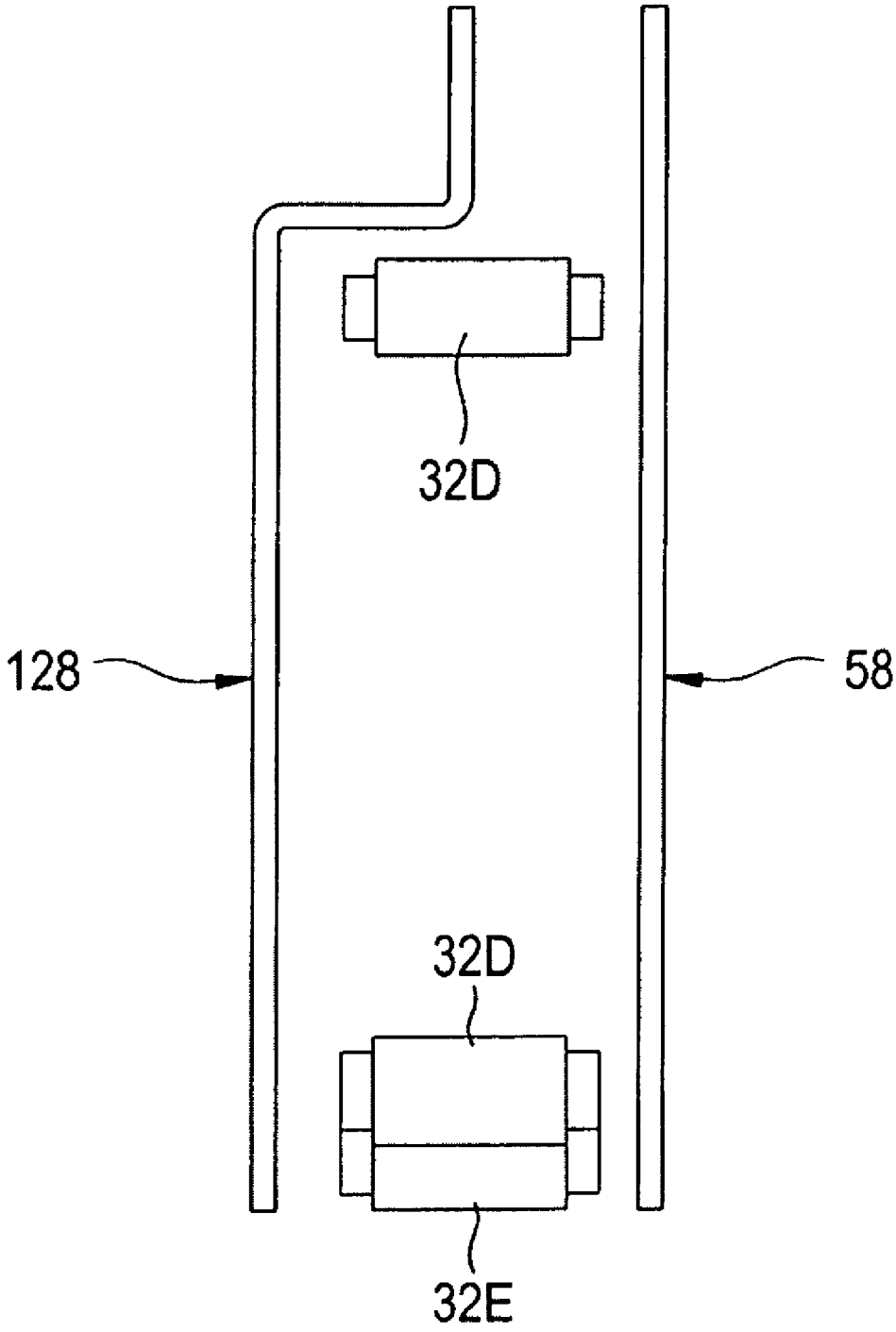
Figure 47B:
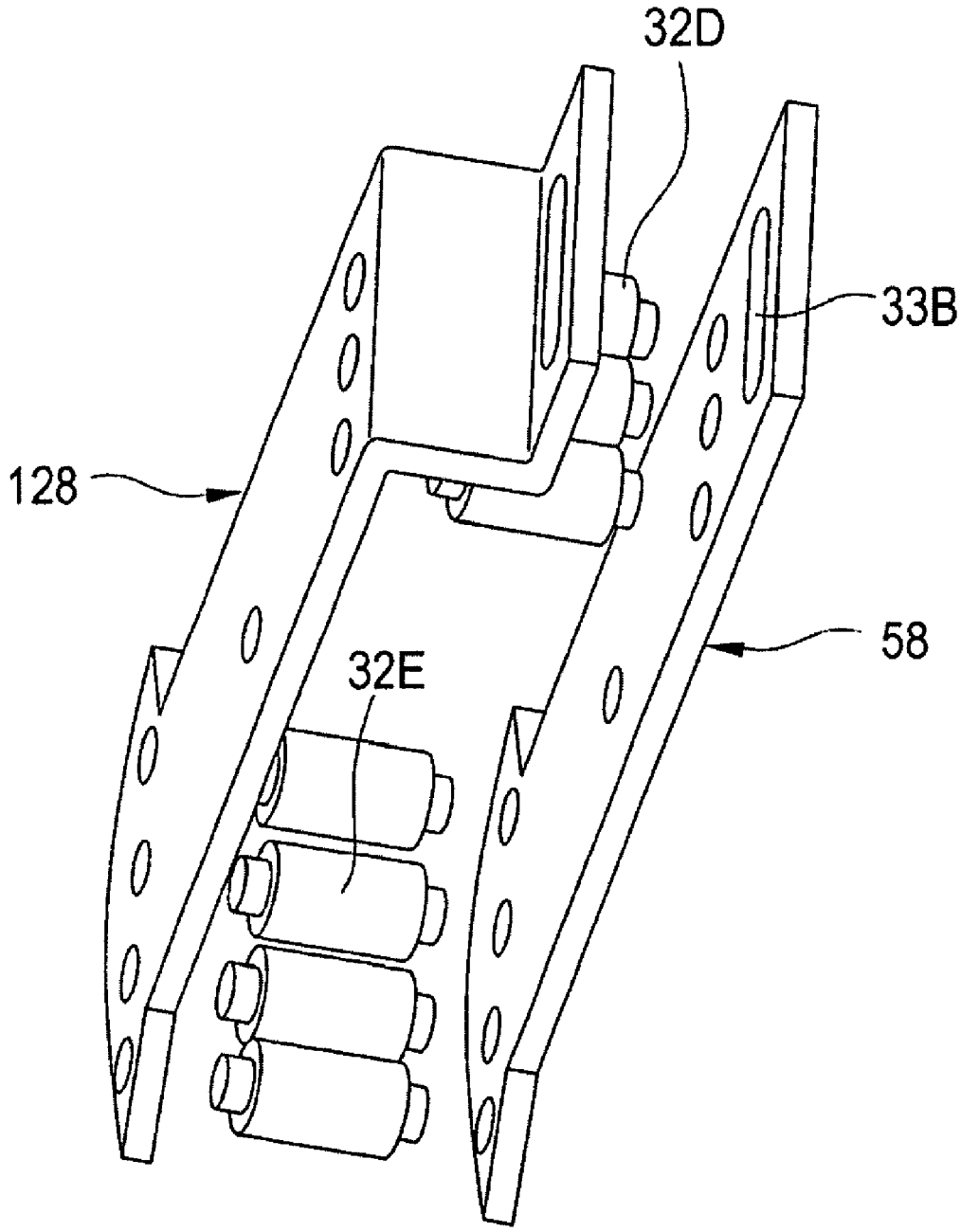

FIG. 47 is a comprehensive exploded perspective view of an embodiment of the controlled-descent device 28, showing braking bars 32B-32E sandwiched between upper plate 128 and base plate 58, where such braking bars are subsequently firmly attached via such mechanical connections as press-fitting, swaging, screws, through-bolting, welding, or riveting. The relationship of the bottom enclosure half 29A is clearly shown to the molded-in or otherwise attached braking and guide tubes, and to the upper lid 29B of the enclosure. Note that base plate 58 and upper (or outer) plate 128 could be extended over the full width of the device, and all braking and guide bars could be made of metal and attached to these two plates via various mechanical fastening devices, as described above. FIG. 47A is an exploded side view showing the relationships of base plate 58 to braking tubes 32D and 32E, as well as to upper (or outer) plate 128. FIG. 47B, likewise, is an exploded perspective view showing the relationships of the upper (outer) plate 128 and base plate 58 to braking bars 32D and 32E.

Figure 48:
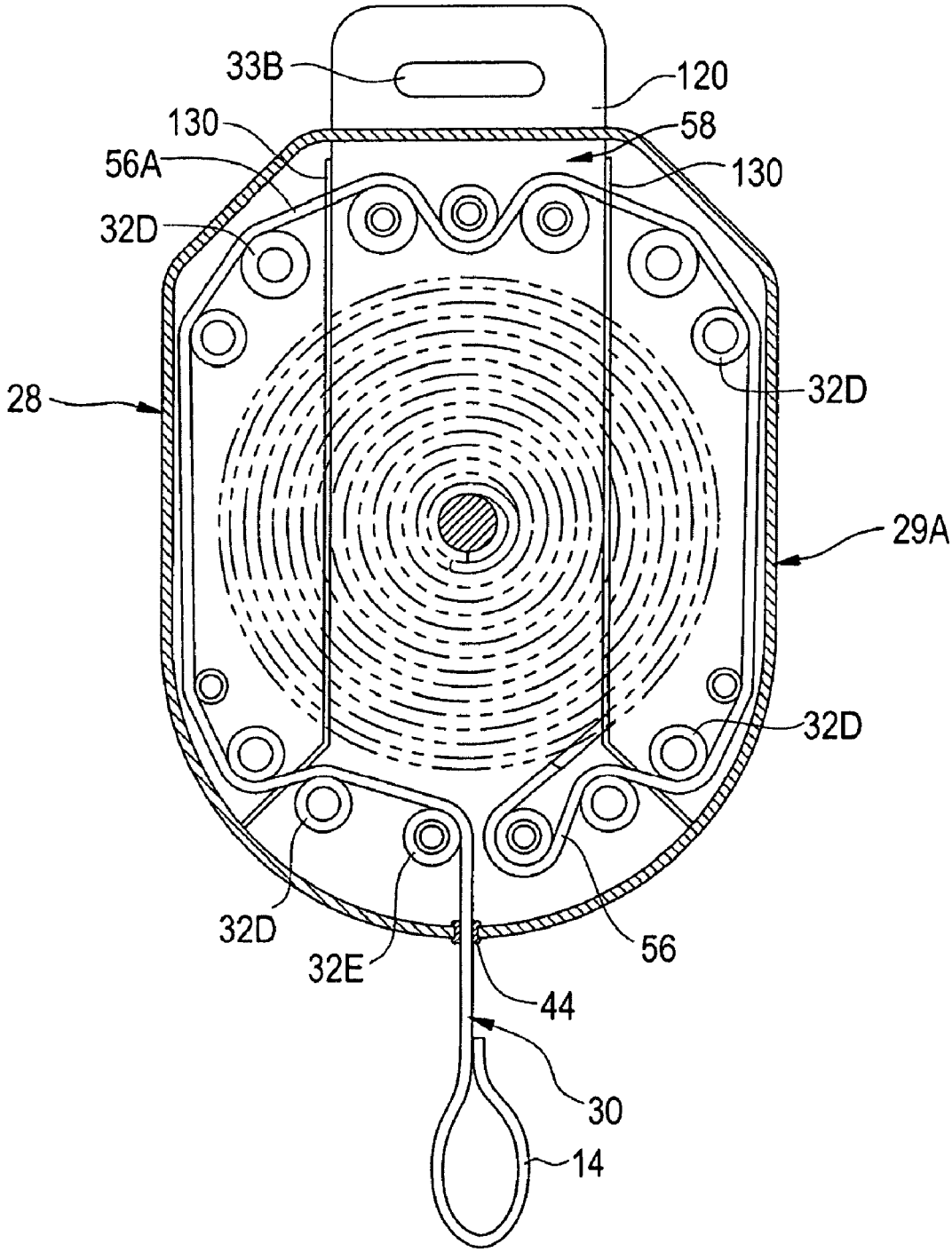

In FIG. 48, it can be seen that the serpentine path 56 of the emergency-descent webbing 30 has been altered, as at 56A, such that the webbing encounters fewer braking tubes, and is thereby less-restricted as to its rate of payout from the enclosure 29 of the controlled-descent system 28. Such an arrangement is illustrative of a number of variations of the geometry, as shown, which may be employed to increase or decrease the amount of force (weight) required to produce a descent, to adapt such controlled-descent device easily for use by persons outside the normal weight range for which the basic braking system geometry is designed to accommodate. Note, also, that in this view, molded-in reinforcing ribs 130 are shown, which ribs are intended to provide additional rigidity and strength to the enclosure 29 of the controlled-descent system 28.

Another embodiment of the improved fall-protection system of the invention includes (A) a controlled-descent system 28 having an attachment devices 18 to a tree or other elevated structure 20, which attachment device in this case may include a belt, strap, rope, line, or cable or other high-strength member; and (B) a dangling or free-hanging section of such attachment device, and (C) a releasable rope or cable clamp or the like attached to controlled-descent device 28, and designed to positively and securely grip such free hanging section when downward force is exerted upon the controlled-descent device 28, so as to enable the point of attachment of said brake or clamp to free-hanging section to serve as an anchor point, from which a fall could be arrested via a fall-protecting safety harness, followed by a safe descent to the ground after the fall, at a controlled, gradual descent rate.

Such an embodiment would include a full-body fall-arresting safety harness 1, or at least a safety belt or chest-type safety harness or vest. The purpose of such an embodiment is to enable constant protection against falls, and controlled-descent capability, throughout the process of ascending from the ground to an elevated position in a tree or other elevated structure. As the user, in this case a hunter 41, ascends to an elevated position as shown, the present embodiment allows him to keep the controlled-descent device near him and attached, for fall-protection, as he climbs, simply by sliding the controlled descent device and its related rope or cable clamp or brake upward along the length of the dangling or free-hanging member, in increments, as he climbs, such that if he should fall at any point during his ascent, or later during his descent, his fall can be arrested by the shock absorbing safety tether 15, and his fall-arresting safety harness, and followed by an automatic gradual descent back to the ground at a controlled and safe rate of descent.

Figure 49:
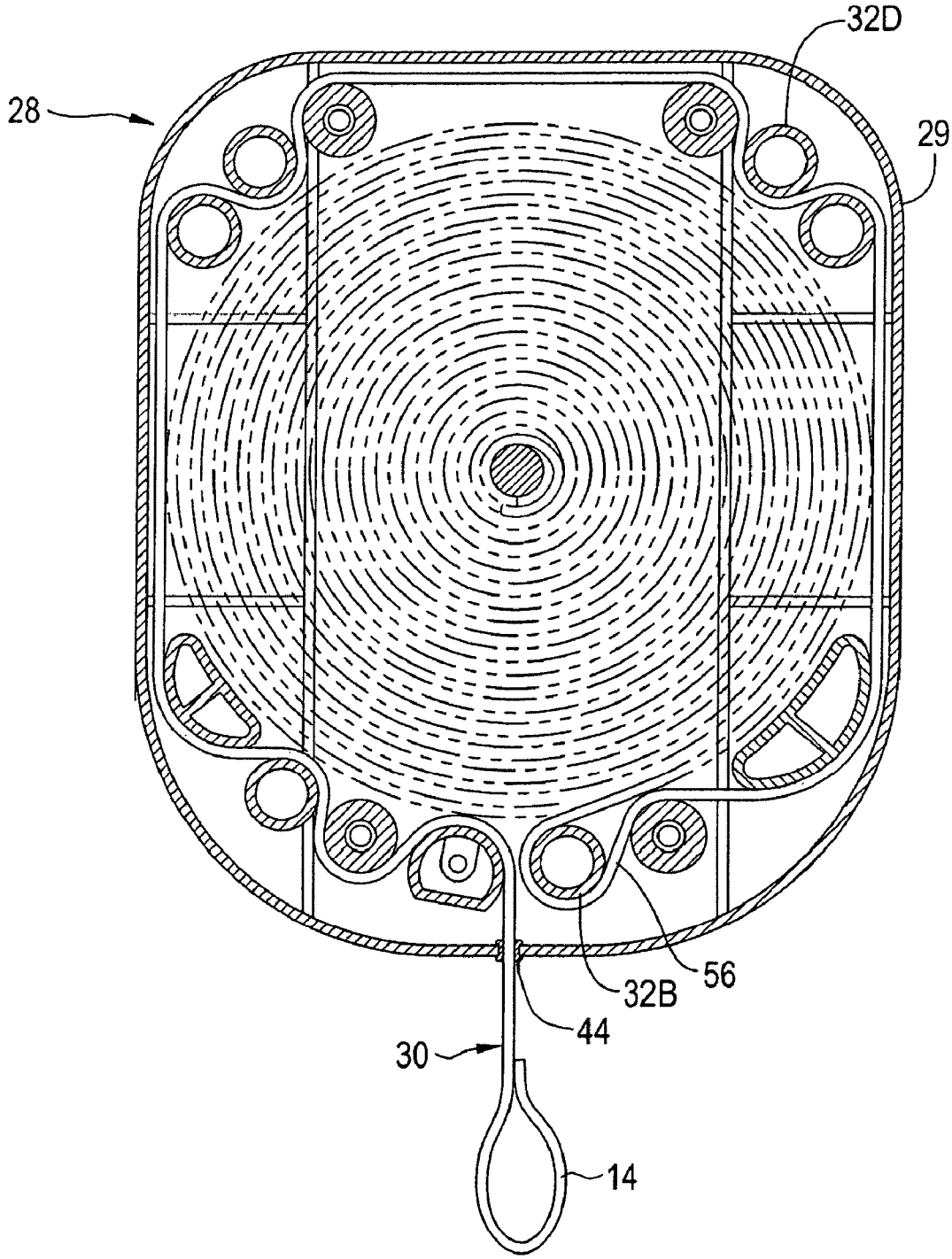

In FIG. 49, an embodiment of the internal braking geometry, braking components and overall configuration of the controlled-descent device of the invention is shown. The lid 29A of the enclosure 29, as well as the upper (outer) plate 128, have both been removed to more clearly show the interrelationship of the braking tubes 32B-32E, and the braking/guide pads, as shown. Employing the geometry as shown, and utilizing the braking/guide pads, which are made from an extruded or molded or die-cast material such as a thermoplastic resin, composite thermoplastic or composite thermosetting resin, or a metallic material, enables and facilitates the creation of an extremely compact package, such that the enclosure 29 of the controlled-descent device 28 can be very space-efficient, small, and light-weight. Likewise, the use of components which are extruded, machined, die-cast, or molded to create a serpentine path 56 that fits into a more compact space than simply cylindrical braking tubes such as 32B would permit, can result in greater simplicity, reliability, strength, and compactness.

Such compactness is an important element if people are to be motivated to actually carry the controlled-descent device 28 with them and use it when they go to hunt or work at elevated locations off the ground. Likewise, the compact and efficient geometry of the braking and guide bars 32D at the upper corners of the controlled descent device 28 further enable a small, lightweight package, and facilitate the revision of the geometry of the serpentine path 56 followed by the webbing 30 as it passes around and through the braking system. A major benefit of this geometry, and other similar geometries shown elsewhere herein, is that the configuration allows for adjustment of the frictional braking force applied to the webbing 30 in the event of a fall by a user, which user is of a weight substantially lighter or heavier than the nominal weight ranges for which the basic geometry is designed. A further advantage is that the geometry places the braking tubes sufficiently apart from one another that, unlike conventional rappelling racks or figure-8 rappelling accessories, heat-buildup from braking friction is allowed to dissipate so readily that there is no apparent increase in temperatures experienced by the webbing or by the braking components throughout a descent of up to 30 feet at a rate of up to 3 feet per second.

Additionally, an important characteristic of the novel geometry of a controlled descent device of this embodiment of the invention, as shown in FIG. 49 and other figures herein, is its unique ability to self-compensate for different loads which may be applied, with no need for failure-prone moving parts, actuators, or adjustments of any kind. In other words, the geometry of the fixed-position components of this braking system is such that if the device is used by a relatively light-weight user weighing, for example, 135 pounds, the lower weight of the wearer exerts less force, and thereby creates less friction, upon the braking tubes and other components of the frictional braking system, thereby increasing the rate of descent to a velocity which ends up being very close to the same as the velocity or descent rate for a much heavier person. Correspondingly, a heavier person would exert more sideways force and generate more frictional resistance on the braking bars 32B-32E or other components along the serpentine path 56 of the breaking system, which additional friction would provide greater resistance to movement, resulting in a correspondingly lower descent rate (per pound of weight) than might otherwise be expected.

This phenomenon results in the novel capability, unique to this invention, to provide self-compensation for users of different weights, to provide relatively similar rates of descent for such users, within a nominally acceptable range, without resorting to moving parts, adjustment mechanisms, or elaborate assemblies, such as centrifugal brakes or clutches. The rationale and physics behind this phenomenon arise from the fact that heavier weights tend to generate more frictional drag, which keeps heavy users from descending at excessively fast or dangerous rates, while the lower weight of lighter users imparts less frictional drag, permitting the webbing 30 to be withdrawn more easily, thereby keeping the descent rate of such light-weight wearers from being too slow.

Figure 50:
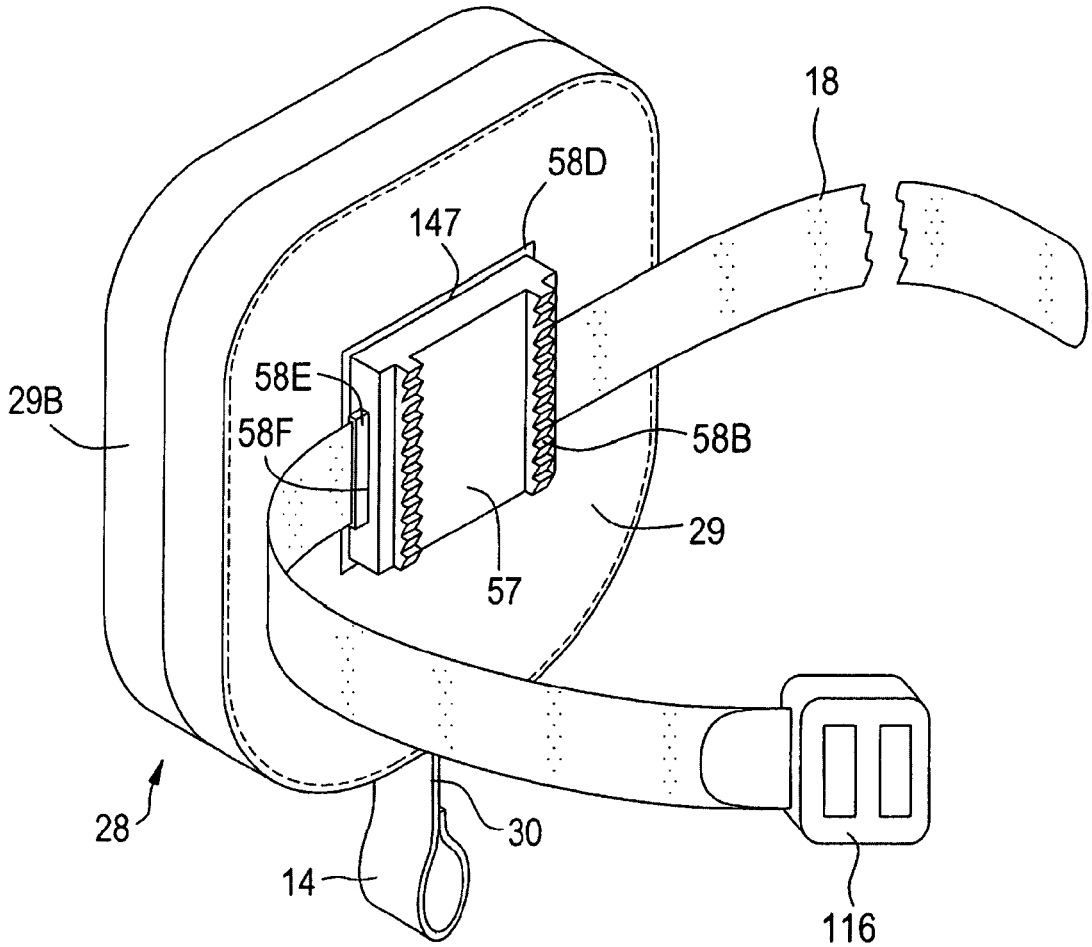

Referring to FIGS. 47 and 50, an embodiment of a controlled descent device 28 for use by hunters, climbers, or persons working at elevated heights includes a base plate 58, an outer plate 128, a coil of webbing or line 30 which terminates at its lower end in a loop 14 to permit attachment to a fall-arresting safety harness, belt, or other such device, or a shock-absorbing tether which may then be attached to such fall-arresting protective device. In this configuration, the base plate 58 is fitted with a rearward projecting boss member 57, which boss member is equipped with a vertically elongated opening 58F which extends through the full width of said boss member, which opening is sized to receive a suitable attachment and anchoring device 18, such as a belt, strap, cable, chain, rope, line, or cord, which is adapted for use in securely attaching the controlled-descent device to a tree or other elevated structure 20, and fitted with a coupling and tensioning device such as a buckle or ratchet 116, for purposes of tightly securing the controlled-descent device 28 against said tree or other elevated structure 20. Such attachment and anchoring device 18 may be made of a high-strength webbing material made of a suitable polymer such as nylon or polyester, or may be configured as a cord or line or rope or cable made of such materials as nylon, polyester, Kevlar, stainless steel, or steel, or a chain made of a suitable metallic substance such as steel or stainless steel.

One way of attaching the braking tubes 32D to the base plate 58 and outer plate 128 is shown, involving the use of machine screws threaded into mating threaded holes in such braking bars 32D. Several of such machine screws can be positioned around the rim of the lid 29B and rear housing 29A, to affix such lid 29B and enclosure 29A to the base plate 58 and outer plate 128, and to join such lid 29B and enclosure 29A together where they meet around the circumference of such enclosure, at which point a resilient sealing gasket 145 is positioned. By virtue of the two halves of the enclosure 29 being held forcibly together by the machine screws, the gasket 145 is compressed, to produce a weather-tight seal against the elements, and to prevent water intrusion or the intrusion of dust, foreign objects, pests, or any other contaminant which might degrade the internal components of the controlled-descent device 28. The boss member 57 protrudes through the back wall of enclosure 29, and an environmental seal is likewise provided between such enclosure 29 and the boss member 57 by a grommet 147, which grommet 147 may be constructed of a suitably resilient material such as an elastomer which exhibits environmental suitability for such application.

In the area of the attachment belt or other attachment mechanism 18 which is inside and immediately adjacent to the boss member 57, said attachment belt or other attachment mechanism 18 is, in the embodiment shown, equipped with a reinforcing chafe-protector including a segment of high-strength webbing or other appropriate sleeveing material which is permanently affixed to such belt or other attachment mechanism 18 in that area along the length of the belt or other attachment mechanism 18 which is inside or adjacent to the opening 58F through boss member 57. Such reinforcement sleeveing 58E is provided to afford greater protection to the belt or other attachment mechanism against the effects of chafing or shearing which may result from sudden downward jolts on the controlled-descent device which may occur during a fall, and more particularly during the arrest of a fall. Other techniques may be employed to protect and insulate the belt or other attachment mechanism 18, such as encapsulation with a surrounding layer of an elastomeric or other strong but resilient material, such as polyurethane, internal grommets positioned with and along the length of opening 58D, and radius-chamfering of the edges of the opening 58F.

FIG. 50 likewise is a rear perspective view of an embodiment of a controlled descent device 28 which shows many of the same components as other embodiments, including the enclosure 29 and lid 29B, the belt or other attachment mechanism 18, the coupling and tensioning device 116, the emergency-descent webbing 30, webbing termination loop 14, gasket 29C, gasket 44, rearward-protruding boss member 57, opening 58F, and shielding member or sleeve 58 E. In addition, a set of rearward-projecting gripper-teeth are shown as machined or extruded into the rear face of boss member 57. The purpose of such gripper-teeth is to achieve a "bite" or grip on the surface of the tree or pole or other elevated structure to which the controlled-descent device is attached, in order to enhance the resistance to vertical, especially downward, movement of the controlled-descent device 28 in the event of a fall, wherein the momentum of the falling user would apply great downward pressure on the webbing 30, the controlled-descent device 28 itself, the braking system inside enclosure 29, and the belt or other attachment mechanism 18 which is used to secure the controlled-descent device to the tree or other elevated structure. By minimizing the vertical movement of the body of the controlled-descent device 28 during the arrest of a fall, the forces, particularly shearing forces, exerted upon the belt or other attachment mechanism 18 are minimized, as well, decreasing any probability or likelihood that damage could occur to such belt or other attachment mechanism 18, particularly in view of the additional protection also offered by the protective reinforcing sleeve 58E, and any radiusing of the corners of opening 58 F.

Figure 51:
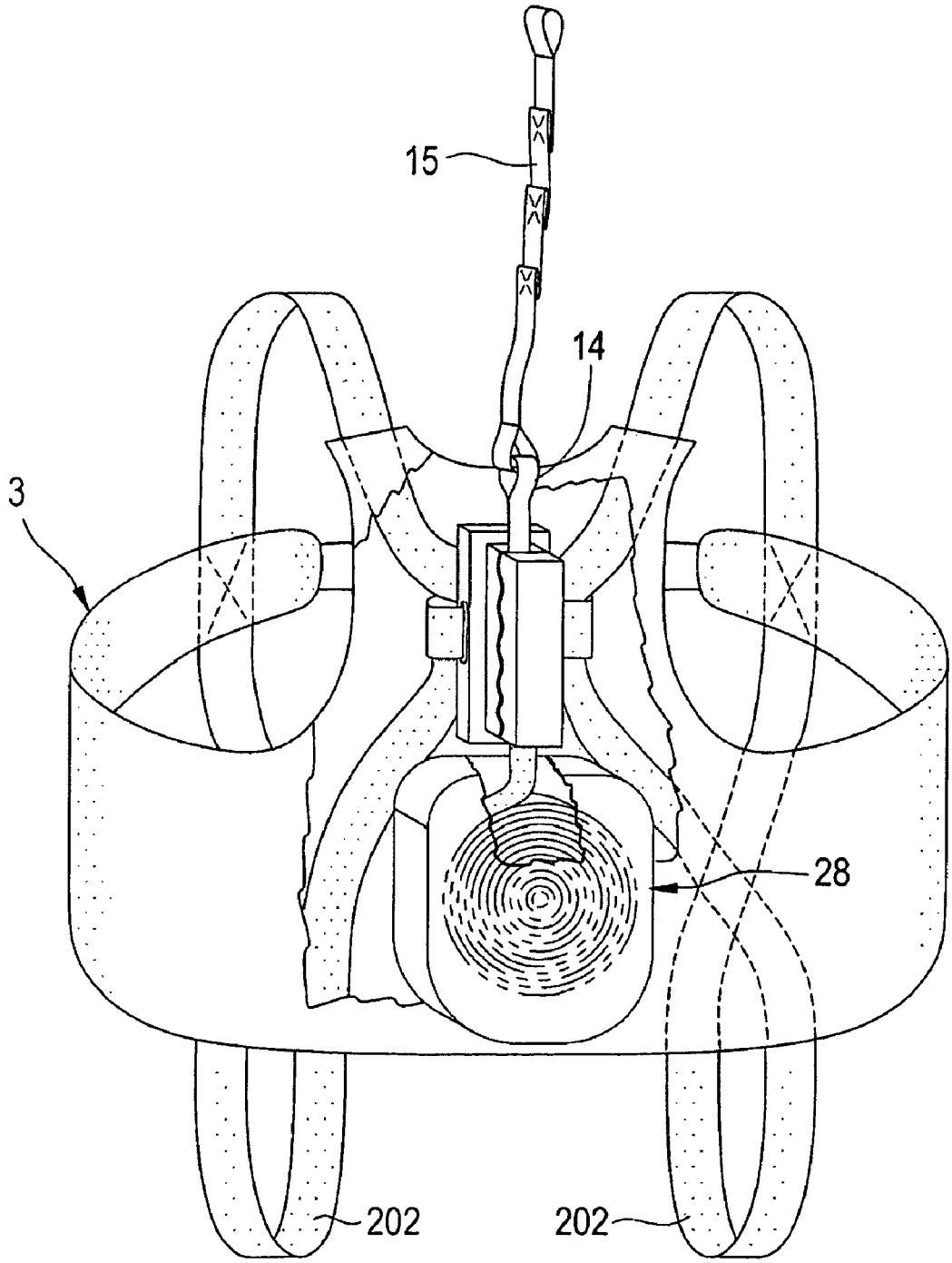
FIG. 51 shows a view of an alternative design for an improved safety harness with a descent control system in accordance with one embodiment of the present invention.

FIG. 51 is a rear perspective view of an alternative embodiment of the present invention. This embodiment includes a padded waist belt 3 that has a belt buckle in front (not shown) and padded leg straps that are also buckled in front. A descent control system 28 is included with an anchor loop 14 for a sew on tether and a shock absorbing tether 15. Any of the previously described examples of a descent control system could be used with this embodiment of the invention. In other embodiments, the padding on the waist belt could be adjustable to slide from side to side for greater comfort by the user. Other options could include padded shoulder straps and a separate chest strap buckle.

While the invention has been described with respect to a limited number of embodiments, those skilled in the art, having benefit of this disclosure, will appreciate that other embodiments can be devised which do not depart from the scope of the invention as disclosed here. Accordingly, the scope of the invention should be limited only by the attached claims.

What is claimed is:

1. In a fall protection system, a descender which attaches at a first end to an elevated structure, and at a second end to the terminal end of the tether of a safety harness, to provide a controlled safe descent for a user of the fall protection system in the event of a fall; the descender comprising:

a housing; said housing formed of first and second halves removably and sealably connected to one another;

a stored quantity of descent line contained in said housing, wherein a first free end of said line extends through an opening in a side wall of the housing and a second free end of said line is in the housing; such first free end having attachment means for attaching such first free end of the descent line to the terminal end of the tether of the safety harness of such system, a braking mechanism, further comprising:

an array of generally cylindrical friction inducing members, which array includes at least four such members, each of which members has at least one friction inducing surface; which friction inducing members are non-rotatably secured between said first and second halves of the housing; said friction inducing members being spaced apart and positioned to define a convoluted path through which the descent line travels when said descent line is paid out from the housing as a result of a fall experienced by a user of the system; wherein such descent line rubs against such friction inducing members, resulting in frictional resistance to the movement of said descent line as it is pulled through said convoluted path of friction inducing members during a fall or descent of a user, thereby restricting a rate of payout of the descent line, and consequently a rate of the user's descent;

a pair of load-supporting and load-insulating mounting plates, each having a first end and a second end, which first ends are connected to and directly support at least two of such friction inducing members of said array within the walls of said housing; which at least two friction inducing members serve as load-absorbing, load-insulating members as well as friction inducing members; such pair of plates having second ends; said pair of plates being fitted at said second ends with connecting means for connecting said second ends of the plates to an elevated structure; whereby, upon occurrence of a fall by a user of the system, a majority portion of loads imposed on the descent line by the weight of the user during a drop or descent are transferred to and absorbed by the at least two load-insulating, load-absorbing friction inducing members attached to the two plates, thence to the plates themselves, then to the connecting means, and ultimately to the elevated structure, thereby insulating and protecting the housing and the remaining friction inducing members from damage imposed by such drop or descent loads, as the fall victim/user is provided with a slow and gradual descent back to the ground.

2. The descender of claim 1, wherein the friction inducing members are removably secured within the housing.

3. The descender of claim 1, wherein the friction inducing members are tubular.

4. The descender of claim 1, wherein the friction inducing members comprise cut lengths of tubular material.

5. The descender of claim 1, wherein the second end of each of the mounting plates extend through a second opening in the housing.

6. In a fall safety system, a descender which attaches at a first end to an elevated structure, and at a second end to the terminal end of the tether of a safety harness, to provide a controlled safe descent for a user of the fall protection system in the event of a fall; the descender comprising:

a housing; said housing formed of first and second halves removably and sealably connected to one another;

a stored quantity of descent line contained in said housing, wherein a first free end of said line extends through an opening in a side wall of the housing and a second free end of said line is in the housing; such first free end having attachment means for attaching such first free end of the descent line to the terminal end of the tether of the safety harness of such system, a braking mechanism, comprising:

an array consisting of a plurality of generally cylindrical friction inducing members, which array includes at least four such members, each of which members has at least one friction inducing surface; which friction inducing members are removably and non-rotatably secured between said first and second halves of the housing; said friction inducing members being spaced apart and positioned to define a convoluted path through which the descent line travels when said descent line is paid out from the housing as a result of a fall experienced by a user of the system; wherein such descent line rubs against such friction inducing members, resulting in frictional resistance to the movement of said descent line as it is pulled through said convoluted path of friction inducing members during a fall or descent of a user, thereby restricting a rate of payout of the descent line, and consequently the rate of a user's descent;

which friction inducing members are held in place between the two inner walls of the housing by positioning them upon mating mounting structures within the housing, eliminating the need for fasteners; and a pair of mounting plates positioned separate from the housing, each having a first and a second end, which first ends of such plates are connected to and directly support the at least four friction inducing members of said array within the walls of said housing; wherein the second ends of such plates are provided with connecting means for connecting said second ends of the plates to an elevated structure; whereby, in the event of a fall by a user of the system, the friction inducing members absorb loads imparted upon the descent line by a user's fall or descent, and insulate the housing from the damaging forces of such loads by transferring such loads to the load-bearing mounting plates, thence to the connecting means connecting the two load-bearing mounting plates to the elevated structure, and ultimately to the elevated structure, thereby enabling the housing to be constructed of lightweight materials which might not otherwise be able to withstand the loads, were they not insulated from such loads by the load-bearing mounting plates.

7. The descender of claim 6, wherein the friction inducing members are removably secured within the housing.

8. The descender of claim 6, wherein the friction inducing members are tubular.

9. The descender of claim 6, wherein the friction inducing members comprise cut lengths of tubular material.

10. The descender of claim 6, wherein the second end of each of the mounting plates extend through a second opening in the housing.

11. In a fall safety system, a descender which attaches at a first end to an elevated structure, and at a second end to the terminal end of the tether of a safety harness, to provide a controlled safe descent for a user of the fall protection system in the event of a fall; the descender comprising:

a housing; said housing formed of first and second halves removably and sealably connected to one another;

a stored quantity of descent line contained in said housing, wherein a first free end of said line extends through a first opening in the lower side wall of the housing and a second free end of said line is in the housing; such first free end having attachment means for attaching such first free end of the descent line to the terminal end of the tether of the safety harness of such system, a braking mechanism, comprising:

a first array of friction inducing members, which array includes at least four members, each of which members has at least one friction inducing surface; which friction inducing members are removably and non-rotatably secured between said first and second halves of the housing; said friction inducing members being spaced apart and positioned to define a convoluted path through which the descent line travels when said descent line is paid out from the housing as a result of a fall experienced by a user of the system; wherein such descent line rubs against such friction inducing members, resulting in frictional resistance to the movement of said descent line as it is pulled through said convoluted path of friction inducing members during a fall or descent of a user, thereby restricting a rate of payout of the descent line, and consequently a rate of the user's descent, which friction inducing members are held in place between the two inner walls of the housing by positioning them upon mating mounting structures within the housing, eliminating the need for fasteners;

a second array of load-absorbing friction inducing members, comprising at least two such members, which are connected to a pair of load-bearing mounting plates positioned separate from the housing, each of which has a first end and a second end, which first ends of such plates are connected to and directly support the friction inducing members of said second array within the walls of said housing; such plates having a second end; said pair of plates being fitted at said second, upper end with connecting means for connecting said second end of the plates to an elevated structure; whereby, in the event of a fall by a user of the system, the at least two friction inducing members absorb loads imparted upon the descent line by a user's fall or descent, and insulate the housing from the damaging forces of such loads by transferring such loads to the load-bearing mounting plates, then to the connecting means connecting the two load-bearing mounting plates to the elevated structure, and ultimately to the anchor point on the elevated structure, thereby enabling the housing to be constructed of lightweight materials which might not otherwise be able to withstand the loads, were they not insulated from such loads by the load-bearing mounting plates.

12. The descender of claim 11, wherein the friction inducing members are removably secured within the housing.

13. The descender of claim 11, wherein the friction inducing members are tubular.

14. The descender of claim 11, wherein the friction inducing members comprise cut lengths of tubular material.

15. The descender of claim 11, wherein the second end of each of the mounting plates extend through a second opening in the housing.

* * * * *